US007605787B2

(12) United States Patent
Akutsu et al.

(10) Patent No.: US 7,605,787 B2
(45) Date of Patent: Oct. 20, 2009

(54) LIQUID CRYSTAL DISPLAY DEVICE, SIGNAL PROCESSING UNIT FOR USE IN LIQUID CRYSTAL DISPLAY DEVICE, PROGRAM AND STORAGE MEDIUM THEREOF, AND LIQUID CRYSTAL DISPLAY CONTROL METHOD

(75) Inventors: Masahiko Akutsu, Tochigi (JP); Toshiyuki Fujine, Tochigi (JP); Takashi Yoshii, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 17 days.

(21) Appl. No.: 10/586,313

(22) PCT Filed: Sep. 9, 2004

(86) PCT No.: PCT/JP2004/013164

§ 371 (c)(1),
(2), (4) Date: Jan. 4, 2007

(87) PCT Pub. No.: WO2005/069628

PCT Pub. Date: Jul. 28, 2005

(65) Prior Publication Data

US 2007/0164946 A1 Jul. 19, 2007

(30) Foreign Application Priority Data

Jan. 16, 2004 (JP) ..... 2004-009896
Jul. 20, 2004 (JP) ..... 2004-212203

(51) Int. Cl.
*G09G 3/36* (2006.01)

(52) U.S. Cl. ..... 345/89; 345/87; 345/690

(58) Field of Classification Search ..... 345/690, 345/87–104

See application file for complete search history.

(56) References Cited

U.S. PATENT DOCUMENTS 5,844,533 A * 12/1998 Usui et al. ..... 345/89
6,452,639 B1 * 9/2002 Wagner et al. ..... 348/448
7,397,457 B2 * 7/2008 Sugino et al. ..... 345/89
2004/0145596 A1 7/2004 Yamakawa et al.

(Continued)

FOREIGN PATENT DOCUMENTS

EP 0 946 055 A1 9/1999

(Continued)

*Primary Examiner*—Amare Mengistu
*Assistant Examiner*—Robert R Rainey
(74) *Attorney, Agent, or Firm*—Birch, Stewart, Kolasch & Birch, LLP

(57) ABSTRACT

When receiving an interlaced video signal, an I/P conversion section converts the interlaced video signal into a progressive video signal by any of two or more I/P conversion methods. Further, an emphasis conversion section subjects the progressive video signal to emphasis conversion. Here, a control CPU controls the degree of emphasis conversion performed by the emphasis conversion section so as to be changed in accordance with which kind of conversion method among the two or more conversion methods is used for the conversion. This makes it possible to subject video data supplied to a liquid crystal display panel to emphasis conversion with a degree corresponding to the conversion method. As a result of this, it is possible to implement a liquid crystal display device which can realize both improvement in response speed of a liquid crystal display device and improvement in quality of video image displayed on the liquid crystal display device.

16 Claims, 35 Drawing Sheets

U.S. PATENT DOCUMENTS

2004/0201564 A1* 10/2004 Sugino et al. ..... 345/101

FOREIGN PATENT DOCUMENTS

| | | | |
|---|---|---|---|
| EP | 1 443 486 | A1 | 8/2004 |
| JP | 4-288589 | A | 10/1992 |
| JP | 4-318516 | A | 11/1992 |
| JP | 4-365094 | A | 12/1992 |
| JP | 6-165087 | A | 6/1994 |
| JP | 2003-143556 | A | 5/2003 |
| JP | 2004-226841 | A | 8/2004 |
| JP | 3579046 | B1 | 10/2004 |
| WO | WO-03/041043 | A1 | 5/2003 |
| WO | WO-03/041044 | A1 | 5/2003 |
| WO | WO-03/098588 | A1 | 11/2003 |

* cited by examiner

FIG. 21

VIDEO DATA OF CURRENT FRAME

VIDEO DATA OF PREVIOUS FRAME

| | 0 | 32 | 64 | 96 | 128 | 160 | 192 | 224 | 255 |
|---|---|---|---|---|---|---|---|---|---|
| 0 | 0 | 51 | 118 | 165 | 194 | 214 | 230 | 242 | 255 |
| 32 | 0 | 32 | 120 | 159 | 183 | 206 | 226 | 240 | 255 |
| 64 | 0 | 12 | 64 | 110 | 150 | 182 | 209 | 234 | 255 |
| 96 | 0 | 0 | 48 | 96 | 140 | 175 | 204 | 232 | 255 |
| 128 | 0 | 0 | 43 | 81 | 128 | 167 | 201 | 232 | 255 |
| 160 | 0 | 0 | 35 | 66 | 117 | 160 | 196 | 229 | 255 |
| 192 | 0 | 0 | 2 | 56 | 105 | 152 | 192 | 227 | 255 |
| 224 | 0 | 0 | 0 | 50 | 85 | 139 | 186 | 224 | 255 |
| 255 | 0 | 0 | 0 | 44 | 75 | 136 | 181 | 215 | 255 |

LIQUID CRYSTAL DISPLAY DEVICE, SIGNAL PROCESSING UNIT FOR USE IN LIQUID CRYSTAL DISPLAY DEVICE, PROGRAM AND STORAGE MEDIUM THEREOF, AND LIQUID CRYSTAL DISPLAY CONTROL METHOD

TECHNICAL FIELD

The present invention relates to a liquid crystal display device, a signal processing unit for use in the liquid crystal display device, program and storage medium thereof, and a liquid crystal display control method, all of which can realize both improvement in response speed of the liquid crystal display device and improvement in quality of video image displayed on the liquid crystal display device.

BACKGROUND ART

Recently, with accelerated upsizing and high definition of liquid crystal display devices (LCDs), liquid crystal display devices have been increasingly becoming common in applications that mainly display static images, like liquid crystal display devices for use in personal computers, word processors, and the like and applications that display moving images, like liquid crystal display devices for use in TV and the like. Liquid crystal display devices are increasingly becoming common in general households. This is because a liquid crystal display device is thinner and takes up less space than TV including a cathode ray tube (hereinafter referred to as CRT).

However, a liquid crystal display device has an optical response speed slower than CRT (Cathode-Ray Tube) and others, and may not complete a response within a rewrite time (16.7 msec) corresponding to a usual frame frequency (60 Hz), depending upon grayscale transition. For example, Patent document 1 (Japanese Unexamined Patent Publication No. 365094/1992 (Tokukaihei 4-365094); published on Dec. 17, 1992) adopts a technique of driving with a drive signal modulated so as to emphasize grayscale transition occurring from a previous frame to a current frame.

For example, in a situation where grayscale transition from a previous frame FR(k−1) to a current frame FR(k) is rise driving, a voltage higher than a voltage represented by video data D(i,j,k) of the current frame FR(k) is applied to pixels so that grayscale transition from the previous frame to the current frame is emphasized. More specifically, a voltage higher than a voltage represented by video data D(i,j,k) of the current frame FR(k) is applied to pixels.

As a result of this, when the grayscale transition occurs, the luminance level of the pixels more sharply increases and reaches close to a luminance level corresponding to the image data D(i, j, k) of the above-mentioned current frame FR(k) in a shorter time, as compared with a luminance level realized by a voltage level represented by video data D(i, j, k) of the current frame FR(k) being directly applied. Because of this, even in a case where a response speed of liquid crystal is slow, it is possible to improve a response speed of the liquid crystal display device.

Note that the following liquid crystal driving method is herein referred to as overshoot (OS) driving. That is, the liquid crystal driving method, as described in Patent document 1, is such that according to a combination of incoming image data of a current frame and incoming image data of a previous frame, a (overshot) drive voltage which is higher than a predetermined gray-scale voltage of the incoming image data of the current frame or a (undershot) drive voltage which is lower than the predetermined gray-scale voltage is supplied to a liquid crystal display panel.

Further, it is known that liquid crystal has variations in response speed depending upon environmental temperature. A response speed of liquid crystal is slow at low temperatures, in particular. For example, Patent document 2 (Japanese Unexamined Patent Publication No. 318516/1992 (Tokukaihei 4-318516); published on Nov. 10, 1992) suggests a liquid crystal panel driving device which emphasizes grayscale transition in accordance with a temperature.

Furthermore, for example, Patent document 3 (Japanese Unexamined Patent Publication No. 165087/1994 (Tokukaihei 6-165087); published on Jun. 10, 1994) discloses an arrangement in which a gain of a response speed compensation circuit which generates a correction voltage larger than the amount of change in video signal is adjusted in accordance with content of an image and user's preference, in order to provide a visible, high-definition liquid crystal display device which realizes noise removal from still images in MUSE (Multiple sub-Nyquist Sampling Encoding) signals, removal of line flicker, the rise of vertical resolution, smooth displays of moving images, and faithful high-speed displays for pan, tilt, scene change, and baseband signals.

Particularly, a driving method adopted in many liquid crystal display devices is a driving method such that in driving pixels in accordance with interlaced video signals, the interlaced video signals are converted into progressive video signals so that all of the pixels are driven by line-sequential scanning driving.

Referring to FIGS. 31 through 34, the following will describe details of a liquid crystal display device which performs overshoot driving to compensate for optical response properties of a liquid crystal display panel in accordance with its use environmental temperature. Here, FIG. 31 is a block diagram illustrating essential components of the conventional liquid crystal display device. FIG. 32. is a functional block diagram illustrating a schematic configuration of a control CPU. FIG. 33 is an explanatory diagram illustrating the relation between a device internal temperature and reference table memory. FIG. 34 is an explanatory diagram illustrating the relationship between a voltage applied to liquid crystal and a response of the liquid crystal.

In FIG. 31, reference numerals 501*a* through 501*d* represent OS table memories (ROMs) each of which stores OS parameter (emphasis conversion parameter) corresponding to every device internal temperature range. The OS parameter corresponds to grayscale transition between one frame and the previous or next frame of incoming image data. Reference numeral 515 represents frame memory (FM) which stores one frame of incoming image data. Reference numeral 514H represents an emphasis conversion section which compares incoming image data of Mth frame yet to be displayed (Current Data) with incoming image data of M−1th frame stored in the frame memory 515 (Previous Data), reads OS parameter corresponding to a result of the comparison (grayscale transition) from any of the OS table memories (ROMs) 501*a* through 501*d*, and determines emphasis conversion data (writing grayscale data) required for display of the image corresponding to the Mth frame in accordance with the thus read OS parameter.

Reference numeral 516 represents a liquid crystal controller which outputs a liquid crystal drive signal to a gate driver 518 and a source driver 519 of a liquid crystal display panel 517. Reference numeral 520 represents a temperature sensor for detecting a temperature inside the liquid crystal display device. Reference numeral 512H represents a control CPU which selects and references to any of the OS table memories (ROM) 501*a* through 501*d* in accordance with a device internal temperature detected by the temperature sensor 520, and outputs to the emphasis conversion section 514H a switch control signal for changing OS parameter for use in emphasis conversion of image data.

Here, OS parameters LEVEL1 through LEVEL4, which are stored in OS table memories (ROMs) 501*a* through 501*d*, respectively, are obtained in advance from actually measured values for optical response properties of the liquid crystal display panel 517 in an environment of reference temperatures T1, T2, T3, and T4 (T1<T2<T3<T4), respectively. In terms of the degree of emphasis conversion, there is the relationship of LEVEL1>LEVEL2>LEVEL3>LEVEL4.

The control CPU 512H, as illustrated in FIG. 32, has a threshold determination section 512*a* and a control signal output section 512*b*. The threshold determination section 512*a* compares temperature detection data obtained by the temperature sensor 520 with given threshold temperature data values Th1, Th2, and Th3 which are determined in advance. The control signal output section 512*b* selects any of the OS table memories (ROM) 501*a* through 501*d* according to a result of the comparison performed by the threshold determination section 512*a*, and generates a switch control signal for switching between OS parameters LEVEL1 through LEVEL4 and then outputs the generated switch control signal.

Here, for example, as illustrated in FIG. 33, when a device internal temperature detected by the temperature sensor 520 is equal to or lower than a switch threshold temperature Th1 (=15° C.), the control CPU 512H instructs the emphasis conversion section 514H to select and reference to the OS table memory (ROM) 501*a*. In response to the instruction, the emphasis conversion section 514H performs emphasis conversion processing on the incoming image data, by using the OS parameter LEVEL1 stored in the OS table memory (ROM) 501*a*.

Further, when the device internal temperature detected by the temperature sensor 520 is higher than the switch threshold temperature Th1 (=15° C.) but not higher than a switch threshold temperature Th2 (=25° C.), the control CPU 512H instructs the emphasis conversion section 514H to select and reference to the OS table memory (ROM) 501*b*. In response to the instruction, the emphasis conversion section 514H performs emphasis conversion processing on the incoming image data, by using the OS parameter LEVEL2 stored in the OS table memory (ROM) 501*b*.

Still further, when the device internal temperature detected by the temperature sensor 520 is higher than the switch threshold temperature Th2 (=25° C.) but not higher than a switch threshold temperature Th2 (=35° C.), the control CPU 512H instructs the emphasis conversion section 514H to select and reference to the OS table memory (ROM) 501*c*. In response to the instruction, the emphasis conversion section 514H performs emphasis conversion processing on the incoming image data, by using the OS parameter LEVEL3 stored in the OS table memory (ROM) 501*c*.

Yet further, when the device internal temperature. detected by the temperature sensor 520 is higher than the switch threshold temperature Th3 (=35° C.), the control CPU 512H instructs the emphasis conversion section 514H to select and refer to the OS table memory (ROM) 501*d*. In response to the instruction, the emphasis conversion section 514H performs emphasis conversion process on the incoming image data, by using the OS parameter LEVEL4 stored in the OS table memory (ROM) 501*d*.

Generally, a liquid crystal display panel requires a long time for change from one intermediate tone to another. This causes a extremely poor response to an incoming signal at low temperatures, thus increasing a response time. For this reason, the liquid crystal display panel has the problem that an intermediate tone cannot be displayed within one frame period (e.g. within 16.7 msc in progressive scanning of 60 Hz). This results in the occurrence of afterimage and a poorly produced halftone image. However, it is possible to display a target intermediate tone in a short time (within one frame period) as illustrated in FIG. 34, by using the aforesaid overshoot drive circuit to perform emphasis conversion of grayscale level of incoming image data in a grayscale transition direction so that the liquid crystal display panel 517 attains a target intermediate tone luminance defined by the incoming image data after an elapse of a predetermined one frame display period.

However, in a case where the display device can select an interlace-to-progressive conversion method from among a plurality of conversion methods, the arrangements of the Patent documents 1 through 3 have the problem of difficulty in preventing degradation of quality of video image.

More specifically, there is a wide variety of interlace-to-progressive conversion methods. The conversion method most suitable for all of the possible situations does not exist because it is determined depending upon a S/N ratio of incoming interlaced video signal, content of video image, user's preference, and others.

For example, there is a conversion method of performing interpolation between fields by motion detection and motion prediction compensation between adjacent fields. This method realizes improvement in quality of video image under conditions where a S/N ratio of an interlaced video signal is sufficiently high, as compared with a method like line doubling, i.e. a method of converting into a progressive video signal by copying a video signal of a horizontal line, which is a component of a certain field, supplied to pixels. The above conversion method, however, causes noise greater than the copying method under conditions where the S/N ratio is lower than an expected range of S/N ratio, thus resulting in degradation of quality of video image.

The use of the method like line doubling, i.e. the method of converting into a progressive video signal only by using data in a field decrease spatial resolution and thus reduces noise. However, this method has the problem that unwanted luminance change (flicker) is likely to occur in every frame, particularly, in edge portions of static image.

However, the arrangements of Patent documents 1 through 3 cannot emphasize grayscale transition appropriately in accordance with characteristics of interlace-to-progressive conversion. Thus, it might be possible that enhancement of the foregoing unwanted luminance change increase flickers on edge portions of a static image. This might seriously degrade quality of an image displayed.

More specifically, the I/P conversion processing, as illustrated in FIG. 35, both odd-numbered field and even-numbered field of an interlaced signal are subjected to data interpolation, and then, each of the odd-numbered field and even-numbered field is converted into image data which is one frame long, as illustrated in FIG. 36.

With this arrangement, an interlaced video signal (in case of NTSC broadcasting scheme) of 30 frames per second (60 fields per second) is converted into a quasi-progressive video signal of 60 frames per second. Thus, it is possible to make the interlaced video signal to be displayed as a progressive video signal.

However, suppose, for example, such an I/P conversion processing is the interpolation with only the respective data of even-numbered field and odd-numbered field in the interlaced scanning. As represented by dotted lines in FIG. 36, the I/P conversion processing causes variations in edge positions in a static image, which are supposed to be stationary, from field to field. Because of this, flicker noise (false signal) occurs, and jaggies of slanted lines (difference in brightness) appears.

Thus, suppose that interlaced signal with a sufficiently high S/N ratio is subjected to motion adaptive I/P conversion, or image data is subjected to emphasis conversion by the foregoing overshoot driving with a degree of emphasis that is the same as in the case where a progressive signal is supplied. Such an I/P conversion processing produces images emphasized with unwanted flicker noise (false signal) and jaggies of slanted lines (difference in brightness) caused by the I/P conversion processing, resulting in quality degradation of images displayed.

DISCLOSURE OF INVENTION

The present invention has been attained in view of the above problems, and an object of the present invention is to implement a liquid crystal display device, a signal processing unit for use in the liquid crystal display device, program and storage medium thereof, and a liquid crystal display control method, all of which can realize both improvement in response speed of the liquid crystal display device and improvement in quality of video image displayed on the liquid crystal display device.

In order to solve the above problems, a liquid crystal display device according to the present invention is a liquid crystal display device which carries out emphasis conversion on video data supplied to a liquid crystal display panel in accordance with at least video data of previous vertical period and video data of current vertical period, thereby compensating for optical response properties of the liquid crystal display panel, the liquid crystal display device comprising: I/P conversion means which, when incoming video data is an interlaced signal, converts the interlaced signal into a progressive signal in accordance with any one of two or more conversion methods; and emphasis conversion means which carries out emphasis conversion on video data of current vertical period so as to emphasize grayscale transition at least from previous vertical period to current vertical period in the progressive signal, wherein a degree of the emphasis conversion on the video data is controlled so as to be changed in accordance with which kind of conversion method among the two or more conversion methods is used for the conversion.

Note that mutually different conversion methods are conversion methods by which mutually different progressive video signals are outputted in response to identical interlaced video signals. For example, the mutually different conversion methods are the ones which adopt mutually different algorithms or the ones which adopt identical algorithms but has different parameters and filter properties.

Examples of the mutually different conversion methods include (1) motion adaptive interlace/progressive conversion and (2) interlace/progressive conversion by intra-field interpolation only (intra-field interpolation for all pixels making up one screen).

A vertical period is equivalent to one frame period. For example, assuming that a whole video image of one frame video signal data is subjected to write scanning for one frame period of the data, one vertical period corresponds to one vertical display period. On the other hand, in a case of pseudo-impulse driving by black interpolation, assuming that video display period and the following black display period is included in one frame period, the one vertical period is longer than one vertical display period. The emphasis conversion of video signal is carried out pixel by pixel.

Moreover, at least video signal of previous vertical period and video signal of current vertical period are at least pixel data indicative of grayscale luminance of previous vertical period and pixel data indicative of grayscale luminance of current vertical period, respectively, when signals indicative of luminance are repeatedly supplied to a certain pixel and a state of the pixel changes in accordance with both of the signals. In a case where pixels in liquid crystal display device are rewritten in one vertical period cycle, the pixels respond to data provided every one vertical period (16.7 msec in 60 Hz-progressive scanning).

With the above arrangement, the I/P conversion means can convert an interlaced video signal to a progressive video signal by two or more conversion methods. This makes it possible to perform conversion into a progressive video signal (progressive scanning conversion) by a conversion method suitable for, for example, type and S/N ratio of a video signal supplied from a video signal source, user's preference, or a demanded image quality, and to display a video signal obtained by the conversion on the liquid crystal display device.

Moreover, in the above arrangement, the emphasis conversion means performs emphasis conversion of video data of current vertical period so as to emphasize grayscale transition at least from previous vertical period to current vertical period in the progressive signal by emphasis conversion or the like of the converted video data, so that the liquid crystal display panel provides transmittance defined by the video data within a predetermined period. This compensates for optical response properties of the liquid crystal display panel.

Further, in the above arrangement, the degree of emphasis conversion on the video data is controlled to be changed in accordance with a conversion method used by the I/P conversion means. Thus, the emphasis conversion means can emphasize a video signal with a suitable degree all the time whichever I/P conversion method is used by the I/P conversion means for generation of a progressive video signal.

As a result of this, it is possible to realize both improvement in response speed of the liquid crystal display device and improvement in quality of video image displayed on the liquid crystal display device.

In addition to the above arrangement, the liquid crystal display device may further include: table memory which stores an emphasis conversion parameter determined by video data of current vertical period and video data of previous vertical period, the emphasis conversion means having: an operation section which performs emphasis operation on the video data by using the emphasis conversion parameter; and a multiplying section which multiplies output data obtained by the emphasis operation by a coefficient varying depending upon which kind of conversion method among the two or more conversion methods is used for the conversion.

In the above arrangement, the operation section performs emphasis operation on the video data by using the emphasis conversion parameter stored in the table memory, and output data obtained by the emphasis operation is multiplied by a coefficient corresponding to a conversion method. This makes it possible to change the degree of emphasis conversion by using a comparatively small-scale circuit and with a comparatively high precision.

Still further, in addition to the above arrangement, the liquid crystal display device may further include: table memory which is referenced to when incoming video data is converted by a first conversion method, and stores an emphasis conversion parameter determined by video data of current vertical period and video data of previous vertical period; and table memory which is referenced to when incoming video data is converted by a second conversion method, and stores an emphasis conversion parameter determined by video data of current vertical period and video data of previous vertical period, the emphasis conversion means having: an operation section which performs emphasis operation on the video data obtained by the conversion by using the emphasis conversion parameter which is read from the table memory determined by which kind of conversion method among the two or more conversion methods is used for the conversion.

In this arrangement, it is possible to change table memory referenced to by the emphasis conversion means, in accordance with each conversion method. Thus, even when there is not much correlation between emphasis conversion parameters suitable for the respective conversion methods, it is possible to perform emphasis conversion on the video data with a degree of emphasis conversion suitable for each of the conversion methods.

Yet further, in addition to the above arrangement, the liquid crystal display device may further include: temperature detection means which detects a device internal temperature, the emphasis conversion means changing the degree of emphasis conversion performed on the video data in accordance with a detection result of the device internal temperature.

In this arrangement, the degree of emphasis conversion can be changed in accordance with not only a conversion method but also a device internal temperature. Even in a case where a suitable degree of emphasis conversion changes by a temperature of usage environment, it is possible to perform emphasis conversion with a suitable degree. As a result of this, this arrangement can realize a higher quality of video image displayed on the liquid crystal display device than the arrangement where the degree of emphasis conversion is maintained constantly irrespective of device internal temperature.

Further, in addition to the above arrangement, the liquid crystal display device may further include: table memory which stores an emphasis conversion parameter determined by video data of current vertical period and video data of previous vertical period, the emphasis conversion means having: an operation section which performs emphasis operation on the video data obtained by the conversion, by using the emphasis conversion parameter; and a multiplying section which multiplies output data supplied from the operation section by a coefficient varying depending upon (i) which kind of conversion method among the two or more conversion methods is used for the conversion and (ii) a detection result of the device internal temperature.

In the above arrangement, the emphasis conversion means multiplies output data of the operation section determined by using the table memory by a coefficient corresponding to a conversion method and a detection result of the device internal temperature, in order to change the degree of emphasis conversion. Thus, it is possible to share a table memory between in situations where combinations of conversion method and detection result of device internal temperature are mutually different, and to realize a liquid crystal display device with a smaller circuit scale.

Yet further, in addition to the above arrangement, the liquid crystal display device may further include: table memory which is referenced to when incoming video data is converted by a first conversion method, and stores an emphasis conversion parameter determined by video data of current vertical period and video data of previous vertical period; and table memory which is referenced to when incoming video data is converted by a second conversion method, and stores an emphasis conversion parameter determined by video data of current vertical period and video data of previous vertical period, the emphasis conversion means having: an operation section which performs emphasis operation on the video data obtained by the conversion by using the emphasis conversion parameter which is read from the table memory determined by which kind of conversion method among the two or more conversion methods is used for the conversion; and a multiplying section which multiplies output data obtained by the emphasis operation by a coefficient varying depending upon a detection result of the device internal temperature.

In the above arrangement, the emphasis conversion means multiplies output data of the emphasis operation determined by using the emphasize conversion parameter read from the table memory corresponding to a conversion method by a coefficient corresponding to a detection result of the device internal temperature, in order to change the degree of emphasis conversion. Thus, it is possible to share table memory between varying temperatures. Moreover, table memories can be switched in accordance with a conversion method. Thus, even when there is not much correlation between emphasis conversion parameters suitable for the respective conversion methods, it is possible for the emphasis conversion means to perform emphasis conversion with a degree suitable for each of the conversion methods.

Therefore, it is possible to reduce a circuit scale more than in the arrangement where table memory is provided for each combination of temperature and conversion method, and it is possible to perform emphasis conversion with a more suitable degree than in the arrangement where table memory is shared between varying combinations of temperature and conversion method. As a result of this, it is possible to realize a liquid crystal display device which balances reduction in circuit scale and improvement in quality of video image displayed on the liquid crystal display device.

Further, in addition to the above arrangement, the liquid crystal display device may further include: table memories which are referenced to when incoming video data is converted by a first conversion method, and store emphasis conversion parameters respectively associated with a plurality of device internal temperatures, the emphasis conversion parameters each being determined by video data of current vertical period and video data of previous vertical period; and table memories which are referenced to when incoming video data is converted by a second conversion method, and store emphasis conversion parameters respectively associated with a plurality of device internal temperatures, the emphasis conversion parameters each being determined by video data of current vertical period and video data of previous vertical period, the emphasis conversion means having: an operation section which performs emphasis operation on the video data obtained by the conversion by using the emphasis conversion parameter which is read from the table memory determined by (i) which kind of conversion method among the two or more conversion methods is used for the conversion and (ii) a detection result of the device internal temperature.

In the above arrangement, a table memory from which the emphasis conversion parameter for use in the emphasis operation performed by the operation section is read is changed in accordance with a conversion method and a device internal temperature. Thus, even when there is not much correlation between emphasis conversion parameters suitable for respective combinations of conversion method and temperature, the emphasis conversion means can perform emphasis conversion with a degree suitable for each of the combinations. This can improve quality of video image displayed on the liquid crystal display device.

Still further, in addition to the above arrangement, the liquid crystal display device according may further include: table memories which store emphasis conversion parameters respectively associated with a plurality of device internal temperatures, the emphasis conversion parameters each being determined by video data of current vertical period and video data of previous vertical period; and the emphasis conversion means having: an operation section which performs emphasis operation on the video data obtained by the conversion by using the emphasis conversion parameter which is read from the table memory determined by a result of comparison between (i) a switching temperature determined by which kind of conversion method among the two or more conversion methods is used for the conversion and (ii) a detection result of the device internal temperature.

Yet further, in addition to the above arrangement, the liquid crystal display device may further include: an operation section which performs a predetermined operation on temperature data that is the detection result of the device internal temperature, the operation being determined for each of the two or more conversion methods; a comparison section which compares between the temperature data having been subjected to the operation and given threshold temperature data determined in advance; and a control signal output section which generates a switching control signal for controlling switching of the emphasis conversion parameters, in accordance with a result of the comparison.

Further, in addition to the above arrangement, the liquid crystal display device may further include: a comparison section which compares between temperature data that is the detection result of the device internal temperature and a given threshold temperature data determined for each of the two or more conversion methods; and a control signal output section which generates a switching control signal for controlling switching of the emphasis conversion parameters, in accordance with a result of the comparison.

In these arrangements, switching temperatures used for switching of the table memories are changed in accordance with a conversion method. This makes it possible to change the degree of emphasis conversion, without provision of the multiplying section, even although at least part of the table memories is shared by mutually different conversion methods. As a result of this, it is possible to reduce a circuit scale more than in the arrangement where the multiplying section is provided.

In order to solve the above problems, a signal processing unit for use in a liquid crystal display device according to the present invention is a signal processing unit for use in a liquid crystal display device, the signal processing unit comprising: conversion means which converts an interlaced video signal into a progressive video signal; and correction means which corrects a video signal of current vertical period so as to emphasize grayscale transition at least from previous vertical period to current vertical period in the progressive video signal, wherein the conversion means is capable of conversions by two or more conversion methods, and a degree of the grayscale transition emphasis performed by the correction means is changed in accordance with a conversion method used by the conversion means.

Note that mutually different conversion methods are conversion methods by which mutually different progressive video signals are outputted in response to identical interlaced video signals. For example, the mutually different conversion methods are the ones which adopt mutually different algorithms or the ones which adopt identical algorithms but has different parameters and filter properties.

Examples of the mutually different conversion methods include (1) motion adaptive interlace/progressive conversion and (2) interlace/progressive conversion by intra-field interpolation only (intra-field interpolation for all pixels making up one screen).

A vertical period is equivalent to one frame period. For example, assuming that a whole video image of one frame video signal data is subjected to write scanning for one frame period of the data, one vertical period corresponds to one vertical display period. On the other hand, in a case of pseudo-impulse driving by black interpolation, assuming that video display period and the following black display period is included in one frame period, the one vertical period is longer than one vertical display period. The emphasis conversion of video signal is carried out pixel by pixel.

Moreover, at least video signal of previous vertical period and video signal of current vertical period are at least pixel data indicative of grayscale luminance of previous vertical period and pixel data indicative of grayscale luminance of current vertical period, respectively, when signals indicative of luminance are repeatedly supplied to a certain pixel and a state of the pixel changes in accordance with both of the signals. In a case where pixels in liquid crystal display device are rewritten in one vertical period cycle, the pixels respond to data provided every one vertical period (16.7 msec in 60 Hz-progressive scanning).

With the above arrangement, the conversion means can convert an interlaced video signal to a progressive video signal by two or more conversion methods. This makes it possible to perform conversion into a progressive video signal (progressive scanning conversion) by a conversion method suitable for, for example, type and S/N ratio of a video signal supplied from a video signal source, user's preference, or a demanded image quality, and to display a video signal obtained by the conversion on the liquid crystal display device.

In the above arrangement, the correction means corrects video signal of current vertical period so as to emphasize grayscale transition at least from previous vertical period to current vertical period in the progressive signal. This makes it possible to improve response speed of display pixels, thus compensating for optical response properties of the liquid crystal display device.

Further, in the above arrangement, the degree of grayscale transition emphasis performed by the correction means is changed in accordance with a conversion method used by the conversion means. Thus, the correction means can correct a video signal with a suitable degree all the time whichever conversion method is used by the conversion means for generation of a progressive video signal.

As a result of this, it is possible to realize both improvement in response speed of the liquid crystal display device and improvement in quality of video image displayed on the liquid crystal display device.

Further, in addition to the above arrangement, the signal processing unit for use in a liquid crystal display device may be such that the two or more conversion methods include a first conversion method of performing motion detection between fields and a second conversion method of performing conversion in a given procedure regardless of presence or absence of motion between fields, and in a case where the conversion means performs conversion by the second conversion method, a degree of grayscale transition emphasis performed by the correction means is changed to be lower than in a case where the conversion means performs conversion by the first conversion method.

Still further, in addition to the above arrangement, the signal processing unit for use in a liquid crystal display device may be such that: the two or more conversion methods include a first conversion method of performing conversion by motion prediction between fields and a second conversion method of performing conversion in a given procedure regardless of presence or absence of motion between fields, and in a case where the conversion means performs conversion by the second conversion method, a degree of grayscale transition emphasis performed by the correction means is changed to be lower than in a case where the conversion means performs conversion by the first conversion method.

Yet further, in addition to the above arrangement, the signal processing unit for use in a liquid crystal display device may be such that: the two or more conversion methods include a first conversion method of referencing to a video signal of other field for conversion and a second conversion method of not referencing to a video signal of other field for conversion, and in a case where the conversion means performs conversion by the second conversion method, a degree of grayscale transition emphasis performed by the correction means is changed to be lower than in a case where the conversion means performs conversion by the first conversion method.

Further, in addition to the above arrangement, the signal processing unit for use in a liquid crystal display device may be such that: the second conversion method is a method of copying a video signal in a certain field, or averaging sets of video signals in a certain field or averaging sets of video signals in a certain field while being weighted, so as to convert the video signal in the field into a progressive video signal.

Here, in the first conversion method, progressive conversion is performed with reference to a video signal of other field. It is therefore possible to generate a comparatively high-quality progressive video signal if a S/N ratio of video signal is sufficiently high, as compared with the second conversion method. Thus, unwanted luminance change in pixels, resulting from progressive conversion, is less likely to occur. However, in a case where a S/N ratio is lower than expected, a progressive video signal with obtrusive noise is likely to occur.

On the other hand, in the second conversion method, a spatial resolution decreases. If an S/N ratio is comparatively low, a progressive video signal with less obtrusive noise may be generated than in a case where the first conversion method is selected. However, unwanted luminance changes (flickers) are likely to occur especially in edge portions of a still image.

In either conversion method, a progressive video signal generated by the conversion means is subjected to grayscale transition emphasis by the correction means. With excessive emphasis of unwanted luminance change (flickers) caused by the second conversion method, flickers in edge portions of a still image, for example, becomes obtrusive. This might cause significant degradation in quality of video image.

On the contrary, in the above arrangement, in a case where progressive conversion is performed by the second conversion method, the degree of grayscale transition emphasis performed by the correction means is changed to be lower. Even when unwanted luminance change (flickers) occurs in edge portions of an image due to the second conversion method, the luminance change is not much emphasized, and degradation in quality of video image can be suppressed.

Further, in addition to the above arrangement, the signal processing unit for use in a liquid crystal display device may be such that: the correction means includes a plurality of table memories each of which stores emphasis conversion parameter determined by at least the video signal of previous vertical period and the video signal of current vertical period, and the table memories referenced to by the correction means are switched in accordance with a conversion method used by the conversion means, so that the degree of the grayscale transition emphasis is changed. Note that the emphasis conversion parameter is data by which a video signal obtained after the correction is obtained. Examples of the emphasis conversion parameter include (i) video signal (grayscale level value) itself obtained after the correction and (ii) an amount of addition/subtraction to/from a yet-to-be-corrected video signal. This is obtained by actual measurement of optical response properties of the liquid crystal display device.

In this arrangement, table memory referenced to by the correction means can be changed in accordance with each of the conversion methods. Even when there is not much correlation between emphasis conversion parameters suitable for the conversion methods, the correction means can emphasize grayscale transition with a degree suitable for each of the conversion methods. This allows for improvement in quality of video image displayed on the liquid crystal display device.

Further, in addition to the above arrangement, the signal processing unit for use in a liquid crystal display device may be such that: the correction means includes: a table memory which stores an emphasis conversion parameter determined by at least the video signal of previous vertical period and the video signal of current vertical period; and adjustment means which adjusts a correction amount for the video signal of current vertical period in accordance with the degree of grayscale transition emphasis, the correction amount being determined with reference to the table memory.

In this arrangement, for example, in accordance with (i) the degree of grayscale transition emphasis determined by a conversion method or (ii) the degree of grayscale transition emphasis determined by a combination of conversion method and temperature, the adjustment means adjusts a correction amount determined with reference to table memory.

Thus, a common table memory can be shared between the situations where degrees of grayscale transition emphasis are mutually different, for example, such as mutually different conversion methods, or mutually different combinations of conversion method and temperature. This makes it possible to realize a liquid crystal display device with smaller circuit scale.

Note that, generally, the emphasis conversion parameters between the above situations are often correlated with each other to some extent. This makes it possible to set the degree of grayscale transition emphasis to be a suitable degree with a comparatively high precision, by using the adjustment means of which circuit scale is not so large. Thus, it is possible to suppress degradation in quality of video image displayed on the liquid crystal display device, without increase of circuit scale.

Still further, in addition to the above arrangement, the degree of grayscale transition emphasis performed by the correction means may be changed in accordance with not only the conversion method used by the conversion means but also a device internal temperature. In this arrangement, the degree of grayscale transition emphasis can be changed in accordance with not only a conversion method but also a device internal temperature. Even in a case where a suitable degree of grayscale transition emphasis changes by a temperature of usage environment, it is possible to perform grayscale transition emphasis with a suitable degree. As a result of this, this arrangement can realize a higher quality of video image displayed on the liquid crystal display device than the arrangement where the degree of grayscale transition emphasis is maintained constantly irrespective of device internal temperature.

Yet further, in addition to the above arrangement, the signal processing unit for use in a liquid crystal display device may be such that: the correction means includes a plurality of table memories each of which stores emphasis conversion parameter determined by at least the video signal of previous vertical period and the video signal of current vertical period, and the table memories referenced to by the correction means are switched in accordance with (a) a conversion method used by the conversion means and (b) a device internal temperature, so that the degree of the grayscale transition emphasis is changed.

In the above arrangement, a table memory referenced to by the correction means can be changed in accordance with a conversion method and a device internal temperature. Thus, even when there is not much correlation between emphasis conversion parameters suitable for respective combinations of conversion method and temperature, the correction means can perform grayscale transition with a degree suitable for each of the combinations. This can improve quality of video image displayed on the liquid crystal display device.

Further, in addition to the above arrangement, the signal processing unit for use in a liquid crystal display device may be such that: the correction means includes a plurality of table memories each of which stores an emphasis conversion parameter determined by at least the video signal of previous vertical period and the video signal of current vertical period, the correction means further includes adjustment means which adjusts a correction amount for the video signal of current vertical period, the correction amount being determined with reference to any one of the table memories, and a degree of the adjustment performed by the adjustment means is changed in accordance with a device internal temperature, and the table memories referenced to by the correction means are switched in accordance with a conversion method used by the conversion means, so that the degree of the grayscale transition emphasis is changed.

In the above arrangement, the correction amount determined with reference to the table memory is adjusted by the adjustment means in accordance with a device internal temperature, it is possible to share table memories referenced to in determining a correction amount for video signal of current vertical period, between varying temperatures. Moreover, table memories can be switched in accordance with a conversion method. Thus, even when there is not much correlation between emphasis conversion parameters suitable for the respective conversion methods, it is possible for the correction means to emphasize grayscale transition with a degree suitable for each of the conversion methods.

Therefore, it is possible to reduce a circuit scale more than in the arrangement where table memory is provided for each combination of temperature and conversion method, and it is possible to emphasize grayscale transition with a more suitable degree than in the arrangement where table memory is shared between varying combinations of temperature and conversion method, and the correction amount is adjusted according to the combination. As a result of this, it is possible to realize a liquid crystal display device which balances reduction in circuit scale and improvement in quality of video image displayed on the liquid crystal display device.

Still further, in addition to the above arrangement, the signal processing unit for use in a liquid crystal display device may be such that: the correction means includes a plurality of table memories each of which stores an emphasis conversion parameter determined by at least the video signal of previous vertical period and the video signal of current vertical period, at least part of the table memories are shared between the two or more conversion methods used by the conversion means, and the table memories referenced to by the correction means are switched in accordance with a device internal temperature, and switching temperatures for switching between the table memories are changed in accordance with a conversion method used by the conversion means, so that the degree of the grayscale transition emphasis is changed.

In the above arrangement, switching temperatures used for switching of the table memories are changed in accordance with a conversion method. This makes it possible to change the degree of grayscale transition emphasis, without provision of the adjustment means, even although at least part of the table memories is shared by mutually different conversion methods. As a result of this, it is possible to reduce a circuit scale more than in the arrangement where the adjustment means is provided.

As an example, assume that there is a situation where a suitable degree of grayscale transition emphasis becomes lower with rise in temperature. In this case, switching to a table memory corresponding to a higher temperature range is performed at a lower device internal temperature for a conversion method for which the degree of grayscale transition emphasis should be set to be lower. If the degree of grayscale transition emphasis is compared under the same condition of temperature, the degree of grayscale transition emphasis for a conversion method which requires a lower degree of grayscale transition emphasis can be set to be equal or lower than the degree of grayscale transition emphasis for a conversion method which requires a higher degree of grayscale transition emphasis.

Incidentally, all of the plurality of table memories may be shared between mutually different conversion methods. If the demand for reduction of circuit scale is comparatively weak, but the demand for improvement in quality of video image displayed on the liquid crystal display device is comparatively strong, the table memories are desirably switched so that part of the table memories are referenced to only when the conversion means performs conversion by a particular conversion method.

In this arrangement, part of the table memories corresponding to the respective temperatures is shared between mutually different conversion methods. Thus, a circuit scale is reducible more than in an arrangement where the table memories are not shared. Meanwhile, when all of the table memories are shared, it is possible to emphasize grayscale transition suitably even when conversion is performed by a particular conversion method in which grayscale transition cannot be emphasized suitably at a certain temperature. This is because the table memories include a table memory referenced to only when the conversion means performs conversion by the particular conversion method. As a result of this, it is possible to realize a liquid crystal display device which balances reduction in circuit scale and improvement in quality of video image displayed on the liquid crystal display device.

Further, in order to solve the above problems, a signal processing unit for use in a liquid crystal display device according to the present invention is a signal processing unit for use in a liquid crystal display device, the signal processing unit including conversion means which converts an interlaced video signal into a progressive video signal and modulating the progressive video signal so as to emphasize grayscale transition in each pixel of the liquid crystal display device, wherein the conversion means is capable of conversions by two or more conversion methods, and a degree of the grayscale transition emphasis is changed in accordance with a conversion method used by the conversion means.

With the above arrangement, the degree of grayscale transition emphasis performed on the video signal having been subjected to progressive conversion is changed in accordance with a conversion method of interlace/progressive conversion. Thus, it is possible to perform grayscale transition emphasis with a suitable degree all the time whichever conversion method is used for generation of a progressive video signal. It is therefore possible to realize both improvement in response speed of the liquid crystal display device and improvement in quality of video image displayed on the liquid crystal display device.

In order to solve the above problems, a liquid crystal display device according to the present invention includes any one of the above-arranged signal processing units for use in a liquid crystal display device. As is the case with the above signal processing units for use in liquid crystal display device, it is possible to realize both improvement in response speed of the liquid crystal display device and improvement in quality of video image displayed on the liquid crystal display device.

Further, a liquid crystal display device according to the present invention is a liquid crystal display device having an I/P conversion means which, when incoming video data is an interlaced signal, converts the interlaced signal into a progressive signal in accordance with any one of two or more conversion methods, said liquid crystal display device, carrying out emphasis conversion on video data supplied to a liquid crystal display panel in accordance with at least video data of previous vertical period and video data of current vertical period, so as to emphasize grayscale transition at least from previous vertical period to current vertical period in the progressive signal, thereby compensating for optical response properties of the liquid crystal display panel, and controlling a degree of the emphasis conversion on the video data so as to be changed in accordance with which kind of conversion method among the two or more conversion methods is used for the conversion.

With the above arrangement, the degree of grayscale transition emphasis performed on the video signal having been subjected to progressive conversion is changed in accordance with a conversion method of interlace/progressive conversion. Thus, it is possible to perform emphasis conversion with a suitable degree all the time whichever conversion method is used for generation of a progressive video signal. It is therefore possible to realize both improvement in response speed of the liquid crystal display device and improvement in quality of video image displayed on the liquid crystal display device.

Incidentally, the foregoing means may be realized by hardware only. Alternatively, the foregoing means may be realized by a computer executing software. That is, a program according to the present invention is a program causing a computer to execute a process of controlling a degree of emphasis conversion on video data so as to be changed in accordance with which kind of conversion method among two or more conversion methods is used for the conversion, the computer controlling a liquid crystal display device comprising: an I/P conversion means which, when incoming video data is an interlaced signal, converts the interlaced signal into a progressive signal in accordance with any one of two or more conversion methods; and emphasis conversion means which carries out emphasis conversion on video data of current vertical period so as to emphasize grayscale transition at least from previous vertical period to current vertical period in the progressive signal, and the liquid crystal display device carrying out emphasis conversion on video data supplied to a liquid crystal display panel in accordance with at least video data of previous vertical period and video data of current vertical period, thereby compensating for optical response properties of the liquid crystal display panel. Another program according to the present invention is a program causing a computer comprising: conversion means which converts an interlaced video signal into a progressive video signal; and correction means which corrects a video signal of a current vertical period so as to emphasize grayscale transition at least from current vertical period to previous vertical period in the progressive video signal, wherein the conversion means is capable of conversions by two or more conversion methods, to operate so as to change a degree of grayscale transition emphasis performed by the correction means in accordance with a conversion method used by the conversion means. Further, a storage medium according to the present invention stores any of the above programs.

When a program for changing the degree of emphasis conversion is executed by the computer, a liquid crystal display device controlled by the computer operates as the foregoing liquid crystal display device. When a program for changing the degree of grayscale transition emphasis is executed by the computer, the computer operates as the signal processing unit for use in a liquid crystal display device. As a result of this, as is the case with the foregoing liquid crystal display device and the foregoing signal processing unit for use in liquid crystal display device, it is possible to realize both improvement in response speed of the liquid crystal display device and improvement in quality of video image displayed on the liquid crystal display device.

In order to solve the above problems, a liquid crystal display control method according to the present invention is a liquid crystal display control method of carrying out emphasis conversion on video data supplied to a liquid crystal display panel in accordance with at least video data of previous vertical period and video data of current vertical period, thereby compensating for optical response properties of the liquid crystal display panel, the method comprising the steps of: when incoming video data is an interlaced signal, converting the interlaced signal into a progressive signal in accordance with any one of two or more conversion methods; and carrying out emphasis conversion on video data of the current vertical period so as to emphasize grayscale transition at least from previous vertical period to current vertical period in the progressive signal, wherein a degree of the emphasis conversion on the video data is controlled so as to be changed in accordance with which kind of conversion method among the two or more conversion methods is used for the conversion.

Further, in order to solve the above problems, a liquid crystal display control method according to the present invention is a liquid crystal display driving method comprising: a conversion step of converting an interlaced video signal into a progressive video signal; and a correction step of correcting a video signal of current vertical period so as to emphasize grayscale transition at least from current vertical period to previous vertical period in the progressive video signal, wherein conversions by two or more conversion methods are possible in the conversion step, the method further comprising: a control step of changing a degree of the grayscale transition emphasis performed in the correction step in accordance with a conversion method used in the conversion step.

Still further, in order to solve the above problems, a liquid crystal display control method according to the present invention is a liquid crystal display control method of including a conversion step of converting an interlaced video signal into a progressive video signal, and modulating the progressive video signal so as to emphasize grayscale transition in each pixel of a liquid crystal display device wherein conversions by two or more conversion methods are possible in the conversion step, and a degree of the grayscale transition emphasis is changed in accordance with a conversion method used in the conversion step.

Yet further, in order to solve the above problems, a liquid crystal display control method according to the present invention is a liquid crystal display control method including an I/P conversion step of, when incoming video data is an interlaced signal, converting the interlaced signal into a progressive signal in accordance with any one of two or more conversion methods, said method carrying out emphasis conversion on video data supplied to a liquid crystal display panel in accordance with at least video data of previous vertical period and video data of current vertical period, so as to emphasize grayscale transition at least from previous vertical period to current vertical period in the progressive signal, thereby compensating for optical response properties of the liquid crystal display panel, wherein a degree of the emphasis conversion on the video data is controlled so as to be changed in accordance with which kind of conversion method among the two or more conversion methods is used for the conversion.

In these liquid crystal display control methods, the degree of emphasis conversion or the degree of grayscale transition emphasis is changed in accordance with a conversion method. Thus, it is possible to perform emphasis conversion or grayscale transition emphasis with a suitable degree all the time whichever conversion method is used for generation of a progressive signal (progressive video signal).

As a result of this, in these methods, it is possible to realize both improvement in response speed of the liquid crystal display device and improvement in quality of video image displayed on the liquid crystal display device.

Thus, according to the present invention, the degree of grayscale transition emphasis or the degree of emphasis conversion on a video signal having been subjected to progressive conversion is changed in accordance with a conversion method of interlace/progressive conversion. This brings about the effect that it is possible to perform grayscale transition emphasis (emphasis conversion) with a suitable degree all the time whichever conversion method is used for generation of a progressive video signal. It is therefore possible to realize both improvement in response speed of the liquid crystal display device and improvement in quality of video image displayed on the liquid crystal display device. The present invention can be used preferably for the realization of a liquid crystal television receiver, a liquid crystal monitor, and various liquid crystal display devices.

Additional objects, features, and strengths of the present invention will be made clear by the description below. Further, the advantages of the present invention will be evident from the following explanation in reference to the drawings.

BRIEF DESCRIPTION OF DRAWINGS

FIG. 21 is a view illustrating data stored in a look up table which is provided in the modulation processing section.

BEST MODE FOR CARRYING OUT THE INVENTION

The following will describe details of the present invention with Examples and Comparative Examples. However, the present invention is not limited to the description.

First Embodiment

Figure 1:
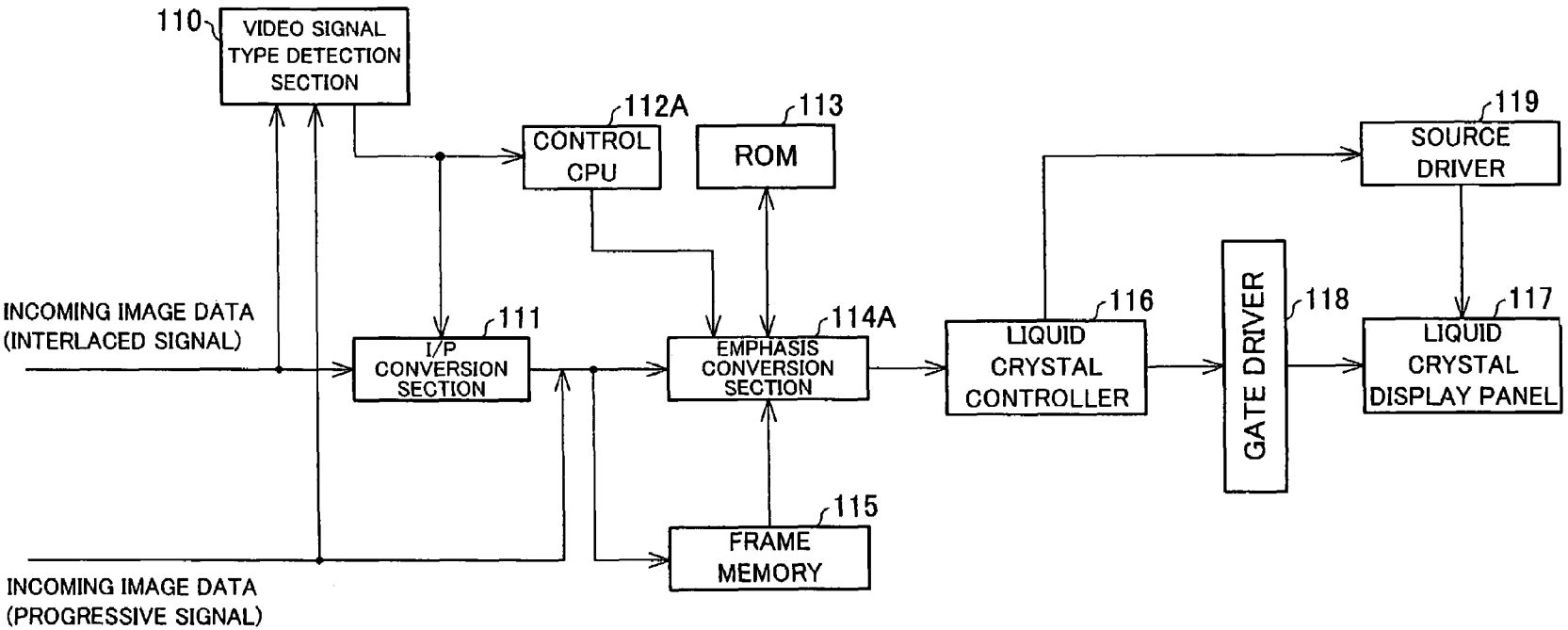
FIG. 1 is a diagram for explaining First Embodiment of a liquid crystal display device of the present invention
Figure 2:
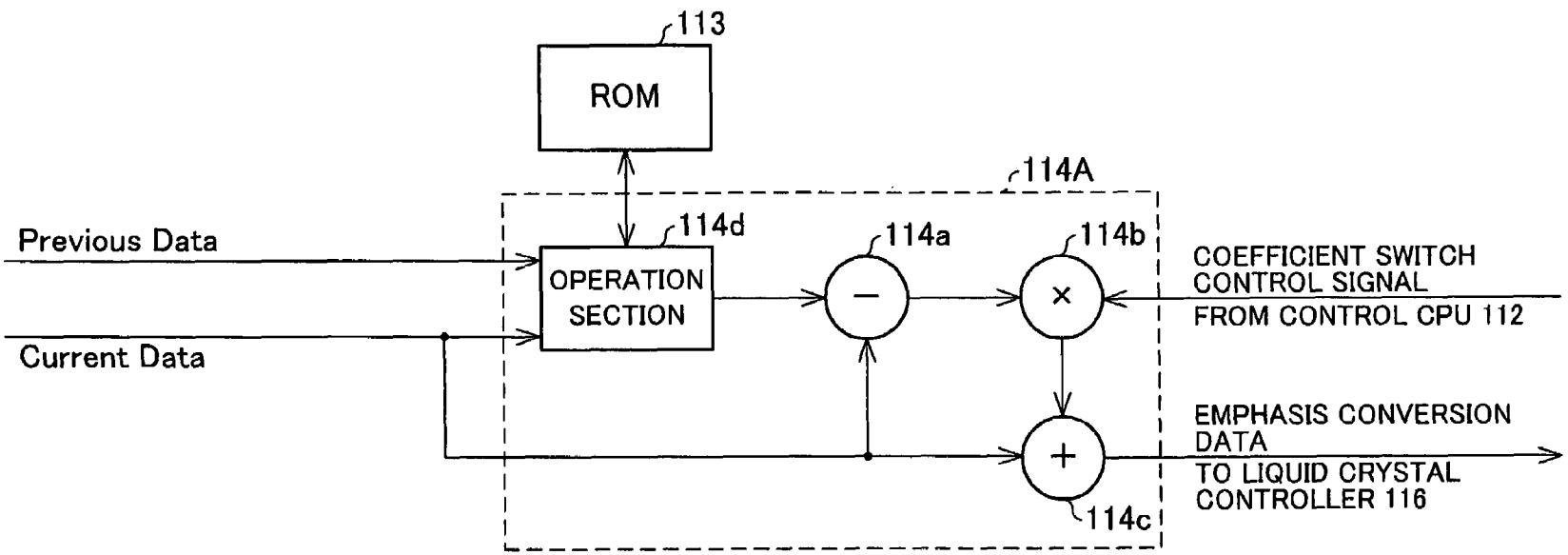
FIG. 2 is a diagram for explaining an arrangement in which emphasis conversion data supplied to a liquid crystal display panel is obtained by using (i) an OS parameter obtained with reference to an OS table memory (ROM) of FIG. 1 and (ii) a multiplier coefficient given according to the type of incoming signal.

FIG. 1 is a diagram for explaining First Embodiment of a liquid crystal display device of the present invention, and FIG. 2 is a diagram for explaining an arrangement in which emphasis conversion data supplied to a liquid crystal display panel is obtained by using (i) an OS parameter obtained with reference to an OS table memory (ROM) of FIG. 1 and (ii) a multiplier coefficient given according to the type of incoming signal. In the following descriptions, emphasis conversion is performed differently by the emphasis conversion section between the following Embodiments. That is why reference numerals 114A through 114F are given to the respective emphasis conversion sections in the following Embodiments. Similarly, controlling is performed differently by control CPUs between the following Embodiments. That is why reference numerals 112A through 112G are given to the control CPUs in the following Embodiments.

A liquid crystal display device of First Embodiment illustrated in FIG. 1 is arranged as follows: In a case where incoming image data is a progressive signal, the image data is not converted, but in a case where incoming image data is an interlaced signal, the image data is I/P converted into a progressive signal by any one of two or more I/P conversion methods. Then, in order to improve optical response speed of a liquid crystal display panel, the liquid crystal display device subjects the image data to emphasis conversion processing. In the emphasis conversion processing, a degree of emphasis conversion performed on the image data having been subjected to I/P conversion is controlled so as to change according to an I/P conversion method. The liquid crystal display device includes a video signal type detection section 110, an I/P conversion section 111, control CPU 112A, an emphasis conversion section 114A, a frame memory 115, a liquid crystal controller 116, and a liquid crystal display panel 117.

The video signal type detection section 110 serves as a signal type detection section. The video signal type detection section 110 detects a signal type indicative of whether incoming image data is an interlaced signal or a progressive signal. The signal type detection can be implemented by a detection method such that a horizontal frequency is counted for the determination of a signal format.

Figure 35:
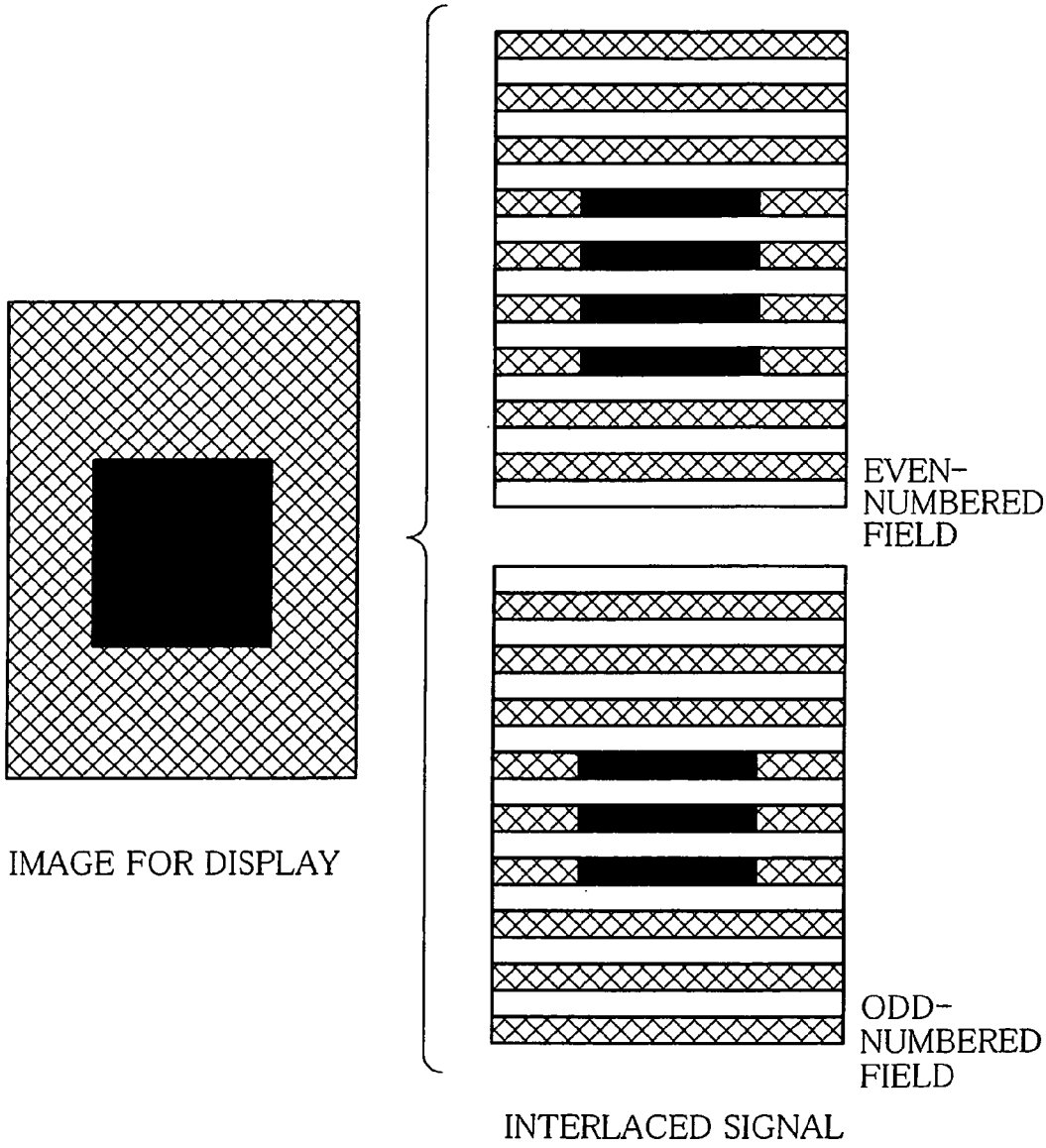
FIG. 35 is a view for explaining the conventional I/P conversion processing.
Figure 36:
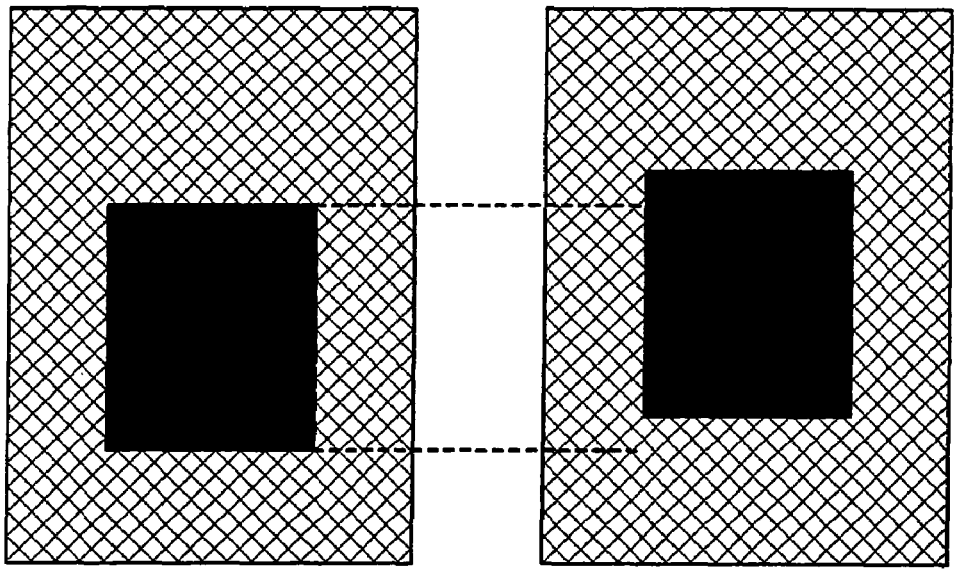
FIG. 36 is a view for explaining variation of an edge position in every frame of a displayed image due to the I/P conversion processing of FIG. 35.

The I/P conversion section 111 servers as I/P conversion means. The I/P conversion section 111 subjects odd-numbered field and even-numbered field of an interlaced signal to data interpolation, as explained previously with reference to FIG. 35. Then, the odd-numbered field and even-numbered field are converted into image data which is one frame long, as illustrated in FIG. 36. In this manner, an interlaced video signal (in case of NTSC broadcasting scheme) of 30 frames per second (60 fields per second) is converted into a quasi-progressive video signal of 60 frames per second.

The I/P conversion section 111 according to the present embodiment can convert an interlaced signal into a progressive signal by any one of two or more I/P conversion methods. Examples of the I/P conversion methods adopted by the I/P conversion section 111 according to the present embodiment include motion adaptive I/P conversion method, conversion by intra-field interpolation only.

The control CPU 112A serves as control means. When the video signal type detection section 110 has detected an interlaced signal, the control CPU 112A causes the I/P conversion section 111 to perform the I/P conversion process by any of the plurality of I/P conversion methods. Also, the control CPU 112A controls emphasis conversion processing performed by the emphasis conversion section 114A, in accordance with which of the I/P conversion methods is used by the I/P conversion section 111 to perform I/P conversion.

The liquid crystal display device therefore can select more appropriate conversion method automatically or by user hand in accordance with type and S/N ratio of a video signal supplied from a video signal source, user's preference, or demanded image quality, for example. Selection of a more appropriate conversion method by user hand includes user's selection from one I/P conversion method used by the I/P conversion section 111 to another as a result of user's judgment by visual observation that noise becomes obtrusive in a displayed video image due to video image processing performed on a video signal having a poor S/N ratio.

The emphasis conversion section 114A serves as emphasis conversion mean. Under the control of the control CPU 112A (in the present embodiment, a value of a coefficient switch control signal outputted from the control CPU 112A), the emphasis conversion section 114A compares image data of a current frame to be displayed (image data in a current vertical period) with image data of a previous frame stored in the frame memory 115 (image data in the immediately previous vertical period). OS parameter (emphasis conversion parameter) corresponding to a grayscale transition pattern, i.e. a result of the comparison is read from an OS table memory (ROM) 113. In accordance with the thus read OS parameter, emphasis conversion data (writing gradation data) required for image display of the current frame to be displayed is obtained and outputted to the liquid crystal controller 116. Here, in a case where incoming image data is a progressive signal, the image data is directly supplied to the emphasis conversion section 114A without being converted. In a case where incoming image data is an interlaced signal, the image data having been subjected to I/P conversion is supplied to the emphasis conversion section 114A by any one of two or more I/P conversion methods.

In this case, as illustrated in FIG. 2, the emphasis conversion data to be supplied to the liquid crystal display panel 117 can be obtained by using (i) the OS parameter obtained with reference to the OS table memory (ROM) 113 and (ii) a multiplier coefficient varying depending upon which of the I/P conversion methods is used for conversion by the I/P conversion section 111. That is, an operation section 114*d* compares incoming image data of Mth frame to be displayed (current data) with incoming image data of M−1th frame stored in the frame memory 115 (previous data). Subsequently, the operation section 114*d* reads OS parameter corresponding to a result of the comparison (grayscale transition) (i.e. OS parameter determined by the comparison result) from the OS table memory (ROM) 113, and then performs operation such as linear complement to output emphasis operation data.

Then, a subtracter 114*a* subtracts the emphasis operation data from the image data of the current frame to obtain difference data. A multiplier 114*a* multiplies the difference data by a multiplier coefficient $\alpha 1$ or $\beta 1$ which is switched in accordance with the coefficient switch control signal supplied from the control CPU 112A. An adder 114*c* adds the difference data multiplied by the multiplier coefficient $\alpha 1$ or $\beta 1$ to the image data of the current frame. Data obtained by the addition is given as emphasis conversion data to the liquid crystal controller 116. This allows a liquid crystal pixel to drive for display with a transmittance defined by the incoming image data within a predetermined period. Here, the predetermined period means a display period of one frame image (pixel rewrite cycle). In case of a normal hold-type display, the predetermined period is one frame period (e.g. 16.7 msec in 60-Hz progressive scanning). For example, in case of a pseudo-impulse type display in which black is displayed in 50% period of the one frame period, an image display period is ½ frame period (e.g. 8.3 msec in 60-Hz progressive scanning).

In a case where incoming image data is I/P converted by the motion adaptive I/P conversion method, the multiplier coefficient $\alpha 1$ is $\alpha 1=1$. In a case where incoming image data is I/P converted by conversion by intra-field interpolation only, the multiplier coefficient $\beta 1$ is $\beta 1<1$. With this arrangement, in a case where incoming image data is I/P converted by the motion adaptive I/P conversion method, the multiplier coefficient $\alpha 1$ (=1) is selected so that the image data is subjected to emphasis conversion in order that liquid crystal pixel provides a transmittance defined by the incoming image data within a predetermined period. This allows for high-definition image display without afterimage and trailing. Meanwhile, in a case where incoming image data is I/P converted by conversion by intra-field interpolation only, the multiplier coefficient $\beta 1$ (<1) is selected so that a degree of emphasis conversion can be lower. This prevents image quality degradation resulting from excessive emphasis such as unwanted flicker noise and jaggies caused in edge portions of displayed image by the I/P conversion processing.

Note that the OS table memory (ROM) 113 may have OS parameters (measured values) respectively corresponding to all of 256 levels of gray when displayed data is of 8 bits, i.e. 256 levels of gray. For example, as illustrated in FIG. 21, the OS table memory (ROM) 113 stores 9-by-9 OS parameters (measured values) concerning nine representative levels of gray in every thirty-two levels of gray. Emphasis conversion data corresponding to other levels than the nine representative levels of gray are obtained by operation such as linear complement from the measured value. Thus, it is possible to reduce a storage space in the OS table memory (ROM) 113.

The frame memory 115 can store image data of one frame. The frame memory 115 stores image data of a previous frame with respective to yet-to-be displayed image data of a current frame. The liquid crystal controller 116 drives a gate driver 118 and a source driver 119 in accordance with the emphasis conversion data supplied from the emphasis conversion section 114A, and then causes the liquid crystal display panel 117 to provide image display. The liquid crystal display panel 117 has TFT (Thin Film Transistor) that is the foregoing nonlinear element (switching element), and provides image display as the gate driver 118 and the source driver 119 drive.

Next, the following will describe a liquid crystal display control method by using the above-described emphasis conversion of incoming image data in First Embodiment.

First of all, when incoming image data is an interlaced signal, the I/P conversion section 111 I/P converts the incoming image data by either of the motion adaptive I/P conversion method or conversion method by intra-field interpolation only under the control of the control CPU 112A to generate a quasi-progressive signal. Then the I/P conversion section 111 supplies the progressive signal to the emphasis conversion section 114A.

Here, when the I/P conversion section 111 is under instruction from the control CPU 112A to perform I/P conversion by the motion adaptive I/P conversion method, the I/P conversion section 111 performs the motion adaptive I/P conversion to generate a quasi-progressive signal, and then supplies the thus generated signal to the emphasis conversion section 114A.

At this moment, the control CPU 112A instructs the emphasis conversion section 114A to perform emphasis conversion processing on the image data having been subjected to the motion adaptive I/P conversion. In this case, as described previously, the operation section 114*d* compares incoming yet-to-be displayed image data of Mth frame (Current Data) with incoming image data of M−1th frame stored in the frame memory 115 (Previous Data). The operation section 114*d* reads OS parameter corresponding to a result of the comparison (grayscale transition) from the OS table memory (ROM) 113 so as to obtain emphasis operation data. Note that the thus obtained emphasis operation data is data with which it is possible to attain transmittance defined by the incoming image data of Mth frame to be displayed on the liquid crystal display panel 117 within a predetermined period. The subtracter 114*a* obtains difference data between the emphasis operation data and the yet-to-be displayed incoming image data of Mth frame.

Here, the control CPU 112A selects the multiplier coefficient $\alpha$1 (=1) for the motion adaptive I/P conversion. The multiplier 114*b* therefore multiplies the difference data obtained by the subtracter 114*a* by the multiplier coefficient $\alpha$1 (=1) (i.e. the multiplier 114*b* directly outputs the difference data). The adder 114*c* adds data thus obtained by the multiplication to the yet-to-be displayed incoming image data of Mth frame, and provides data thus obtained by the addition, as emphasis conversion data, to the liquid crystal controller 116 (In this case, the emphasis conversion data supplied to the liquid crystal display panel 117 is therefore equal to emphasis operation data obtained by the operation section 114*d*.). With this arrangement, in a case where the incoming image data is I/P converted by the motion adaptive I/P conversion method, liquid crystal pixels are driven so as to provide display in a predetermined period with transmittance defined by the incoming image data. This compensates for optical response properties of the liquid crystal display panel 117 and allows for a high-definition image display without afterimage and trailing.

On the other hand, when the I/P conversion section 111 is under instruction from the control CPU 112A to perform I/P conversion by the conversion method by intra-field interpolation only, the I/P conversion section 111 performs conversion by intra-field interpolation only to generate a quasi-progressive signal, and then supplies the thus generated signal to the emphasis conversion section 114A.

Further, at this moment, the control CPU 112A instructs the emphasis conversion section 114A to perform emphasis conversion processing on the image data having been subjected to conversion by intra-field interpolation only. In this case, as described previously, the operation section 114*d* compares yet-to-be displayed incoming image data of Mth frame (Current Data) with incoming image data of M−1th frame stored in the frame memory 115 (Previous Data). The operation section 114*d* reads OS parameter corresponding to a result of the comparison (grayscale transition) from the OS table memory (ROM) 113 so as to obtain emphasis operation data. Note that the thus obtained emphasis operation data is data with which it is possible to attain transmittance defined by incoming image data of Mth frame to be displayed in a predetermined period on the liquid crystal display panel 117. The subtracter 114*a* obtains difference data between the emphasis operation data and the yet-to-be displayed incoming image data of Mth frame.

Here, the control CPU 112A selects the multiplier coefficient $\beta$1 (<1) for the I/P conversion by intra-field interpolation only. The multiplier 114*b* therefore multiplies the difference data obtained by the subtracter 114*a* by the multiplier coefficient $\beta$1 (i.e. the multiplier 114*b* outputs reduced difference data). The adder 114*c* adds data thus obtained by the multiplication to the yet-to-be displayed incoming image data of Mth frame, and supplies data thus obtained by the addition, as emphasis conversion data, to the liquid crystal controller 116 (In this case, the emphasis conversion data supplied to the liquid crystal display panel 117 is lower in the degree of emphasis conversion than emphasis operation data obtained by the operation section 114*d*.). With this arrangement, in a case where the incoming image data is converted by intra-field interpolation only, compensation for optical response properties of the liquid crystal display panel 117 is performed to suppress the occurrence of afterimage and trailing and to suppress image quality degradation resulting from the emphasis of an unwanted false signal caused by the I/P conversion processing. This allows for a high-definition image display.

As described above, in First Embodiment, in a case where the incoming image data is I/P converted by the motion adaptive I/P conversion in the I/P conversion section 111, the emphasis conversion section 114A reads from the OS table memory (ROM) 113 OS parameter corresponding to a result of the comparison (grayscale transition) between incoming image data of a current frame and incoming image data of a previous frame. Then, the emphasis conversion section 114A outputs emphasis operation data obtained in accordance with the thus read OS parameter, as emphasis conversion data, to the liquid crystal controller 116. Thus, liquid crystal pixels are driven so as to provide display in a predetermined period with transmittance defined by the incoming image data. This allows for a high-definition image display free from afterimage and trailing.

Meanwhile, in a case where the incoming image data is I/P converted by intra-field interpolation only in the I/P conversion section 111, the emphasis conversion section 114A reads OS parameter corresponding to a result of the comparison (grayscale transition) between incoming image data of a current frame and incoming image data of a previous frame from the OS table memory (ROM) 113, and outputs emphasis operation data which is lower in the degree of emphasis conversion than the emphasis operation data obtained in accordance with the thus read OS parameter, as emphasis conversion data, to the liquid crystal controller 116. This improves response speed of liquid crystal and suppresses image quality degradation resulting from a false signal caused in edge portions or others in an image when an interlaced signal is I/P converted by the above-described I/P conversion method, while suppressing the occurrence of afterimage and trailing. This allows for high definition image display.

Second Embodiment

Figure 3:
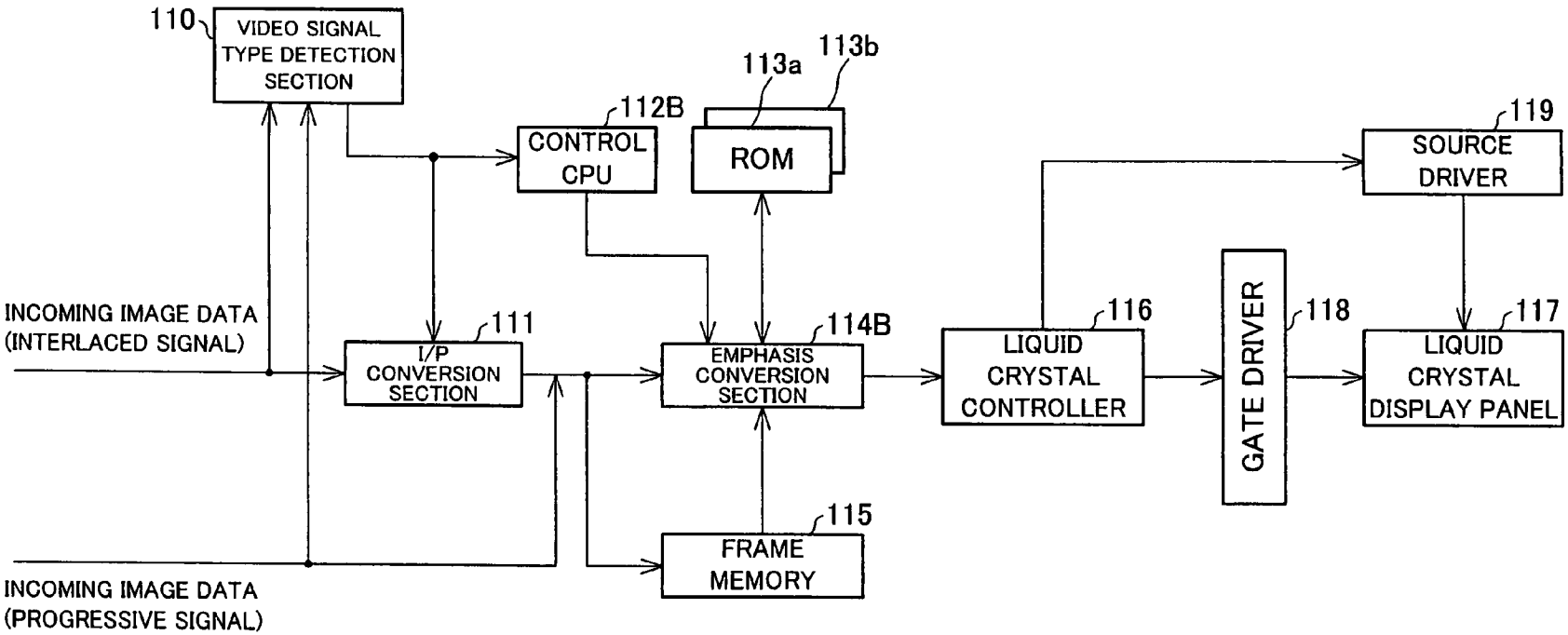
FIG. 3 is a diagram illustrating Second Embodiment including two OS table memories (ROMs) provided separately, wherein one OS table memory is referenced to in a case where incoming image data is a progressive signal, and the other OS table memory is referenced to in a case where incoming image data is an interlaced signal.

FIG. 3 is a diagram illustrating Second Embodiment including two OS table memories (ROMs) provided separately, wherein one OS table memory stores an OS parameter used in emphasis conversion of image data in a case where the incoming image data is subjected to the motion adaptive I/P conversion, and the other OS table memory stores OS parameter used in emphasis conversion of image data in a case where incoming image data is converted by intra-field interpolation only. Note that as to drawings referenced to in the following descriptions, the same members as those illustrated in FIG. 1 are given the same reference numerals and explanations thereof are omitted here.

A liquid crystal display device illustrated in FIG. 3 includes OS table memory (ROM) 113*a* and OS table memory (ROM) 113*b*. The OS table memory (ROM) 113*a* is referenced to in a situation where incoming image data is subjected to motion adaptive I/P conversion, and the OS table memory (ROM) 113*b* is referenced to in a situation where incoming image data is converted by intra-field interpolation only. The OS memory (ROM) 113*a* and the OS memory (ROM) 113*b* are switched for reference in accordance with an I/P conversion method used for the I/P conversion by the I/P conversion section 111, so that emphasis conversion processing of image data is performed.

The OS parameter stored in the OS table memory (ROM) 113*b* is lower in value than the OS parameter stored in the OS table memory (ROM) 113*a*. As described previously, this is because, in order to prevent false signal caused in edge portions of an image from being obtrusively emphasized when an interlaced signal is subjected to intra-field interpolation only, the degree of emphasis conversion performed on the image data must be lower in a case where incoming image data is subjected to intra-field interpolation only than in a case where incoming image data is subjected to motion adaptive I/P conversion.

In the present embodiment, each of the OS table memories (ROM) 113*a* and 113*b*, which are separately provided, stores the respective OS parameters therein. Alternatively, a single OS table memory (ROM) may be adopted that includes different tables each of which stores an OS parameter therein, and switching between the OS parameters to select one of them by adaptively switching from the table referenced to another in accordance with a switch control signal supplied from the control CPU 112B so as to obtain emphasis conversion data.

In such an arrangement, when the I/P conversion section 111 is under instruction from the control CPU 112B to perform I/P conversion by the motion adaptive I/P conversion method, the I/P conversion section 111 performs the motion adaptive I/P conversion to generate a quasi-progressive signal, and then supplies the thus generated signal to the emphasis conversion section 114B.

At this moment, the control CPU 112B instructs the emphasis conversion section 114B as emphasis conversion means to perform emphasis conversion processing on the image data having been subjected to the motion adaptive I/P conversion. In this case, the emphasis conversion section 114B reads OS parameter corresponding to a result of comparison (grayscale transition) between yet-to-be displayed incoming image data of Mth frame (Current Data) with incoming image data of M−1th frame stored in the frame memory 115 (Previous Data) (i.e. OS parameter determined by the comparison result) from the OS table memory (ROM) 113*a*, which is referenced to when the incoming image data is subjected to the motion adaptive I/P conversion. Then, by using the thus read Os parameter, the emphasis conversion section 114B performs operation such as linear complement to obtain emphasis conversion data to be outputted to the liquid crystal controller 116. Note that the thus obtained emphasis conversion data is data with which it is possible to attain transmittance defined by the incoming image data of Mth frame yet to be displayed on the liquid crystal display panel 117 in a predetermined period.

Thus, in a case where the incoming image data is subjected to the motion adaptive I/P conversion, liquid crystal pixels are driven so as to provide display in a predetermined period with transmittance defined by the incoming image data. This compensates for optical response properties of the liquid crystal display panel 117, thus providing a high-definition image display free from afterimage and trailing.

Meanwhile, when the I/P conversion section 111 is under instruction from the control CPU 112B to perform conversion by intra-field interpolation only, the I/P conversion section 111 performs conversion by intra-field interpolation only to generate a quasi-progressive signal, and then supplies the thus generated signal to the emphasis conversion section 114B.

At this moment, the control CPU 112B instructs the emphasis conversion section 114B to perform emphasis conversion processing on the I/P converted image data. In this case, the emphasis conversion section 114B reads OS parameter corresponding to a result of comparison (grayscale transition) between yet-to-be displayed incoming image data of Mth frame (Current Data) and incoming image data of M−1th frame stored in the frame memory 115 (Previous Data) (i.e. OS parameter determined by the comparison result) from the OS table memory (ROM) 113*b*, which is referenced to when the incoming image data is an interlaced signal. Then, by using the thus read OS parameter, the emphasis conversion section 114B performs operation such as linear complement to obtain emphasis operation data to be outputted to the liquid crystal controller 116. Note that the thus obtained emphasis conversion data is lower in the degree of emphasis conversion than emphasis conversion data obtained with reference to the OS table memory (ROM) 113*a* when the incoming image data is a progressive signal.

Thus, in a case where the incoming image data is converted by intra-field interpolation only, compensation for optical response properties of the liquid crystal display panel 117 is performed to suppress image degradation resulted from the emphasis of an unwanted false signal caused by the I/P conversion processing, while suppressing the occurrence of afterimage and trailing. This allows for high-definition image display.

Thus, Second Embodiment includes: the OS table memory (ROM) 113*a* which stores OS parameter used when incoming image data is subjected to the motion adaptive I/P conversion; and the OS table memory (ROM) 113*b* which stores OS parameter used when incoming image data is subjected to conversion by intra-field interpolation only. OS parameter in the OS table memory (ROM) 113*b* is lower in value than OS parameter in the OS table memory (ROM) 113*a*, and obtains emphasis conversion data by using OS parameter read from either the OS table memory (ROM) 113*a* or the OS table memory (ROM) 113*b* depending upon which the thus detected signal is a progressive signal or interlaced signal. Thus, it is possible to appropriately subject image data to emphasis conversion processing in accordance with an I/P conversion method performed on incoming image data.

Third Embodiment

Figure 4:
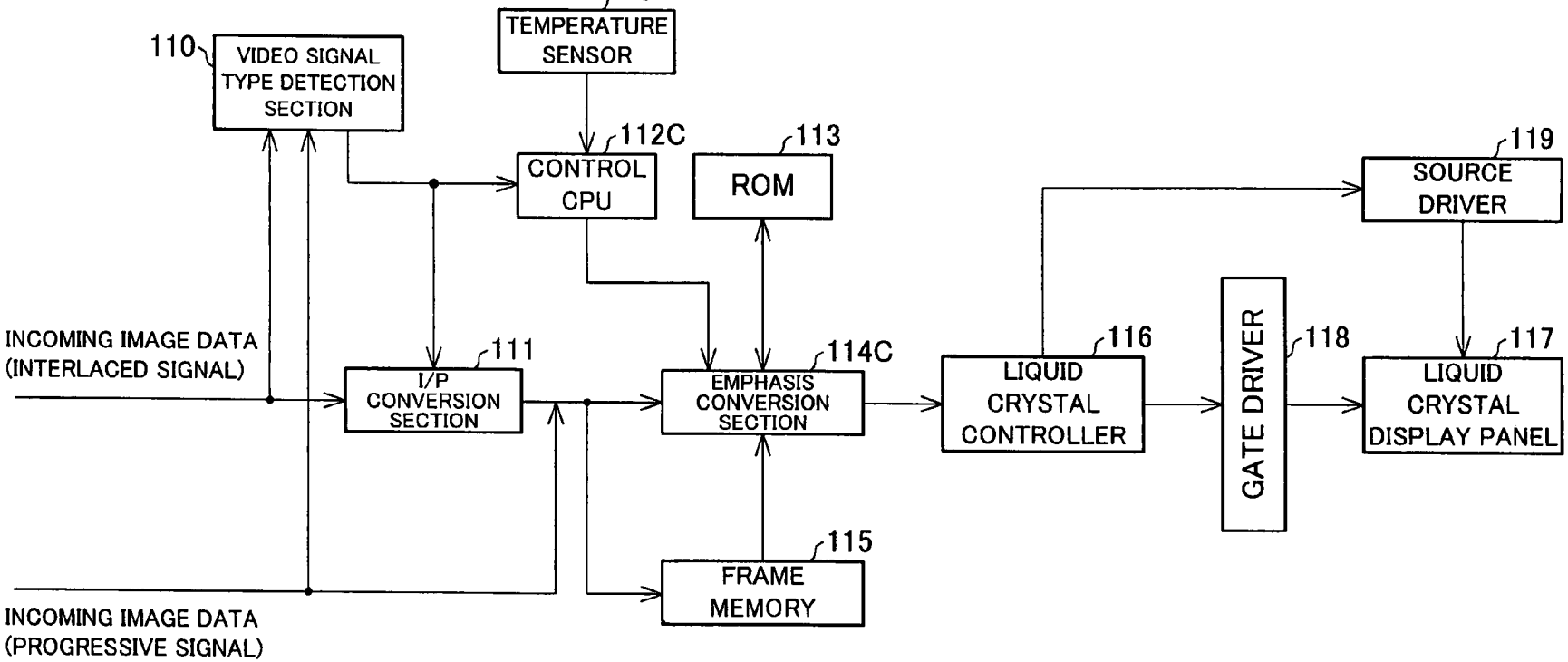
FIG. 4 is a diagram illustrating Third Embodiment in which a temperature sensor is added to the configuration illustrated in FIG. 1, and emphasis conversion processing is performed on image data by using OS parameter obtained with reference to OS table memory (ROM) and a multiplier coefficient determined depending upon the signal type of incoming image data and a device internal temperature.

FIG. 4 is a diagram illustrating Third Embodiment in which a temperature sensor is added to the configuration illustrated in FIG. 1, and emphasis conversion processing is performed on image data by using OS parameter obtained with reference to OS table memory (ROM) 113 and a multiplier coefficient determined depending upon an I/P conversion method and a device internal temperature.

In a liquid crystal display device illustrated in FIG. 4, as in the case of the above-mentioned embodiment, OS table memory (ROM) 113 stores therein OS parameter (emphasis conversion parameter) undergone optimization when incoming image data is subjected to the motion adaptive I/P conversion. In addition, emphasis conversion on incoming image data is performed by using later-described multiplier coefficients $\alpha 1$ to $\alpha 4$ and $\beta 1$ to $\beta 4$ determined depending upon (i) I/P conversion methods performed by the I/P conversion section 111 and (ii) temperature detection data obtained by a temperature sensor 120 as temperature detection means.

Here, as described previously, the OS table memory (ROM) 113 may have OS parameters (measured values) respectively corresponding to all of 256 levels of gray when displayed data is of 8 bits, i.e. 256 levels of gray. For example, as illustrated in FIG. 21, the OS table memory (ROM) 113 stores 9-by-9 OS parameters (measured values) concerning nine representative levels of gray in every thirty-two levels of gray. Emphasis conversion data corresponding to other levels than the nine representative levels of gray are obtained by operation such as linear complement from the measured value. Thus, it is possible to reduce a storage space in the OS table memory (ROM) 113.

An emphasis conversion section 114C of the present embodiment is realized by the same configuration as in FIG. 2, and obtains emphasis conversion data by using (i) an OS parameter having been read from the OS table memory (ROM) 113 and (ii) multiplier coefficients $\alpha 1$ to $\alpha 4$ and $\beta 1$ to $\beta 4$ determined depending upon a signal type and a temperature of the liquid crystal display panel 117, and outputs the obtained emphasis conversion data to the liquid crystal controller 116. The emphasis conversion data is used to compensate for optical response properties including temperature dependence property of the liquid crystal display panel 117. Here, $\alpha 1$ to $\alpha 4$ are multiplier coefficients in a case where incoming image data is subjected to the motion adaptive I/P conversion, and $\beta 1$ to $\beta 4$ are multiplier coefficients in a case where incoming image data is subjected to conversion by intra-field interpolation only, where $\beta 1<\alpha 1$, $\beta 2<\alpha 2$, $\beta 3<\alpha 3$, and $\beta 4<\alpha 4$.

More specifically, for example, assume that temperature detection data obtained by the temperature sensor 120 is rated on a scale of four temperature ranges: (i) 15° C. or lower, (ii) higher than 15° C. but not higher than 25° C., (iii) higher than 25° C. but not higher than 35° C., and (iv) 35° C. or higher. The explanation given below will describe the following cases: Under a situation where incoming image data is a progressive signal, when a device internal temperature is 15° C. or lower, for example, the multiplier coefficient is $\alpha 1$ ($>\alpha 2$). When the device internal temperature is higher than 15° C. but not higher than 25° C., the multiplier coefficient is $\alpha 2$ ($>\alpha 3$). When the device internal temperature is higher than 25° C. but not higher than 35° C., the multiplier coefficient is $\alpha 3$ ($>\alpha 4$). When the device internal temperature is 35° C. or higher, the multiplier coefficient is $\alpha 4$ (=1). Under a situation where incoming image data is an interlaced signal, when a device internal temperature is 15° C. or lower, for example, the multiplier coefficient is $\beta 1$ ($>\beta 2$). When the device internal temperature is higher than 15° C. but not higher than 25° C., the multiplier coefficient is $\beta 2$ ($>\beta 3$). When the device internal temperature is higher than 25° C. but not higher than 35° C., the multiplier coefficient is $\beta 3$ ($>\beta 4$). When the device internal temperature is 35° C. or higher, the multiplier coefficient is $\beta 4$ ($<1$). It is needless to say that the multiplier coefficients may correspond to three or less temperature ranges or five or more temperature ranges.

Note that these multiplier coefficients $\alpha 1$ to $\alpha 4$ and $\beta 1$ to $\beta 4$ are obtained in advance from measured values of optical response properties of the liquid crystal display panel 117. With this arrangement, in a case where incoming image data is converted by intra-field interpolation only, emphasis conversion can be performed on image data with a lower degree of emphasis conversion than a degree of emphasis conversion with which image data is subjected to the motion adaptive I/P conversion. This compensates for optical response properties (including temperature dependence property) of the liquid crystal display panel 117 while suppressing image degradation resulted from the emphasis of an unwanted false signal caused by the I/P conversion by intra-field interpolation only. This allows for high-definition image display free from afterimage and trailing.

It is preferable that the temperature sensor 120 is provided inside the liquid crystal display panel 117 in consideration with its originally intended use, but which is structurally difficult. It is safe that the temperature sensor 120 is placed at the closest possible location to the liquid crystal display panel 117. The number of the temperature sensor 120 is not limited to one, and may be two or more. The temperature sensors 120 may be disposed respectively corresponding to areas of the liquid crystal display panel 117. If a plurality of temperature sensors 120 are provided, a mean value of respective detection results obtained by the temperature sensors 120 may be used as temperature detection data, or a greatly changed detection result obtained by any of the temperature sensors 120 may be used as temperature detection data.

In such an arrangement, when the I/P conversion section 111 is under instruction from the control CPU 112C to perform I/P conversion by the motion adaptive I/P conversion method, for example, the I/P conversion section 111 performs the motion adaptive I/P conversion to generate a quasi-progressive signal, and then supplies the thus generated signal to the emphasis conversion section 114C.

At this moment, the control CPU 112C instructs the emphasis conversion section 114C as emphasis conversion means to perform emphasis conversion processing on the incoming image data having been subjected to the motion adaptive I/P conversion. In this case, as described previously, the operation section 114*d* compares incoming image data of Mth frame yet to be displayed (Current Data) with incoming image data of M−1th frame stored in the frame memory 115 (Previous Data). Then the operation section 114*d* reads OS parameter corresponding to a result of the comparison (gray-scale transition) (i.e. OS parameter determined by the comparison result) from the OS table memory (ROM) 113 to obtain emphasis operation data. Subsequently, the subtracter 114*a* obtains difference data between the obtained emphasis operation data and the incoming image data of Mth frame yet to be displayed.

At this point in time, the control CPU 112C has received the temperature detection data from the temperature sensor 120. The control CPU 112C performs switching between the multiplier coefficient $\alpha 1$ to $\alpha 4$ to select one of them corresponding to the temperature detection data. Here, for example, if the temperature detection data is 15° C. or lower, the multiplier coefficient $\alpha 1$ ($>\alpha 2$) is selected. If the temperature detection data is higher than 15° C. but not higher than 25° C., the multiplier coefficient $\alpha 2$ ($>\alpha 3$) is selected. If the temperature detection data is higher than 25° C. but not higher than 35° C., the multiplier coefficient $\alpha 3$ ($>\alpha 4$) is selected. If the temperature detection data is 35° C. or higher, the multiplier coefficient $\alpha 4$ (=1) is selected.

When the control CPU 112C performs switching between the multiplier coefficients $\alpha 1$ to $\alpha 4$ to select one of them corresponding to the temperature detection data, the multiplier 114*b* multiplies the difference data by the selected one of the multiplier coefficients $\alpha 1$ to $\alpha 4$. The adder 114*c* adds data thus obtained by the multiplication to the incoming image data of Mth frame yet to be displayed, and supplies data thus obtained by the addition, as emphasis conversion data, to the liquid crystal controller 116. Thus, in a case where the incoming image data is a progressive signal, compensation for optical response properties (including temperature dependence property) of the liquid crystal display panel 117 is performed even when there occurs change in temperature of the liquid crystal display panel 117. This allows for high-definition image display free from afterimage and trailing.

On the other hand, when the I/P conversion section 111 is under instruction from the control CPU 112C to perform I/P conversion by intra-field interpolation only, the I/P conversion section 111 performs conversion by intra-field interpolation only to generate a quasi-progressive signal, and then supplies the thus generated signal to the emphasis conversion section 114C.

At this moment, the control CPU 112C instructs the emphasis conversion section 114C to perform emphasis conversion processing on the image data having been subjected to the I/P conversion processing. In this case, as described previously, the operation section 114*d* compares incoming image data of Mth frame yet to be displayed (Current Data) with incoming image data of M−1th frame stored in the frame memory 115 (Previous Data). Then, the operation section 114*d* reads OS parameter corresponding to a result of the comparison (grayscale transition) (i.e. OS parameter determined by the comparison result) from the OS table memory (ROM) 113 to obtain emphasis operation data. Subsequently, the subtracter 114*a* obtains difference data between the obtained emphasis operation data and the incoming image data of Mth frame yet to be displayed.

At this point in time, the control CPU 112C has received the temperature detection data from the temperature sensor 120. The control CPU 112C performs switching between the multiplier coefficient β1 to β4 to select one of them corresponding to the temperature detection data. Here, for example, if the temperature detection data is 15° C. or lower, the multiplier coefficient β1 (>β2) is selected. If the temperature detection data is higher than 15° C. but not higher than 25° C., the multiplier coefficient β2 (>β3) is selected. If the temperature detection data is higher than 25° C. but not higher than 35° C., the multiplier coefficient β3 (>β4) is selected. If the temperature detection data is 35° C. or higher, the multiplier coefficient β4 (<1) is selected.

When the control CPU 112C performs switching between the multiplier coefficients β1 to β4 to select one of them corresponding to the temperature detection data, the multiplier 114*b* multiplies the difference data by the selected one of the multiplier coefficients β1 to β4. The adder 114*c* adds data thus obtained by the multiplication to the incoming image data of Mth frame yet to be displayed, and supplies data thus obtained by the addition, as emphasis conversion data, to the liquid crystal controller 116.

Here, in a case where the incoming image data is an interlaced signal, β1<α1, β2<α2, β3<α3, and β4<α4. Thus, compensation for optical response properties (including temperature dependence property) of the liquid crystal display panel 117 is performed even when there occurs change in temperature of the liquid crystal display panel 117, so as to suppress the occurrence of afterimage and trailing while suppressing image degradation resulted from the emphasis of an unwanted false signal caused by the I/P conversion processing. This allows for high-definition image display.

Thus, in Third Embodiment, the degree of emphasis conversion of the incoming image data is controlled so as to change by using the multiplier coefficients α1 through α4, which are used when the incoming image data is subjected to the motion adaptive I/P conversion, and the multiplier coefficients β1 through β4, which are used when the incoming image data is subjected to conversion by intra-field interpolation only, according to the temperature detection data obtained by the temperature sensor 120. This makes it possible to subject image data an appropriate emphasis conversion processing in accordance with an I/P conversion method performed on the incoming image data and a device internal temperature, thus allowing for high-definition image display.

Fourth Embodiment

Figure 5:
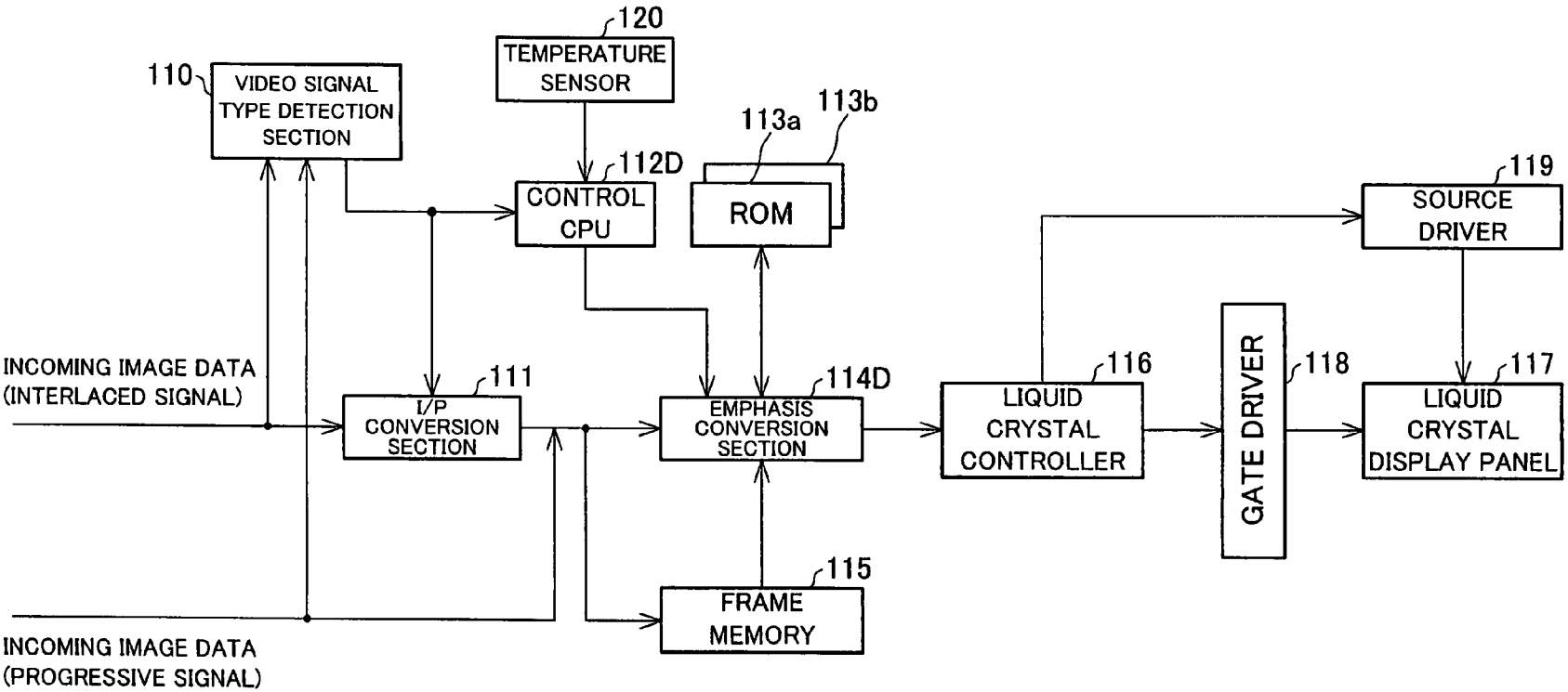
FIG. 5 is a diagram illustrating Fourth Embodiment in which the OS table memory (ROM) illustrated in FIG. 4 comprises two OS table memories (ROMs) provided separately, wherein one OS table memory stores an OS parameter which is referenced to when incoming image data is a progressive signal, the other OS table memory stores an OS parameter which is referred to when incoming image data is an interlaced signal, and the degree of emphasis conversion on image data is changed by using a multiplier coefficient responsive to a device internal temperature.
Figure 6:
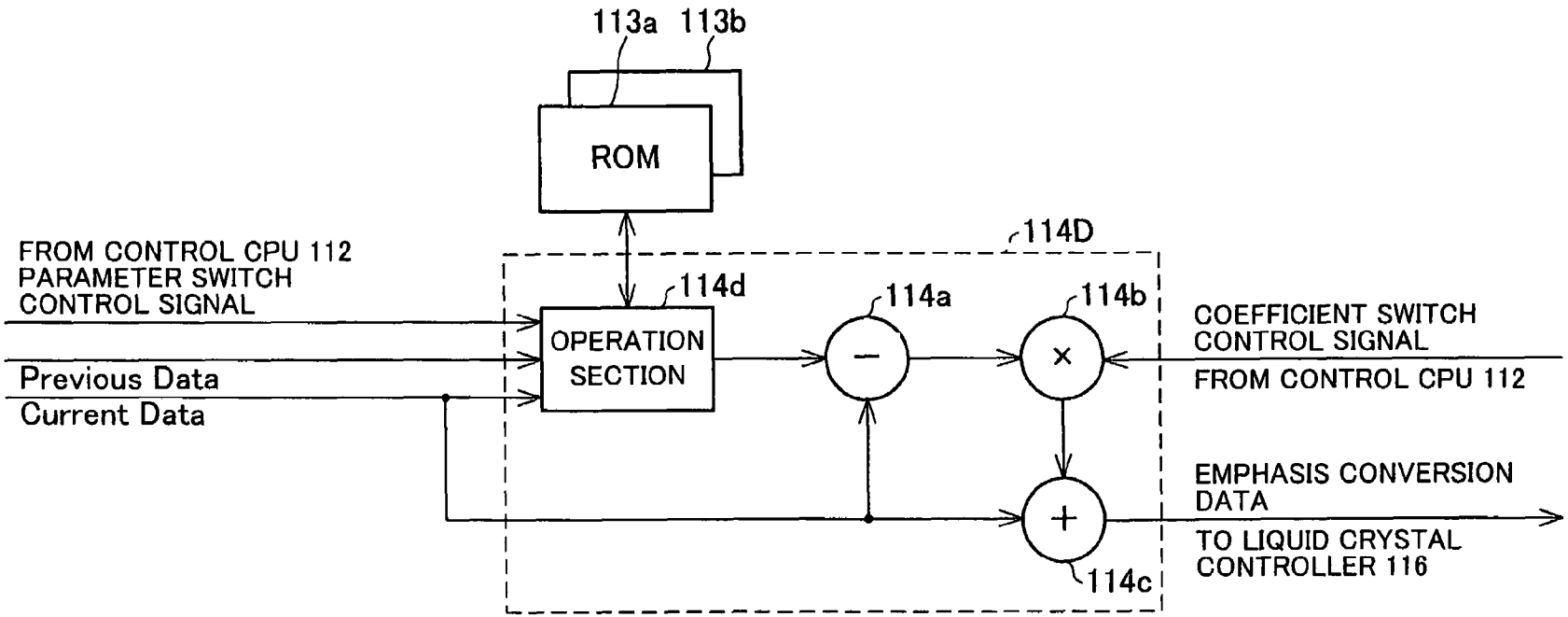
FIG. 6 is a diagram for explaining an arrangement where emphasis conversion data is obtained by using (i) OS parameter obtained with reference to the OS table memory (ROM) of FIG. 5 and (ii) a multiplier coefficient corresponding to temperature detection data obtained by a temperature sensor.

FIG. 5 is a diagram illustrating an embodiment (Fourth Embodiment) in which the OS table memory (ROM) illustrated in FIG. 4 comprises (i) two OS table memories (ROMs) provided separately, wherein one OS table memory stores OS parameter which is referred to when incoming image data is subjected to the motion adaptive I/P conversion and is used in emphasis conversion of image data, the other OS table memory stores OS parameter which is referred to when incoming image data is subjected to the conversion by intra-field interpolation only and are used in emphasis conversion of image data, and the degree of emphasis conversion on image data is changed by using a multiplier coefficient responsive to a device internal temperature. FIG. 6 is a diagram for explaining an arrangement where emphasis conversion data is obtained by using (i) OS parameter obtained as a result of referring to an OS table memory (ROM) of FIG. 5 and (ii) a multiplier coefficient corresponding to temperature detection data obtained by a temperature sensor.

A liquid crystal display device illustrated in FIG. 5. includes an OS table memory (ROM) 113*a* and an OS table memory (ROM) 113*b*. The OS table memory (ROM) 113*a* is referenced to when incoming image data is subjected to the motion adaptive I/P conversion. The OS table memory (ROM) 113*b* is referenced to when incoming image data is subjected to the conversion by intra-field interpolation only. Switching between the OS table memory (ROM) 113*a* and the OS table memory (ROM) 113*b* is performed in accordance with an I/P conversion method used by the I/P conversion section 111, so that either the OS table memory (ROM) 113*a* or the OS table memory (ROM) 113*b* is referenced to, and thus emphasis conversion on incoming image data is performed by using later-described multiplier coefficients α1 to α4 corresponding to temperature detection data obtained by the temperature sensor 120.

OS parameter in the OS table memory (ROM) 113*b* is lower in value than OS parameter in the OS table memory (ROM) 113*a*. As described previously, this is because, in order to prevent flicker noise (false signal) or the like caused in edge portions of a displayed image from being noticeably emphasized due to emphasis conversion performed on image data obtained by I/P conversion by intra-field interpolation only, the degree of emphasis conversion performed on the image data must be lower in a case where incoming image data is subjected to conversion by intra-field interpolation only than in a case where incoming image data is subjected to motion adaptive I/P conversion.

In the present embodiment, the OS table memories (ROM) 113*a* and 113*b* provided separately store respective OS parameters. Alternatively, the present embodiment may be arranged such that respective OS parameters are stored in different table regions of a single OS table memory (ROM), and the OS parameters are switched for selection to obtain emphasis conversion data, by adaptively switching from one reference table region to another in accordance with a switch control signal supplied from the control CPU 112D.

As described previously, the OS table memories (ROMs) 113*a* and 113*b* each may have OS parameters (measured values) respectively corresponding to all of 256 levels of gray when display data is of 8 bits, i.e. 256 levels of gray. For example, as illustrated in FIG. 21, each of the OS table memories (ROMs) 113*a* and 113*b* stores 9-by-9 OS parameters (measured values) concerning nine representative levels of gray in every thirty-two levels of gray. Emphasis conversion data corresponding to other levels than the nine representative levels of gray are obtained by operation such as linear complement from the measured value. Thus, it is possible to reduce a storage space in the OS table memory (ROM) 113.

An emphasis conversion section 114D of the present embodiment is realized by the same configuration as in FIG. 2, and obtains emphasis conversion data by using (i) OS parameter having been read from either the OS table memory (ROM) 113*a* or the OS table memory (ROM) 113*b* and (ii) multiplier coefficients α1 to α4 determined depending upon a temperature of the liquid crystal display panel 117, and outputs the obtained emphasis conversion data to the liquid crystal controller 116.

More specifically, for example, assume that temperature detection data obtained by the temperature sensor 120 is rated on a scale of four temperature ranges: (i) 15° C. or lower, (ii) higher than 15° C. but not higher than 25° C., (iii) higher than 25° C. but not higher than 35° C., and (iv) 35° C. or higher. The explanation given below will describe the following cases: When a device internal temperature is 15° C. or lower, for example, the multiplier coefficient is α1 (>α2). When the device internal temperature is higher than 15° C. but not higher than 25° C., the multiplier coefficient is α2 (>α3). When the device internal temperature is higher than 25° C. but not higher than 35° C., the multiplier coefficient is α3 (>α4). When the device internal temperature is 35° C. or higher, the multiplier coefficient is α4 (=1). It is needless to say that the multiplier coefficients may correspond to three or less temperature ranges or five or more temperature ranges.

Note that these multiplier coefficients α1 to α4 are obtained in advance from measured values of optical response properties of the liquid crystal display panel 117. With this arrangement, in a case where incoming image data is subjected to conversion by intra-field interpolation only, emphasis conversion of image data can be performed in the degree of emphasis conversion lower than the degree of emphasis conversion in a case where incoming image data is subjected to the motion adaptive I/P conversion. This compensates for optical response properties (including dependence property) of the liquid crystal display panel 117 while suppressing image degradation resulted from the emphasis of an unwanted false signal caused by the I/P conversion by intra-field interpolation only. This allows for high-definition image display free from afterimage and trailing.

It is preferable that the temperature sensor 120 is provided inside the liquid crystal display panel 117 in consideration with its originally intended use, but which is structurally difficult. It is safe that the temperature sensor 120 is placed at the closest possible location to the liquid crystal display panel 117. The number of the temperature sensor 120 is not limited to one, and may be two or more. The temperature sensors 120 may be disposed respectively corresponding to areas of the liquid crystal display panel 117. If a plurality of temperature sensors 120 are provided, a mean value of respective detection results obtained by the temperature sensors 120 may be used as temperature detection data, or a greatly changed detection result obtained by any of the temperature sensors 120 may be used as temperature detection data.

In such an arrangement, when the I/P conversion section 111 is under instruction from the control CPU 112D to perform I/P conversion by the motion adaptive I/P conversion method, the I/P conversion section 111 performs the motion adaptive I/P conversion to generate a quasi-progressive signal, and then supplies the thus generated signal to the emphasis conversion section 114D.

At this moment, the control CPU 112D instructs the emphasis conversion section 114D as emphasis conversion means to perform emphasis conversion processing on the incoming image data having been subjected to the motion adaptive I/P conversion. In this case, as illustrated in FIG. 6, a parameter switch control signal from the control CPU 112D instructs the emphasis conversion section 114D to reference to the OS table memory (ROM) 113*a*. Then, the operation section 114*d* compares incoming image data of Mth frame yet to be displayed (Current Data) with incoming image data of M−1th frame stored in the frame memory 115 (Previous Data). Then the operation section 114*d* reads OS parameter corresponding to a result of the comparison (grayscale transition) (i.e. OS parameter determined by the comparison result) from the OS table memory (ROM) 113*a* to obtain emphasis operation data. Subsequently, the subtracter 114*a* obtains difference data between the obtained emphasis operation data and the incoming image data of Mth frame yet to be displayed.

At this point in time, the control CPU 112D has received the temperature detection data from the temperature sensor 120. The control CPU 112D provides the emphasis conversion section 114D with a coefficient switch control signal for performing switching between multiplier coefficients α1 to α4 to select one of them corresponding to the temperature detection data. Here, for example, if the temperature detection data is 15° C. or lower, the multiplier coefficient α1 (>α2) is selected. If the temperature detection data is higher than 15° C. but not higher than 25° C., the multiplier coefficient α2 (>α3) is selected. If the temperature detection data is higher than 25° C. but not higher than 35° C., the multiplier coefficient α3 (>α4) is selected. If the temperature detection data is 35° C. or higher, the multiplier coefficient α4 (=1) is selected.

When any one of the multiplier coefficients α1 to α4 is selected by the coefficient switch control signal supplied from the control CPU 112D in accordance with the temperature detection data, the multiplier 114*b* multiplies the difference data by the selected one of the multiplier coefficients α1 to α4. The adder 114*c* adds data thus obtained by the multiplication to the incoming image data of Mth frame yet to be displayed, and supplies data thus obtained by the addition, as emphasis conversion data, to the liquid crystal controller 116. Thus, in a case where the incoming image data is subjected to the motion adaptive I/P conversion, compensation for optical response properties (including temperature dependence property) of the liquid crystal display panel 117 is performed even when there occurs change in temperature of the liquid crystal display panel 117. This allows for high-definition image display free from afterimage and trailing.

On the other hand, when the I/P conversion section 111 is under instruction from the control CPU 112D to perform conversion by intra-field interpolation only, the I/P conversion section 111 performs conversion by intra-field interpolation only to generate a quasi-progressive signal, and then supplies the thus generated signal to the emphasis conversion section 114D.

At this moment, the control CPU 112D instructs the emphasis conversion section 114D to perform emphasis conversion processing on the incoming image data having been subjected to the I/P conversion by intra-field interpolation only. In this case, a parameter switch control signal supplied from the control CPU 112D instructs the emphasis conversion section 114D to reference to the OS table memory (ROM) 113*b*. Then, the operation section 114*d* reads from the OS table memory (ROM) 113 an OS parameter corresponding to a result of comparison (grayscale transition) between incoming image data of Mth frame yet to be displayed (Current Data) and incoming image data of M−1th frame stored in the frame memory 115 (Previous Data) (i.e. OS parameter specified by the comparison result), so as to obtain emphasis operation data. Subsequently, the subtracter 114*a* obtains difference data between the obtained emphasis operation data and the incoming image data of Mth frame yet to be displayed.

At this point in time, the control CPU 112D has received the temperature detection data from the temperature sensor 120. The control CPU 112D provides the emphasis conversion section 114D with a coefficient switch control signal for performing switching between multiplier coefficients α1 to α4 to select one of them corresponding to the temperature detection data. Here, for example, if the temperature detection data is 15° C. or lower, the multiplier coefficient α1 (>α2) is selected. If the temperature detection data is higher than 15° C. but not higher than 25° C., the multiplier coefficient α2 (>α3) is selected. If the temperature detection data is higher than 25° C. but not higher than 35° C., the multiplier coefficient α3 (>α4) is selected. If the temperature detection data is 35° C. or higher, the multiplier coefficient α4 (=1) is selected.

When any one of the multiplier coefficients α1 to α4 is selected by the coefficient switch control signal supplied from the control CPU 112D in accordance with the temperature detection data, the multiplier 114*b* multiplies the difference data by the selected one of the multiplier coefficients α1 to α4. The adder 114*c* adds data thus obtained by the multiplication to the incoming image data of Mth frame yet to be displayed, and supplies data thus obtained by the addition, as emphasis conversion data, to the liquid crystal controller 116.

Here, as described previously, in a case where the incoming image data is subjected to the I/P conversion by intra-field interpolation only, OS parameter in the OS table memory (ROM) 113*b* is lower in value than OS parameter in the OS table memory (ROM) 113*a*. Compensation for optical response properties (including temperature dependence property) of the liquid crystal display panel 117 is performed even when there occurs change in temperature of the liquid crystal display panel 117, image degradation resulted from the emphasis of an unwanted false signal caused by the I/P conversion by intra-field interpolation only is suppressed while suppressing the occurrence of afterimage and trailing. This allows for high-definition image display.

Thus, Fourth Embodiment includes: the OS table memory (ROM) 113*a* which is referenced to when incoming image data is subjected to the motion adaptive I/P conversion; and the OS table memory (ROM) 113*b* which is referenced to when incoming image data is subjected to the conversion by intra-field interpolation only, wherein OS parameter read from either the OS table memory (ROM) 113*a* or the OS table memory (ROM) 113*b* in accordance with an I/P conversion method used by the I/P conversion section 111 is used, and the degree of emphasis conversion performed on the incoming image data is controlled so as to change by using any of the multiplier coefficients α1 to α4 corresponding to the temperature detection data obtained by the temperature sensor 120. It is therefore possible to subject image data to appropriate emphasis conversion processing in accordance with (i) an I/P conversion method used to process the incoming image data and (ii) a device internal temperature. This allows for high-definition image display.

Fifth Embodiment

Figure 7:
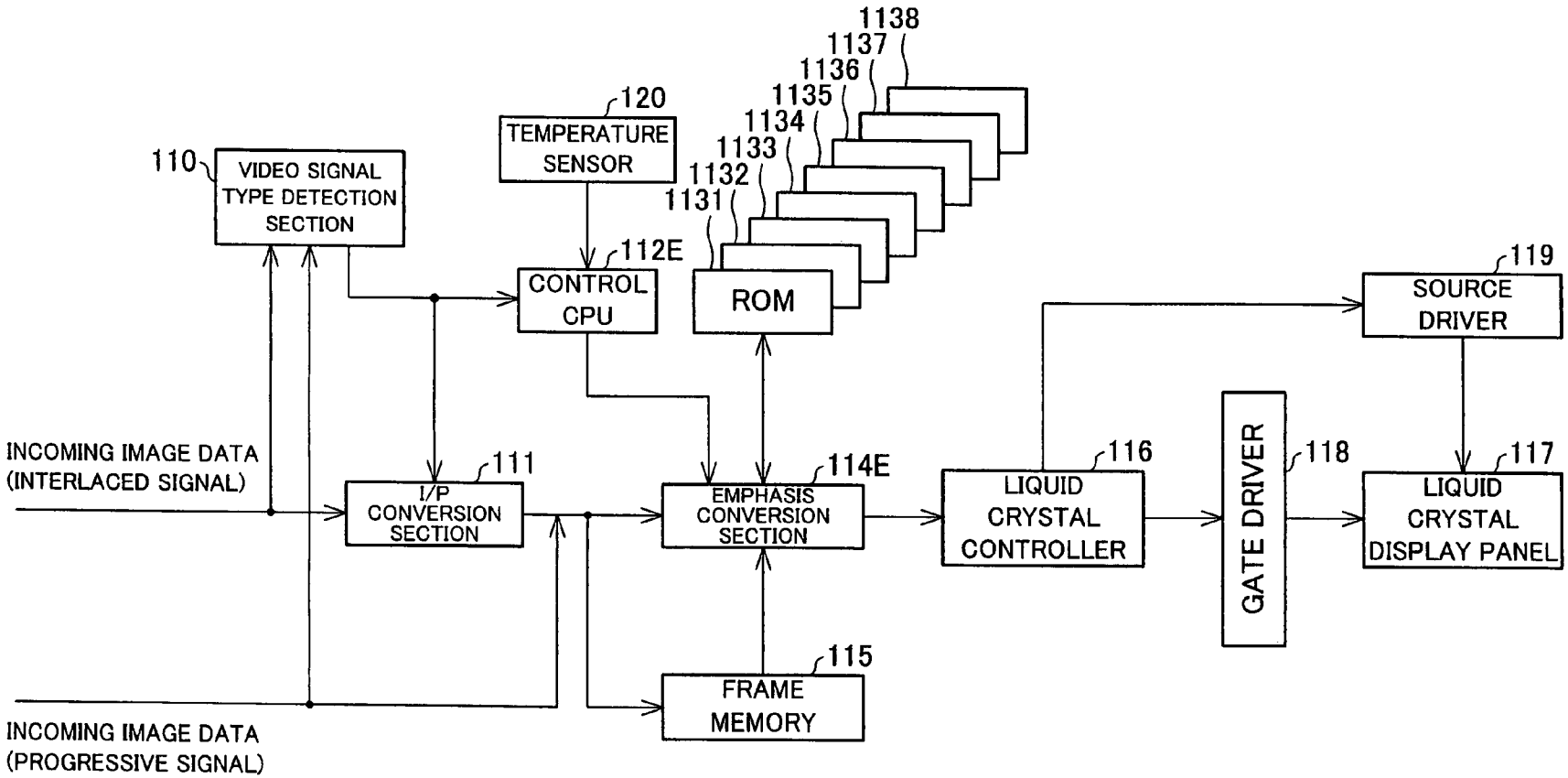
FIG. 7 is a diagram illustrating Fifth Embodiment in which (a) OS table memories (ROMs) and (b) OS table memories (ROMs) are provided separately, wherein the (a) OS table memories (ROMs) store OS parameters respectively corresponding to a plurality of temperature ranges and are referenced to when incoming image data is a progressive signal, and the (b) OS table memories (ROMs) store OS parameters respectively corresponding to a plurality of temperature ranges and are referenced to when incoming image data is an interlaced signal.
Figure 8:
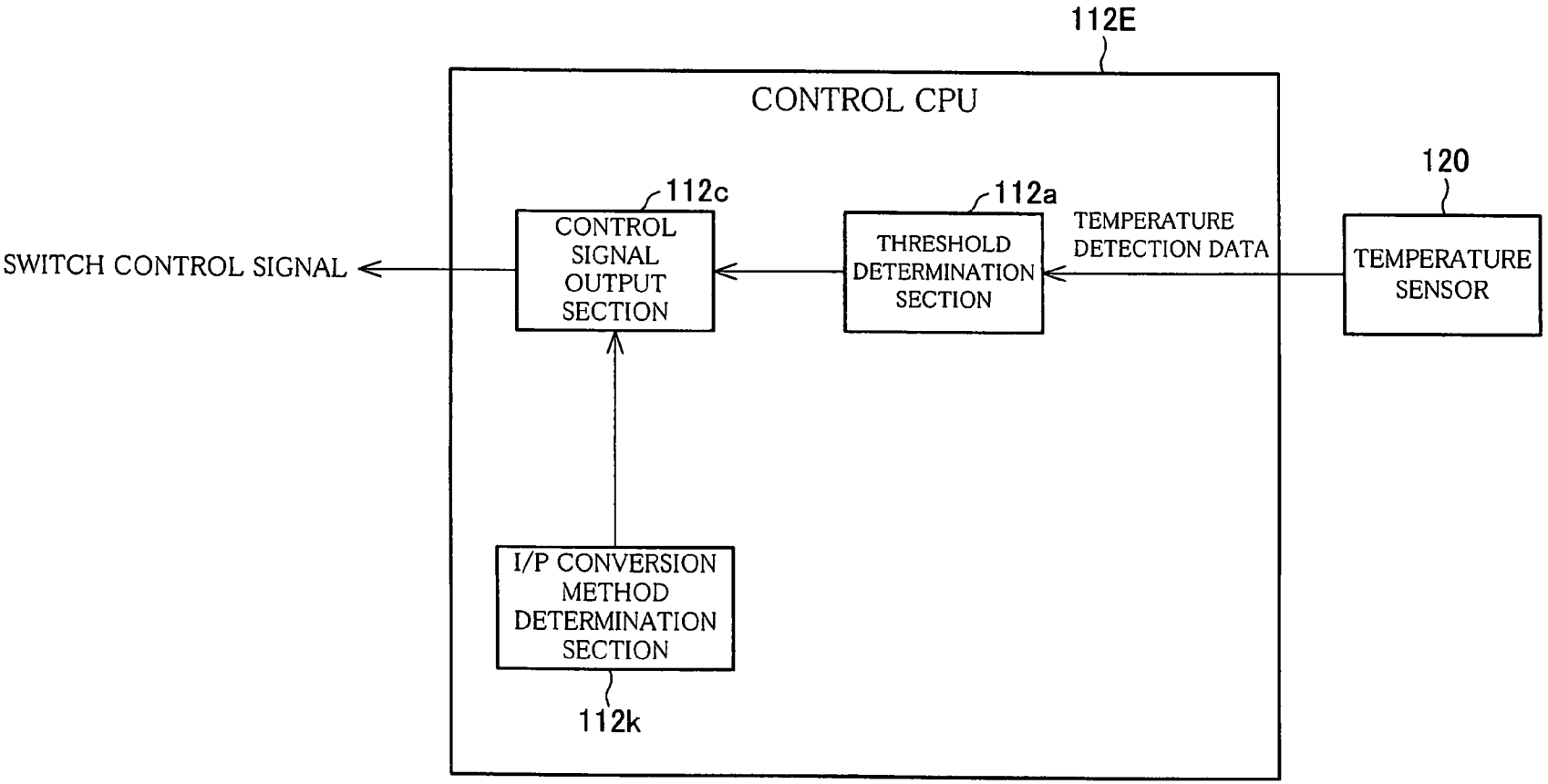
FIG. 8 is a diagram for explaining details of a control CPU illustrated in FIG. 7.
Figure 9:
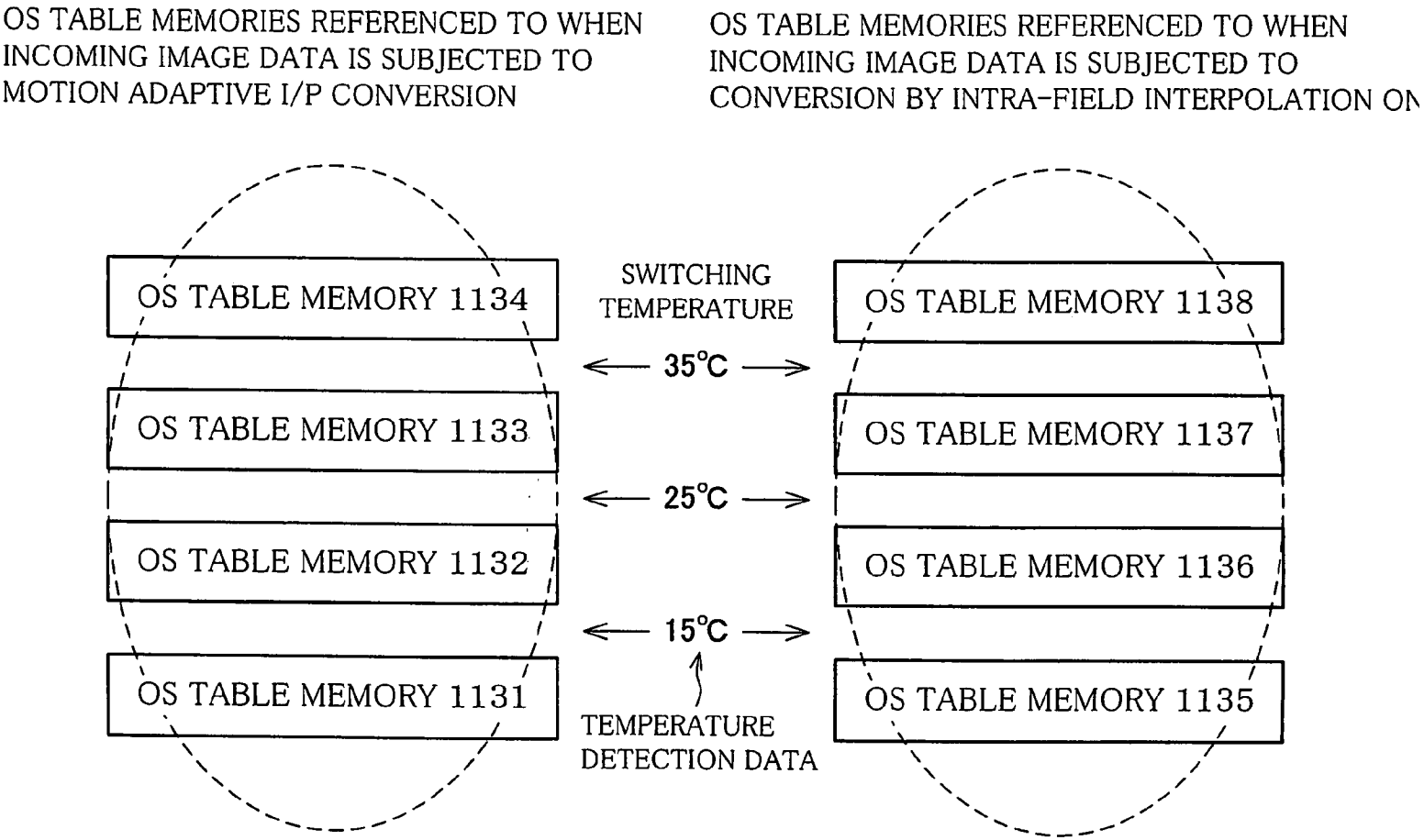
FIG. 9 is an explanatory view of operations of performing switching between the OS table memories (ROMs) illustrated in FIG. 7 to select one of the OS table memories in accordance with a signal type of incoming image data and a device internal temperature.

FIG. 7 is a diagram illustrating Fifth Embodiment in which (a) OS table memories (ROMs) and (b) the OS table memories (ROMs) are provided separately, wherein the (a) OS table memories (ROMs) store OS parameters respectively corresponding to a plurality of temperature ranges and are referenced to when incoming image data is subjected to the motion adaptive I/P conversion, and the (b) OS table memories (ROMs) store OS parameters respectively corresponding to a plurality of temperature ranges and are referenced to when incoming image data is subjected to the conversion by intra-field interpolation only. FIG. 8 is a diagram for explaining details of a control CPU illustrated in FIG. 7. FIG. 9 is an explanatory view of operations of performing switching between the OS table memories (ROMs) illustrated in FIG. 7 to select one of the OS table memories in accordance with an I/P conversion method used to process the incoming image data and a device internal temperature.

As illustrated in FIG. 7, in Fifth Embodiment, OS table memories (ROMs) 1131 through 1134 and OS table memories (ROMs) 1135 through 1138 are provided. The OS table memories (ROMs) 1131 through 1134 are referenced to when incoming image data is subjected to the motion adaptive I/P conversion. The OS table memories (ROMs) 1135 through 1138 are referenced to when incoming image data is subjected to the conversion by intra-field interpolation only. The OS table memories (ROMs) 1131 through 1138 are switched to reference to one of the OS table memories (ROMs) 1131 through 1138 in accordance with (i) an I/P conversion method used to process incoming image data and (ii) a device internal temperature obtained by temperature detection data of the temperature sensor 1-20, so that emphasis conversion processing is performed on image data.

Here, OS parameters in the OS table memories (ROMs) 1135 through 1138, which are referenced to when incoming image data is subjected to the conversion by intra-field interpolation only, are lower in value OS parameters in the OS table memories (ROMs) 1131 through 1134, which are referenced to when incoming image data is subjected to motion adaptive I/P conversion. As described previously, this is because, in order to prevent flicker noise (false signal) or the like caused in edge portions of a displayed image from being noticeably emphasized due to emphasis conversion performed on image data obtained by the I/P conversion by intra-field interpolation only, the degree of emphasis conversion performed on the image data must be lower in a case where incoming image data is subjected to the conversion by intra-field interpolation only than in a case where incoming image data is subjected to motion adaptive I/P conversion.

In the present embodiment, the OS table memories (ROM) 1131 through 1138 provided separately store the respective OS parameters. Alternatively, the present embodiment may be arranged such that the respective OS parameters are stored in different table regions of a single OS table memory (ROM), and the OS parameters are switched for selection to obtain emphasis conversion data, by adaptively switching from one reference table region to another in accordance with a switch control signal supplied from the control CPU 112E.

As described previously, the OS table memories (ROMs) 1131 through 1138 each may have OS parameters (measured values) respectively corresponding to all of 256 levels of gray when display data is of 8 bits, i.e. 256 levels of gray. For example, as illustrated in FIG. 21, each of the OS table memories (ROMs) 1131 through 1138 stores 9-by-9 OS parameters (measured values) concerning nine representative levels of gray in every thirty-two levels of gray. Emphasis conversion data corresponding to other levels than the nine representative levels of gray are obtained by operation such as linear complement from the measured value. Thus, it is possible to reduce a storage space in the OS table memories (ROMs) 1131 through 1138.

It is preferable that the temperature sensor 120 is provided inside the liquid crystal display panel 117 in consideration with its originally intended use, but which is structurally difficult. It is safe that the temperature sensor 120 is placed at the closest possible location to the liquid crystal display panel 117. The number of the temperature sensor 120 is not limited to one, and may be two or more. The temperature sensors 120 may be disposed respectively corresponding to areas of the liquid crystal display panel 117. If a plurality of temperature sensors 120 are provided, a mean value of respective detection results obtained by the temperature sensors 120 may be used as temperature detection data, or a greatly changed detection result obtained by any of the temperature sensors 120 may be used as temperature detection data.

In the present embodiment, the OS table memories (ROMs) 1131 through 1138, as illustrated in FIG. 9, are switched to reference to one of the OS table memories (ROMs) 1131 through 1138 in accordance with the temperature detection data supplied from the temperature sensor 120. In the present embodiment, the OS table memories (ROMs) 1131 through 1138 are provided so as to correspond to four temperature ranges, i.e. (i) 15° C. or lower, (ii) higher than 15° C. but not higher than 25° C., (iii) higher than 25° C. but not higher than 35° C., and (iv) 35° C. or higher. It is needless to say that OS parameters corresponding to three or less temperature ranges or five or more temperature ranges may be prepared.

With reference to FIG. 8, the following will describe the configuration of the control CPU 112E arranged so as to make instruction on switching between the OS table memories (ROMs) 1131 through 1138 for selection in accordance with the temperature detection data supplied from the temperature sensor 120. That is, the control CPU 112E as control means has a threshold determination section 112*a*, a control signal output section 112*c*, and an I/P conversion method determination section 112*k*. Note that the members in the control CPU (112E or later-described CPU 112F through 112G) may be mutually different hardware blocks which are provided in the control CPU or the like. However, in the following embodiments, the members are functional blocks realized by the control CPU or the like executing a program stored in memory (not shown). Among these members, a storage section may be either an internal memory provided in the control CPU or an external memory provided outside the control CPU.

The I/P conversion method determination section 112*k* determines an I/P conversion method to be instructed to the I/P conversion section 111 by the foregoing various methods, and then outputs a signal indicative of the determined I/P conversion method.

In response to the temperature detection data from the temperature sensor 120, the threshold determination section 112*a* compares the temperature detection data with predetermined switching temperatures (threshold temperatures) Th1, Th2, and Th3, for example. Here, the switching temperatures (threshold temperatures) Th1, Th2, and Th3 are, for example, 15° C., 25° C., and 35° C. The threshold determination section 112*a* outputs a result of the determination as to whether a device internal temperature is 15° C. or lower, higher than 15° C. but not higher than 25° C., higher than 25° C. but not higher than 35° C., or 35° C. or higher.

The control signal output section 112*c* outputs a switch control signal in accordance with (i) the I/P conversion method determined by the I/P conversion method determination section 112*k* and (ii) the result of the determination by the threshold determination section 112*a*. That is, in response to the I/P conversion method determined by the I/P conversion method determination section 112*k* and the result of the determination by the threshold determination section 112*a*, the control signal output section 112*c* outputs a switch control signal corresponding to the I/P conversion method and the temperature detection data to make an instruction as to which of the OS table memories (ROMs) 1131 through 1138 is to be referenced to.

In this case, the control signal output section 112*c* uses, as the switch control signal, a combination of (i) identification data which is "0" that is selected when incoming image data is subjected to the motion adaptive I/P conversion or "1" that is selected when incoming image data is subjected to conversion by intra-field interpolation only, for example, and (ii) identification data which is "00" that is selected when the temperature detection data supplied from the temperature sensor 120 is 15° C. or lower, "01" that is selected when the temperature detection data is higher than 15° C. but not higher than 25° C., "10" that is selected when the temperature detection data is higher than 25° C. but not higher than 35° C., or "11" that is selected when the temperature detection data is 35° C. or higher, for example. In this manner, the control signal output section 112*c* can output a 3-bit switch control signal to make an instruction as to which of the eight OS table memories (ROMs) 1131 through 1138 is to be referenced to in performing emphasis conversion on image data.

In such an arrangement, as described previously, when the I/P conversion method determination section 112*k* determines to perform the motion adaptive I/P conversion, for example, the I/P conversion method determination section 112*k* outputs a signal indicative of the motion adaptive I/P conversion to the I/P conversion section 111. In this case, the I/P conversion section 111 performs the motion adaptive I/P conversion to generate a quasi-progressive signal, and then supplies the thus generated signal to the emphasis conversion section 114E.

At this moment, the control CPU 112E instructs the emphasis conversion section 114E as emphasis conversion means to perform emphasis conversion processing on the incoming image data having been subjected to the motion adaptive I/P conversion. In this case, in accordance with a result of the determination as to whether the temperature detection data supplied from the threshold determination section 112*a* is 15° C. or lower, higher than 15° C. but not higher than 25° C., higher than 25° C. but not higher than 35° C., or 35° C. or higher, the control signal output section 112*c* outputs the switch control signal to make instruction as to which of the OS table memories (ROMs) 131 through 134 is to be selected for reference in performing the motion adaptive I/P conversion on the incoming image data.

Assuming the temperature detection data supplied from the temperature sensor 120 is, for example, 15° C. or lower, the control signal output section 112*c* instructs to reference to the OS table memory (ROM) 1131. Assuming the temperature detection data supplied from the temperature sensor 120 is, for example, higher than 15° C. but not higher than 25° C., the control signal output section 112*c* instructs to reference to the OS table memory (ROM) 1132. Assuming the temperature detection data supplied from the temperature sensor 120 is, for example, higher than 25° C. but not higher than 35° C., the control signal output section 112*c* instructs to reference to the OS table memory (ROM) 1133. Assuming the temperature detection data supplied from the temperature sensor 120 is, for example, 35° C. or higher, the control signal output section 112*c* instructs to reference to the OS table memory (ROM) 1134.

Then, the emphasis conversion section 114E having received the instruction reads, from the OS table memory (ROM) which is instructed to select from among the OS table memories (ROMs) 1131 through 1134, OS parameter corresponding to a result of comparison (grayscale transition) between incoming image data of Mth frame yet to be displayed (Current Data) with incoming image data of M−1th frame stored in the frame memory 115 (Previous Data) (i.e. OS parameter determined by the comparison result). Subsequently, the emphasis conversion section 114E obtains emphasis conversion data in accordance with the thus read OS parameter and supplies the obtained emphasis conversion data to the liquid crystal controller 116. Thus, in a case where the incoming image data is subjected to the motion adaptive I/P conversion, compensation for optical response properties (including temperature dependence property) of the liquid crystal display panel 117 is performed even when there occurs change in temperature of the liquid crystal display panel 117. This allows for a high-definition image free from afterimage and trailing.

On the other hand, when the I/P conversion method determination section 112*k* determines to perform the conversion by intra-field interpolation only, the I/P conversion method determination section 112*k* outputs a signal indicative of the conversion by intra-field interpolation only to the I/P conversion section 111. In this case, the I/P conversion section 111 performs the conversion by intra-field interpolation only to generate a quasi-progressive signal, and then supplies the thus generated signal to the emphasis conversion section 114E.

In this case, as described previously, in accordance with a result of the determination as to whether the temperature detection data supplied from the threshold determination section 112*a* is 15° C. or lower, higher than 15° C. but not higher than 25° C., higher than 25° C. but not higher than 35° C., or 35° C. or higher, the control signal output section 112*c* outputs a switch control signal to make instruction as to which of the OS table memories (ROMs) 1135 through 1138 is to be selected for reference in performing the conversion by intra-field interpolation only on the incoming image data.

Assuming the temperature detection data supplied from the temperature sensor 120 is, for example, 15° C. or lower, the control signal output section 112*c* instructs to reference to the OS table memory (ROM) 1135. Assuming the temperature detection data supplied from the temperature sensor 120 is, for example, higher than 15° C. but not higher than 25° C., the control signal output section 112*c* instructs to reference to the OS table memory (ROM) 1136. Assuming the temperature detection data supplied from the temperature sensor 120 is, for example, higher than 25° C. but not higher than 35° C., the control signal output section 112*c* instructs to reference to the OS table memory (ROM) 1137. Assuming the temperature detection data supplied from the temperature sensor 120 is, for example, 35° C. or higher, the control signal output section 112*c* instructs to reference to the OS table memory (ROM) 1138.

Then, the emphasis conversion section 114E having received the instruction reads, from the OS table memory (ROM) which is instructed to select from among the OS table memories (ROMs) 1135 through 1138, OS parameter corresponding to a result of comparison (grayscale transition) between incoming image data of Mth frame yet to be displayed (Current Data) with incoming image data of M−1th frame stored in the frame memory 115 (Previous Data) (i.e. OS parameter determined by the comparison result). Subsequently, the emphasis conversion section 114E obtains emphasis conversion data in accordance with the thus read OS parameter and supplies the obtained emphasis conversion data to the liquid crystal controller 116.

Here, as described previously, in a case where the incoming image data is subjected to the conversion by intra-field interpolation only, OS parameters in the OS table memories (ROMs) 1135 through 1138 are lower in value than corresponding OS parameters in the OS table memories (ROMs) 1131 through 1134. Compensation for optical response properties (including temperature dependence property) of the liquid crystal display panel 117 is performed even when there occurs change in temperature of the liquid crystal display panel 117. This suppresses image degradation resulted from the emphasis of an unwanted false signal caused by the I/P conversion by intra-field interpolation only while preventing the occurrence of afterimage and trailing, thus allowing for high-definition image display.

Thus, Fifth Embodiment includes: the OS table memories (ROMs) 1131 through 1134 which correspond to sets of temperature detection data supplied from the temperature sensor 120 and referenced to when incoming image data is subjected to the motion adaptive I/P conversion; and the OS table memories (ROMs) 1135 through 1138 which correspond to sets of temperature detection data supplied from the temperature sensor 120 and referenced to when incoming image data is an interlaced signal, wherein switching between the OS table memories (ROMs) 1131 through 1138 is performed in accordance with (i) an I/P conversion method used to process the incoming image data and (ii) a device internal temperature obtained by temperature detection data supplied from the temperature sensor 120 so that one of the OS table memories (ROMs) 1131 through 1138 can be referenced to, and thus emphasis conversion processing is performed on image data.

Sixth Embodiment

Figure 10:
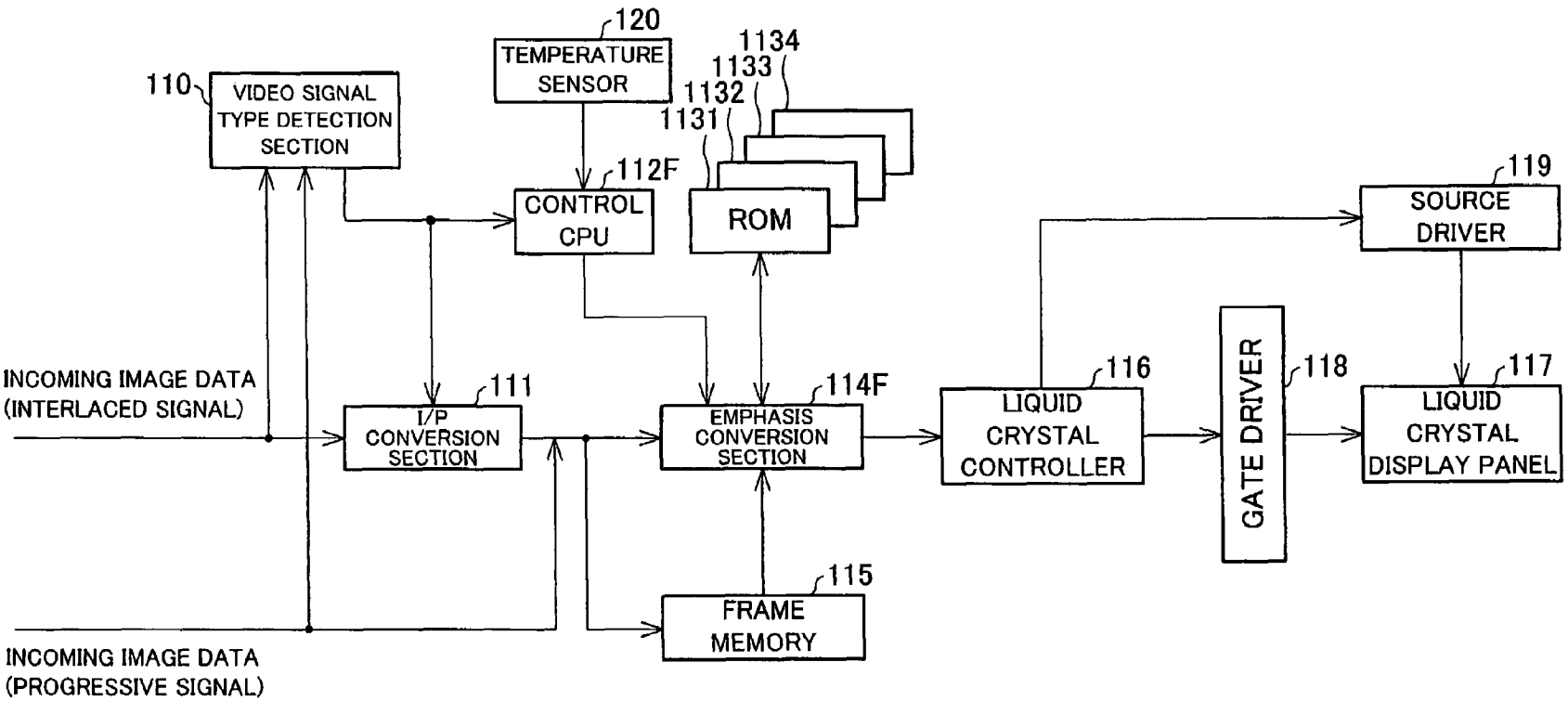
FIG. 10 is a diagram illustrating Sixth Embodiment in which common OS parameters are shared between in a case where incoming image data is a progressive signal and in a case where incoming image data is an interlaced signal.
Figure 11:
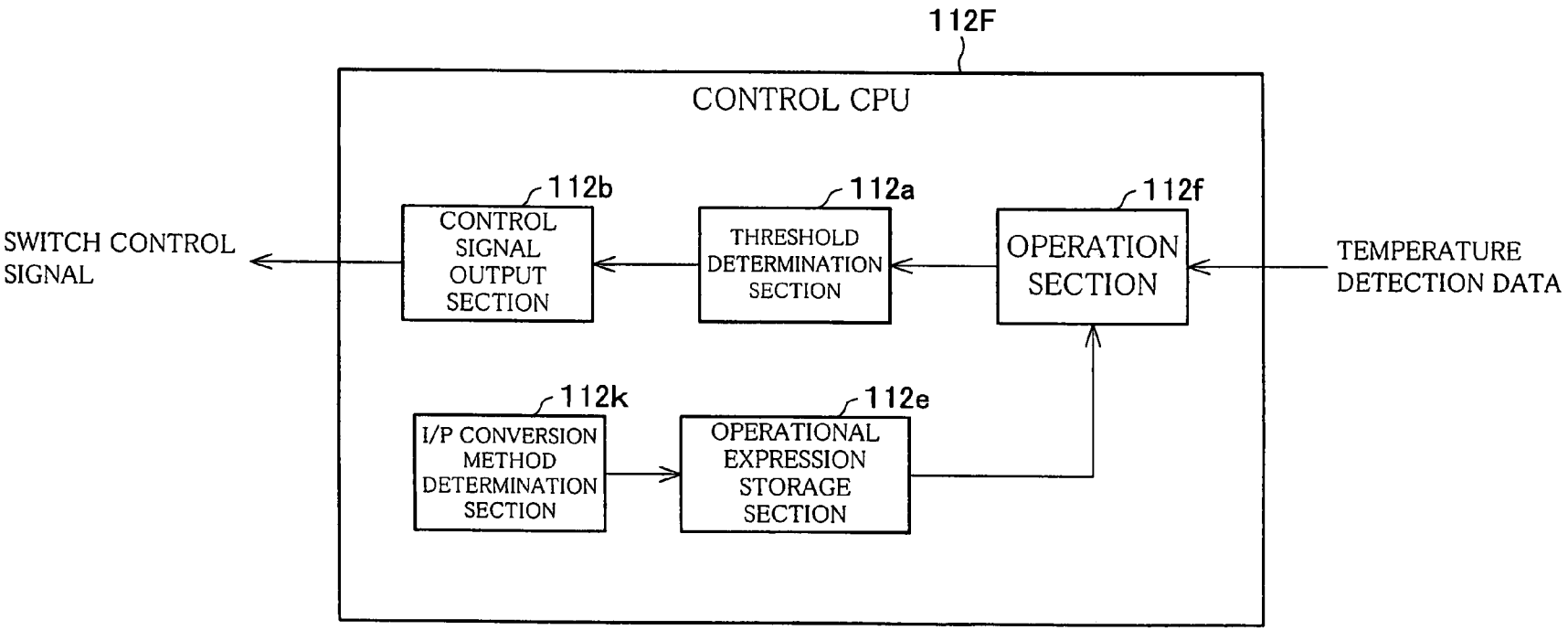
FIG. 11 is a diagram illustrating details of a control CPU illustrated in FIG. 10.
Figure 12:
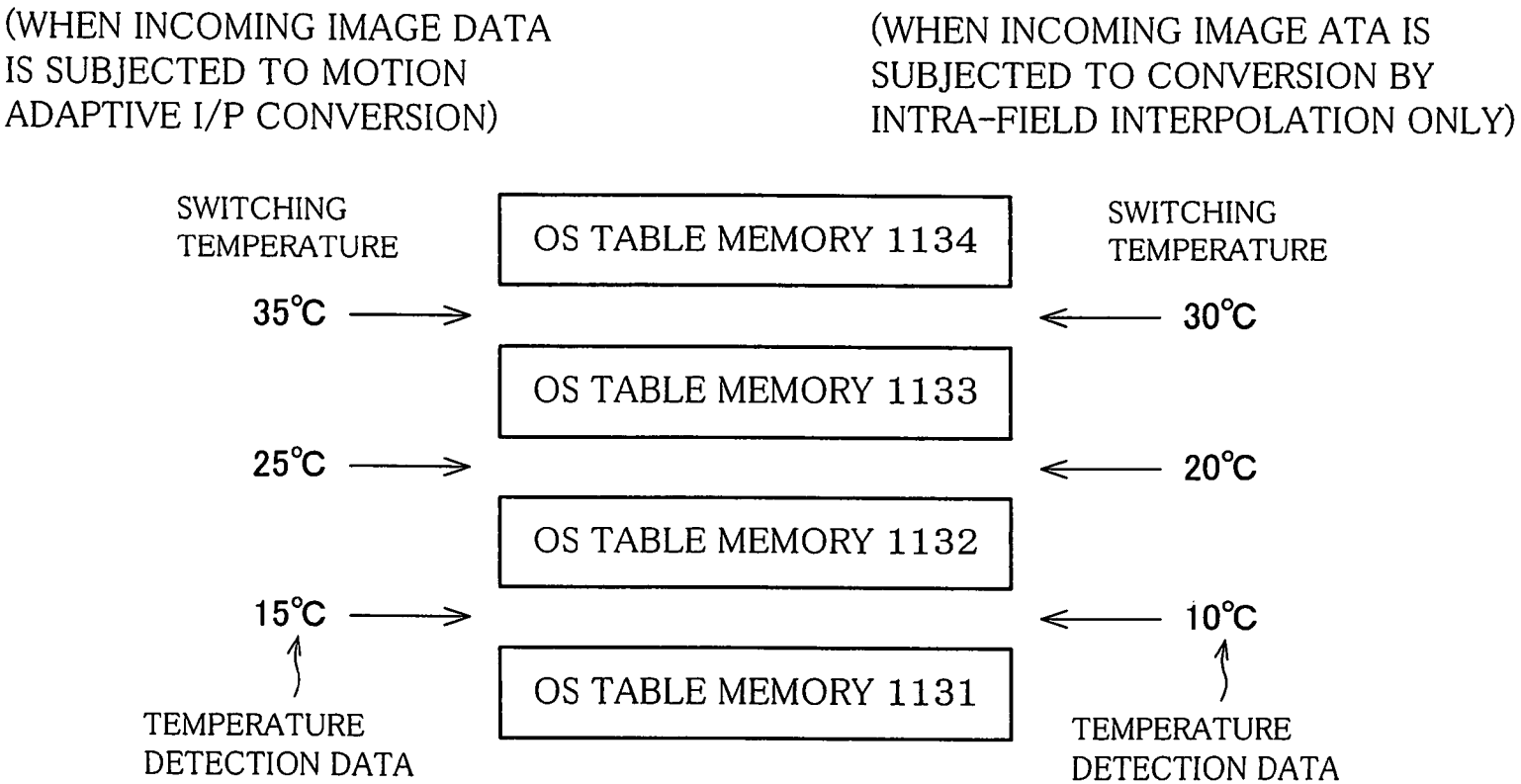
FIG. 12 is an explanatory view of operations of performing switching between the OS table memories (ROMs) illustrated in FIG. 10 to select one of the OS table memories in accordance with a signal type of incoming image data and a device internal temperature.

FIG. 10 is a diagram illustrating Sixth Embodiment in which common OS table memories are shared between in a case where incoming image data is subjected to the motion adaptive I/P conversion and in a case where incoming image data is subjected to the conversion by intra-field interpolation only. FIG. 11 is a diagram illustrating details of a control CPU illustrated in FIG. 10. FIG. 12 is an explanatory view of operations of performing switching between the OS table memories (ROMs) illustrated in FIG. 7 to select one of the OS table memories in accordance with an I/P conversion method used to process the incoming image data and a device internal temperature.

As illustrated in FIG. 10, Sixth Embodiment is such that among the OS table memories (ROMs) 1131 through 1138 illustrated in FIG. 7, for example, four OS table memories (ROMs) 1131 through 1134, which are referenced to when incoming image data is subjected to the motion adaptive I/P conversion, are caused to be also referenced to when incoming image data is subjected to the conversion by intra-field interpolation only, wherein switching between the OS table memories (ROMs) 1131 through 1134 are performed in accordance with (i) an I/P conversion method used by the I/P conversion section 111 and (ii) a device internal temperature obtained by the temperature sensor 120 so that one of the OS table memories (ROMs) 1131 through 1134 can be referenced to, and thus emphasis conversion processing is performed on image data.

Thus, a control CPU 112F which performs control for switching between OS table memories (ROMs) 1131 through 1134 to be referenced to in accordance with (i) the I/P conversion method used to process incoming image data and (ii) a device internal temperature detection data, is arranged as illustrated in FIG. 11. That is, the control CPU 112F has a threshold determination section 112*a*, a control signal output section 112*b*, an operational expression storage section 112*e*, an operation section 112*f*, and an I/P conversion method determination section 112*k*.

The threshold determination section 112*a* compares temperature data having been subjected to operation of the operation section 112*f* with predetermined switching temperatures (threshold temperatures) Th1, Th2, and Th3, for example. Here, the switching temperatures (threshold temperatures) Th1, Th2, and Th3 are, for example, 15° C., 25° C., and 35° C. The control signal output section 112*b* generates a switch control signal for instructing the emphasis conversion section 114F as emphasis conversion means as to which of the OS table memories (ROMs) 1131 through 1134 is to be selected for reference, in accordance with a result of the comparison performed by the threshold determination section 112*a*.

The I/P conversion method determination section 112*k* determines an I/P conversion method to be instructed to the I/P conversion section 111 by the foregoing various methods, and then outputs a signal indicative of the determined I/P conversion method.

The operational expression storage section 112*e* stores operational expressions of operations such as addition/subtraction of predetermined values respectively corresponding to I/P conversion methods used to process incoming image data to/from temperature detection data obtained by the temperature sensor 120. The operation section 112*f* performs correction operation on the temperature detection data obtained by the temperature sensor 120, by using an operational expression read from the operational expression storage section 112*e* in accordance with an I/P conversion method determined by the I/P conversion method determination section 112*k*.

In such an arrangement, as illustrated in FIG. 12, for example, under a situation where incoming image data is subjected to the motion adaptive I/P conversion, assuming that a device internal temperature detected by the temperature sensor 120 is a switching temperature Th1 (=15° C.) or lower, the control CPU 112F instructs the emphasis conversion section 114F to select and reference to the OS table memory (ROM) 1131. Thus, the emphasis conversion section 114F performs emphasis conversion of the incoming image data by using an OS parameter stored in the OS table memory (ROM) 1131.

Further, assuming that a device internal temperature detected by the temperature sensor 120 is higher than the switching temperature Th1 (=15° C.) but not higher than the switching temperature Th2 (=25° C.), the control CPU 112F instructs the emphasis conversion section 114F to select and reference to the OS table memory (ROM) 1132. Thus, the emphasis conversion section 114F performs emphasis conversion of the incoming image data by using an OS parameter stored in the OS table memory (ROM) 1132.

Still further, assuming that a device internal temperature detected by the temperature sensor 120 is higher than the switching temperature Th2 (=25° C.) but not higher than the switching temperature Th3 (=35° C.), the control CPU 112F instructs the emphasis conversion section 114F to select and reference to the OS table memory (ROM) 1133. Thus, the emphasis conversion section 114F performs emphasis conversion of the incoming image data by using an OS parameter stored in the OS table memory (ROM) 1133.

Yet further, assuming that a device internal temperature detected by the temperature sensor 120 is the switching temperature Th3 (=35° C.) or higher, the control CPU 112F instructs the emphasis conversion section 114F to select and reference to the OS table memory (ROM) 1134. Thus, the emphasis conversion section 114F performs emphasis conversion of incoming image data by using an OS parameter stored in the OS table memory (ROM) 1134.

On the other hand, in a case where incoming image data is subjected to the conversion by intra-field interpolation only, as described previously, in order to prevent excessive emphasis of false signals such as flicker noise and jaggies caused in edge portions of an image when an interlaced signal is subjected to I/P conversion by intra-field interpolation only, the degree of emphasis conversion performed on the image data must be lower in a case where incoming image data is subjected to the conversion by intra-field interpolation only than in a case where incoming image data is subjected to motion adaptive I/P conversion. On this account, in order to correct the degree of emphasis conversion, the operation section 112*f* performs a predetermined operation (in this case, for example, addition of 5° C.) on the temperature detection data obtained by the temperature sensor 120, by using an operational expression read from the operational expression storage section 112*e*. Then, the operation section 112*f* outputs a result of the operation to the threshold determination section 112*a*. Note that, in this case 5° C. is not necessarily added. Alternatively, values that are not higher than 4° C. or not lower than 6° C. may be added and may be arbitrarily set according to optical response properties of the liquid crystal display panel 117.

In such an arrangement, under a situation where incoming image data is subjected to the conversion by intra-field interpolation only, assuming that a device internal temperature detected by the temperature sensor 120 is not higher than 10° C., the control CPU 112F instructs the emphasis conversion section 114F to select and reference to the OS table memory (ROM) 1131. Thus, the emphasis conversion section 114F performs emphasis conversion of the incoming image data by using an OS parameter stored in the OS table memory (ROM) 1131.

Further, assuming that the device internal temperature detected by the temperature sensor 120 is higher than 10° C. but not higher than 20° C., the control CPU 112F instructs the emphasis conversion section 114F to select and reference to the OS table memory (ROM) 1132. Thus, the emphasis conversion section 114F performs emphasis conversion of the incoming image data by using an OS parameter stored in the OS table memory (ROM) 1132.

Still further, assuming that the device internal temperature detected by the temperature sensor 120 is higher than 20° C. but not higher than 30° C., the control CPU 112F instructs the emphasis conversion section 114F to select and reference to the OS table memory (ROM) 1133. Thus, the emphasis conversion section 114F performs emphasis conversion of the incoming image data by using an OS parameter stored in the OS table memory (ROM) 1133.

Yet further, assuming that the device internal temperature detected by the temperature sensor 120 is higher than 30° C., the control CPU 112F instructs the emphasis conversion section 114F to select and reference to the OS table memory (ROM) 1134. Thus, the emphasis conversion section 114F performs emphasis conversion of the incoming image data by using an OS parameter stored in the OS table memory (ROM) 1134.

Thus, in Sixth Embodiment, the temperature detection data, obtained by the temperature sensor 120, having been subjected to a predetermined operation, is compared with the predetermined switching temperatures Th1, Th2, and Th3, in order to generate a switch control signal for performing switching between the OS parameters. That is, switching temperatures (device internal temperatures) used to perform switching between the OS table memories (ROMs) 1131 through 1134 to select one of the OS table memories (ROMs) 1131 through 1134 for reference are appropriately changed between the case where incoming image data is subjected to the motion adaptive I/P conversion and the case where incoming image data is subjected to the conversion by intra-field interpolation only. In either case, this arrangement makes it possible to share the common OS table memories (ROMs) 1131 through 1134 for emphasis conversion processing, and makes it possible to reduce a storage space of memory, compared with the arrangement in which the OS table memories (ROMs) are separately provided for each of the I/P conversion methods used to process incoming image data.

Under the same conditions of temperature, in a case where incoming image data is subjected to the conversion by intra-field interpolation only, it is possible to perform emphasis conversion on image data by using OS parameter lower in value than OS parameter used in a case where incoming image data is subjected to the motion adaptive I/P conversion. Thus it is possible to suppress image quality degradation resulting from emphasized false signals such as flicker noise and jaggies caused in edge portions of an image in performing I/P conversion by intra-field interpolation only.

A plurality of OS parameters corresponding to the temperature ranges are stored in the OS table memories (ROMs) 1131 through 1134 provided separately. Needless to say, the present embodiment may be arranged such that respective OS parameters are stored in different table regions of a single OS table memory (ROM), and the OS parameters are selectively switched to obtain emphasis conversion data, by adaptively switching from one reference table region to another in accordance with a switch control signal supplied from the control CPU 112F.

As described previously, the OS table memories (ROMs) 1131 through 1134 each may have OS parameters (measured values) respectively corresponding to all of 256 levels of gray when display data is of 8 bits, i.e. 256 levels of gray. For example, as illustrated in FIG. 21, each of the OS table memories (ROMs) 1131 through 1134 stores 9-by-9 OS parameters (measured values) concerning nine representative levels of gray in every thirty-two levels of gray. Emphasis conversion data corresponding to other levels than the nine representative levels of gray are obtained by operation such as linear complement from the measured value. Thus, it is possible to reduce a storage space in the OS table memories (ROMs) 1131 through 1134.

Seventh Embodiment

Figure 13:
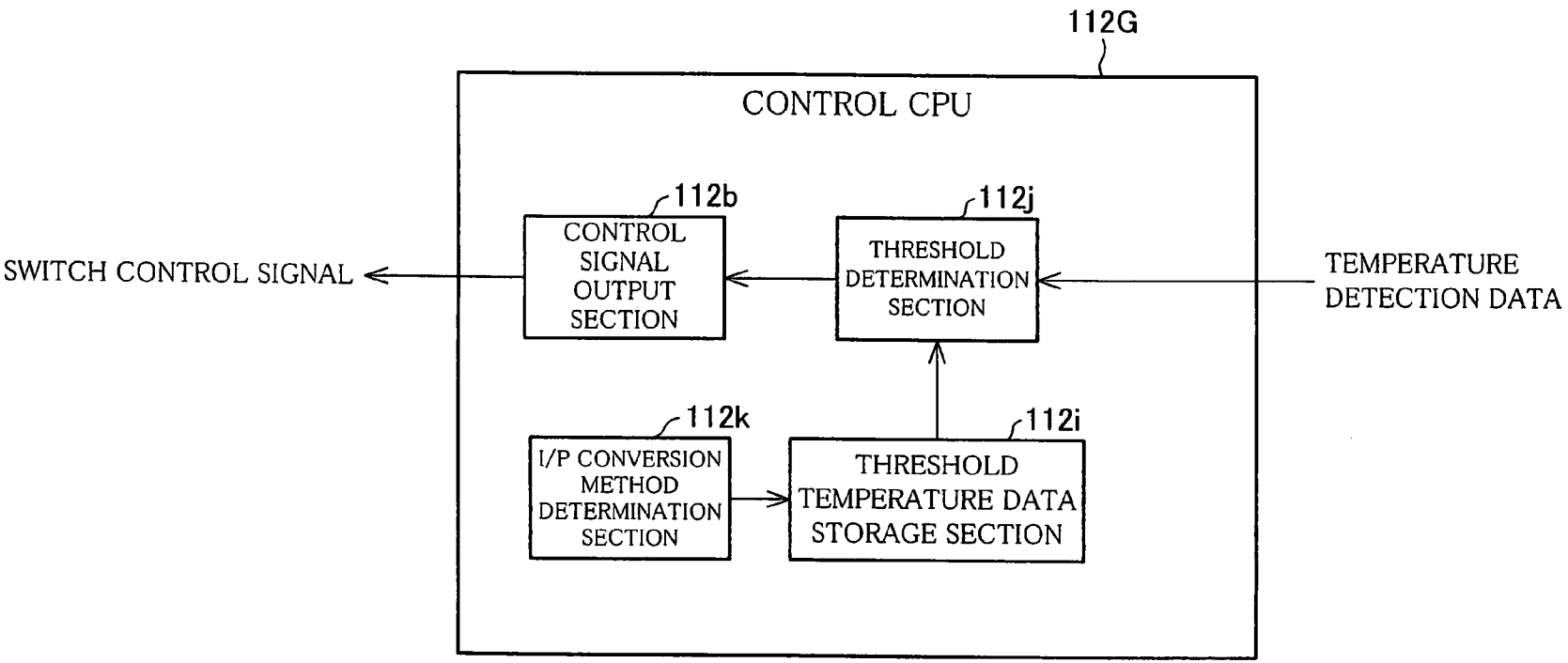
FIG. 13 is a diagram illustrating Seventh Embodiment in which another control CPU having a configuration different from the control CPU in FIG. 10 is provided.

FIG. 13 is a diagram illustrating Seventh Embodiment in which another control CPU having a configuration different from the control CPU in FIG. 10 is provided.

As illustrated in FIG. 13, a control CPU 112G in Seventh Embodiment has: a threshold temperature data storage section 112*i* which stores data of predetermined switching temperatures (threshold temperatures) for each of the I/P conversion methods used to process incoming image data; I/P conversion method determination section 112*k* which determines an I/P conversion method to be instructed to the I/P conversion section 111 in the foregoing various methods and then outputs a signal indicative of the determined I/P conversion method; threshold determination section 112*j* which compares temperature detection data obtained by the temperature sensor 120 with switching temperatures Th1, Th2, and Th3 read from the threshold temperature data storage section 112*i* in accordance with the I/P conversion method determined by the I/P conversion method determination section 112*k*; and a control signal output section 112*b* which generates a switch control signal for causing the emphasis conversion section 114F to select one of the OS table memories (ROMs) 1131 through 1134 for reference in accordance with a result of the comparison performed by the threshold determination section 112*j*.

In such an arrangement, under a situation where incoming image data is subjected to the motion adaptive I/P conversion, assuming that a device internal temperature detected by the temperature sensor 120 is a switching temperature Th1 (=15° C.) or lower, the control CPU 112G instructs the emphasis conversion section 114F to select and reference to the OS table memory (ROM) 1131. Thus, the emphasis conversion section 114F performs emphasis conversion of the incoming image data by using an OS parameter stored in the OS table memory (ROM) 1131.

Further, assuming that a device internal temperature detected by the temperature sensor 120 is higher than the switching temperature Th1 (=15° C.) but not higher than the switching temperature Th2 (=25° C.), the control CPU 112G instructs the emphasis conversion section 114F to select and reference to the OS table memory (ROM) 1132. Thus, the emphasis conversion section 114F performs emphasis conversion of the incoming image data by using an OS parameter stored in the OS table memory (ROM) 1132.

Still further, assuming that a device internal temperature detected by the temperature sensor 120 is higher than the switching temperature Th2 (=25° C.) but not higher than the switching temperature Th3 (=35° C.), the control CPU 112G instructs the emphasis conversion section 114F to select and reference to the OS table memory (ROM) 1133. Thus, the emphasis conversion section 114F performs emphasis conversion of the incoming image data by using an OS parameter stored in the OS table memory (ROM) 1133.

Yet further, assuming that a device internal temperature detected by the temperature sensor 120 is the switching temperature Th3 (=35° C.) or higher, the control CPU 112G instructs the emphasis conversion section 114F to select and reference to the OS table memory (ROM) 1134. Thus, the emphasis conversion section 114F performs emphasis conversion of incoming image data by using an OS parameter stored in the OS table memory (ROM) 1134.

On the other hand, in a case where incoming image data is subjected to the conversion by intra-field interpolation only, as described previously, in order to prevent excessive emphasis of false signals such as flicker noise and jaggies caused in edge portions and other portions of an image when an interlaced signal is subjected to I/P conversion by intra-field interpolation only, the degree of emphasis conversion performed on the image data under the same conditions must be lower than in a case where incoming image data is subjected to motion adaptive I/P conversion. On this account, in order to correct the degree of emphasis conversion, in a case where incoming image data is subjected to the conversion by intra-field interpolation only, the threshold determination section 112*j* performs comparison of temperature detection data obtained by the temperature sensor 120 by using switching temperatures Th'1 (<Th1), Th'2 (<Th2), and Th'3 (<Th3) read from the threshold temperature data storage section 112*j*, and then outputs a result of the comparison to the control signal output section 112*b*.

With such an arrangement, under a situation where incoming image data is an interlaced signal, assuming that a device internal temperature detected by the temperature sensor 120 is Th'1 (=10° C.) or lower, the control CPU 112G instructs the emphasis conversion section 114F to select and reference to the OS table memory (ROM) 1131. Thus, the emphasis conversion section 114F performs emphasis conversion of the incoming image data by using an OS parameter stored in the OS table memory (ROM) 1131.

Further, assuming that a device internal temperature detected by the temperature sensor 120 is higher than the switching temperature Th'1 (=10° C.) but not higher than the switching temperature Th'2 (=20° C.), the control CPU 112G instructs the emphasis conversion section 114F to select and reference to the OS table memory (ROM) 1132. Thus, the emphasis conversion section 114F performs emphasis conversion of the incoming image data by using an OS parameter stored in the OS table memory (ROM) 1132.

Still further, assuming that a device internal temperature detected by the temperature sensor 120 is higher than the switching temperature Th'2 (=20° C.) but not higher than the switching temperature Th'3 (=30° C.), the control CPU 112G instructs the emphasis conversion section 114F to select and reference to the OS table memory (ROM) 1133. Thus, the emphasis conversion section 114F performs emphasis conversion of the incoming image data by using an OS parameter stored in the OS table memory (ROM) 1133.

Yet further, assuming that a device internal temperature detected by the temperature sensor 120 is the switching temperature Th'3 (=30° C.) or higher, the control CPU 112G instructs the emphasis conversion section 114F to select and reference to the OS table memory (ROM) 1134. Thus, the emphasis conversion section 114F performs emphasis conversion of incoming image data by using an OS parameter stored in the OS table memory (ROM) 1134.

Thus, in Seventh Embodiment, comparison of temperature detection data obtained by the temperature sensor 120 by using switching temperatures (threshold temperatures) determined for each of the I/P conversion methods used to process incoming image data is performed, in order to generate a switch control signal for selecting the OS table memory (ROM) 1134 to be referenced to. That is, switching temperatures (device internal temperatures) used to perform switching between the OS table memories (ROMs) 1131 through 1134 to select one of the OS table memories (ROMs) 1131 through 1134 to be referenced to are appropriately changed between the case where incoming image data is subjected to the motion adaptive I/P conversion and the case where incoming image data is subjected to the conversion by intra-field interpolation only. In either case, this arrangement makes it possible to share the common OS table memories (ROMs) 1131 through 1134 for emphasis conversion processing, and makes it possible to reduce a storage space of memory, compared with the arrangement in which the OS table memories (ROMs) are separately provided for each of the I/P conversion methods used to process incoming image data.

Further, under the same conditions of temperature, in a case where incoming image data is subjected to the conversion by intra-field interpolation only, it is possible to perform emphasis conversion on image data by using OS parameter lower in value than OS parameter used in a case where incoming image data is subjected to the motion adaptive I/P conversion. Thus it is possible to suppress image quality degradation resulting from emphasized false signals such as flicker noise and jaggies caused in edge portions of an image in subjecting an interlaced signal to I/P conversion by intra-field interpolation only.

Eighth Embodiment

Figure 14:
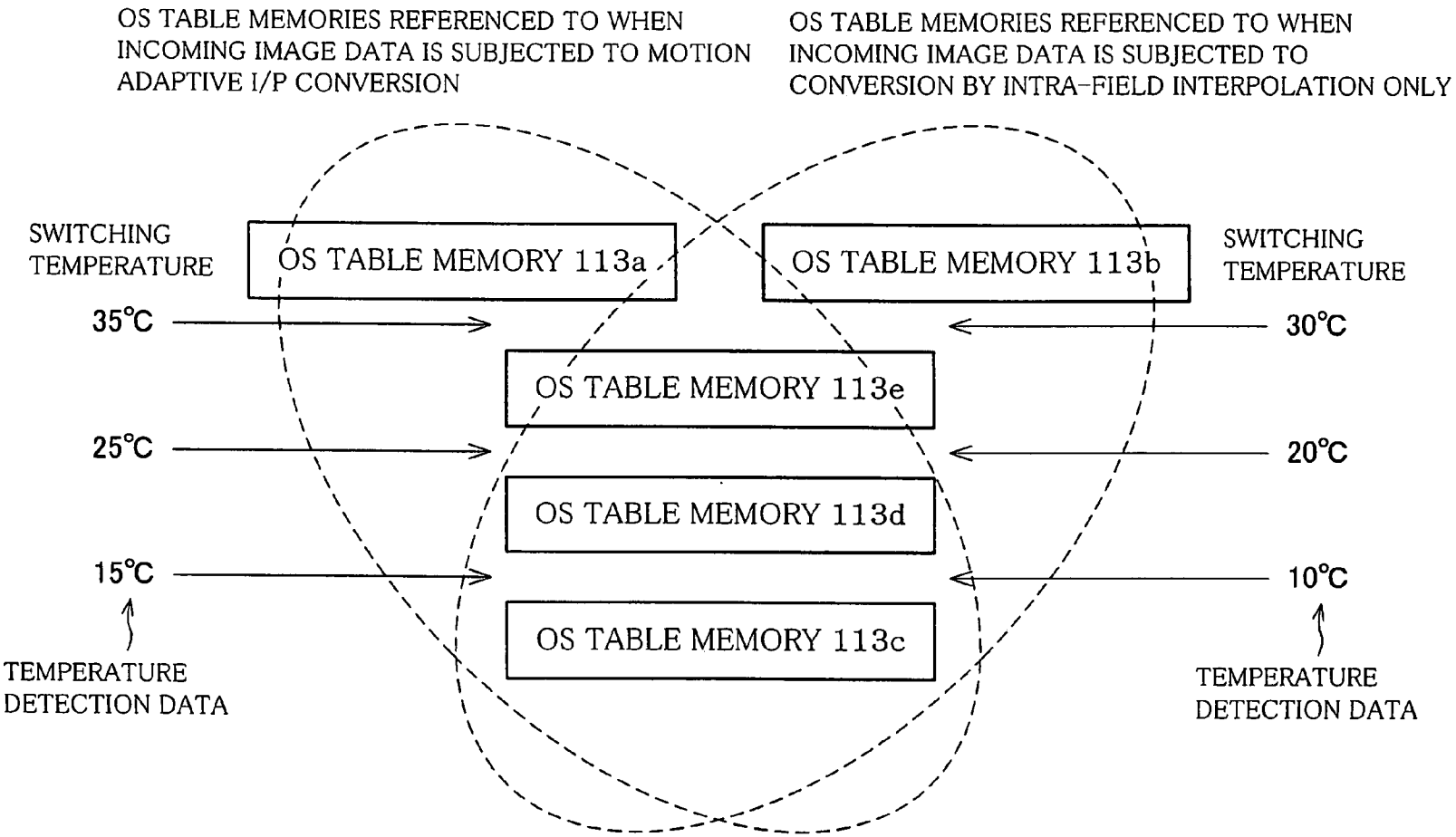
FIG. 14 is a diagram illustrating Eighth Embodiment in which only a part of OS parameters are shared between in a case where incoming image data is a progressive signal and in a case where incoming image data is an interlaced signal.

FIG. 14 is a diagram illustrating Eighth Embodiment in which only a part of OS parameters are shared between in a case where incoming image data is subjected to the motion adaptive I/P conversion and in a case where incoming image data is subjected to the conversion by intra-field interpolation only.

As illustrated in FIG. 14, in Eighth Embodiment, in addition to OS table memories (ROMs) 113*c* through 113*e* which are shared for reference between in a case where incoming image data is subjected to the motion adaptive I/P conversion and in a case where incoming image data is subjected to the conversion by intra-field interpolation only, provided are OS table memory (ROM) 113*a* which is referenced to in a case where incoming image data is subjected to the motion adaptive I/P conversion, and OS table memory (ROM) 113*b* which is referenced to in a case where incoming image data is subjected to the conversion by intra-field interpolation only. These OS table memories (ROMs) 113*a* through 113*e* are switched for reference in accordance with switching temperatures determined for each of the I/P conversion methods, so that emphasis conversion is performed on image data.

Here, the dedicated OS table memories (ROMS) 113*a* and 113*b* store OS parameters used in performing emphasis conversion of image data when a temperature is higher than a normal temperature. Switching between OS table memories (ROMs) 113*a* through 113*e* for reference in accordance with switching temperatures determined for each of the I/P conversion methods, can be performed by the switch control signal supplied from the control CPU 112F (or 112G) illustrated in FIG. 11 (or FIG. 13).

In such an arrangement, under a situation where incoming image data is subjected to the motion adaptive I/P conversion, assuming that a device internal temperature detected by the temperature sensor 120 is 15° C. or lower, the control CPU 112F instructs the emphasis conversion section 114F to select and reference to the OS table memory (ROM) 113*c*. Thus, the emphasis conversion section 114F performs emphasis conversion of the incoming image data by using an OS parameter stored in the OS table memory (ROM) 113*c*.

Further, assuming that a device internal temperature detected by the temperature sensor 120 is higher than 15° C. but not higher than 25° C., the control CPU 112F instructs the emphasis conversion section 114F to select and reference to the OS table memory (ROM) 113*d*. Thus, the emphasis conversion section 114F performs emphasis conversion of the incoming image data by using an OS parameter stored in the OS table memory (ROM) 113*d*.

Still further, assuming that a device internal temperature detected by the temperature sensor 120 is higher than 25° C. but not higher than 35° C., the control CPU 112F instructs the emphasis conversion section 114F to select and reference to the OS table memory (ROM) 113*e*. Thus, the emphasis conversion section 114F performs emphasis conversion of the incoming image data by using an OS parameter stored in the OS table memory (ROM) 113*e*.

Yet further, assuming that a device internal temperature detected by the temperature sensor 120 is 35° C. or higher, the control CPU 112F instructs the emphasis conversion section 114F to select and reference to the OS table memory (ROM) 113*a*. Thus, the emphasis conversion section 114F performs emphasis conversion of incoming image data by using an OS parameter stored in the OS table memory (ROM) 113*a*.

On the other hand, under a situation where incoming image data is subjected to the conversion by intra-field interpolation only, assuming that a device internal temperature detected by the temperature sensor 120 is not higher than 10° C., the control CPU 112F instructs the emphasis conversion section 114F to select and reference to the OS table memory (ROM) 113*c*. Thus, the emphasis conversion section 114F performs emphasis conversion of the incoming image data by using an OS parameter stored in the OS table memory (ROM) 113*c*.

Further, assuming that the device internal temperature detected by the temperature sensor 120 is higher than 10° C. but not higher than 20° C., the control CPU 112F instructs the emphasis conversion section 114F to select and reference to the OS table memory (ROM) 113*d*. Thus, the emphasis conversion section 114F performs emphasis conversion of the incoming image data by using an OS parameter stored in the OS table memory (ROM) 113*d*.

Still further, assuming that the device internal temperature detected by the temperature sensor 120 is higher than 20° C. but not higher than 30° C., the control CPU 112F instructs the emphasis conversion section 114F to select and reference to the OS table memory (ROM) 113*e*. Thus, the emphasis conversion section 114F performs emphasis conversion of the incoming image data by using an OS parameter stored in the OS table memory (ROM) 113*e*.

Yet further, assuming that the device internal temperature detected by the temperature sensor 120 is higher than 30° C., the control CPU 112F instructs the emphasis conversion section 114F to select and reference to the OS table memory (ROM) 113*b*. Thus, the emphasis conversion section 114F performs emphasis conversion of the incoming image data by using an OS parameter stored in the OS table memory (ROM) 113*b*.

Thus, in Eighth Embodiment, in addition to OS table memories (ROMs) 113*c* through 113*e* which are shared for reference between in a case where incoming image data is subjected to the motion adaptive I/P conversion and in a case where incoming image data is subjected to the conversion by intra-field interpolation only, provided are a dedicated OS table memory (ROM) 113*a* which is referenced to in a case where incoming image data is subjected to the motion adaptive I/P conversion, and a dedicated OS table memory (ROM) 113*b* which is referenced to in a case where incoming image data is subjected to the conversion by intra-field interpolation only. These OS table memories (ROMs) 113*a* through 113*e* are switched for reference in accordance with switching temperatures (device internal temperature s) determined for each of the I/P conversion methods. This makes it possible to share the OS table memories (ROMs) 113*c* through 113*e* for appropriate emphasis conversion processing.

A plurality of OS parameters corresponding to the signal types and the temperature ranges are stored in the OS table memories (ROMs) 113*a* through 113*e* provided separately. The present embodiment may be arranged such that respective OS parameters are stored in different table regions of a single OS table memory (ROM), and the OS parameters are selectively switched to obtain emphasis conversion data, by adaptively switching from one reference table region to another in accordance with a switch control signal supplied from the control CPU 112F (or 112G).

As described previously, the OS table memories (ROMs) 113*a* through 113*e* each may have OS parameters (measured values) respectively corresponding to all of 256 levels of gray when display data is of 8 bits, i.e. 256 levels of gray. For example, as illustrated in FIG. 21, each of the OS table memories (ROMs) 113*a* through 113*e* stores 9-by-9 OS parameters (measured values) concerning nine representative levels of gray in every thirty-two levels of gray. Emphasis conversion data corresponding to other levels than the nine representative levels of gray are obtained by operation such as linear complement from the measured value. Thus, it is possible to reduce a storage space in the OS table memories (ROMs) 113*a* through 113*e*.

Ninth Embodiment

The following describes another embodiment of the present invention with reference to FIGS. 15 through 22. More specifically, an image display device (display device) according to the present embodiment is an image display device which can emphasize grayscale transition of video signals to pixels with a suitable degree all the time whichever conversion method is selected from among a plurality of interlace/progressive conversion (progressive scanning conversion) methods with which the image display device can deal, thus realizing both improvement in response speed of pixels and improvement in quality of video image.

Figure 16:
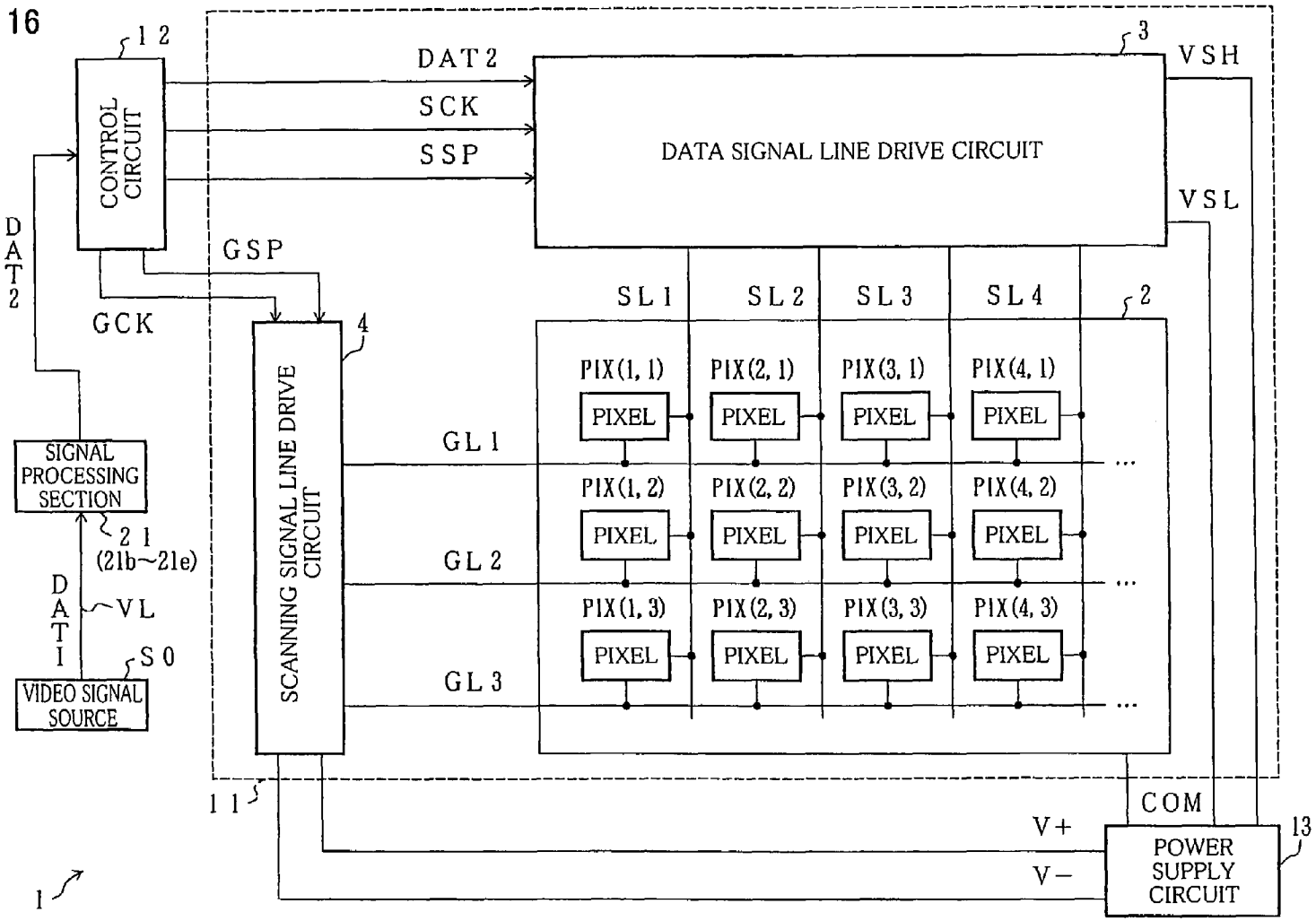
FIG. 16 is a block diagram illustrating essential components of an image display device including the signal processing section.

As illustrated in FIG. 16, a panel 11 of the image display device 1 includes: a pixel array 2 having pixels PIX(1,1) through PIX(n,m) arranged in a matrix manner; a data signal line drive circuit 3 which drives data signal lines SL1 through SLn of the pixel array 2; and a scanning signal line drive circuit 4 which drives scanning signal lines GL1 through GLm of the pixel array 2. Further, the image display device 1 includes: a control circuit 12 which supplies control signals to the drive circuits 3 and 4; and a signal processing section 21 which modifies video signals to be supplied to the control circuit 12 in such a manner so as to emphasize grayscale transition in the pixels PIX(1,1) through PIX(n,m), and converts interlaced signals into progressive signals when the interlaced signals are displayed. Note that these circuits operate on a power supply from a power supply circuit 13.

Before explanation of a detailed configuration of the signal processing section 21, the following will describe a schematic configuration of the whole image display device 1 and operations thereof. For convenience of explanation, numbers or roman alphabets indicative of locations are given for reference only when the locations are required to specify as represented by, for example, i-th data signal line SLi. When the locations are not required to specify and collectively referred to, the characters indicative of locations are omitted.

The pixel array 2 includes a plurality of data signal lines SL1 through SLn (in this case, n-number of data signal lines) and a plurality of scanning signal lines GL1 through GLm (in this case, m-number of scanning signal lines) which intersect with the data signal lines SL1 through SLn. Assuming that arbitrary integers starting from 1 to n are i and arbitrary integers starting from 1 to m are j, a pixel PIX(i,j) is provided for each combination of the data signal line SLi and the scanning signal line GLj. Note that in the present embodiment, the pixel PIX(i,j) is disposed in an area surrounded by two adjacent data signal lines SL(i−1) and SLi and two adjacent scanning signal lines GL(j−1) and GLj.

Figure 17:
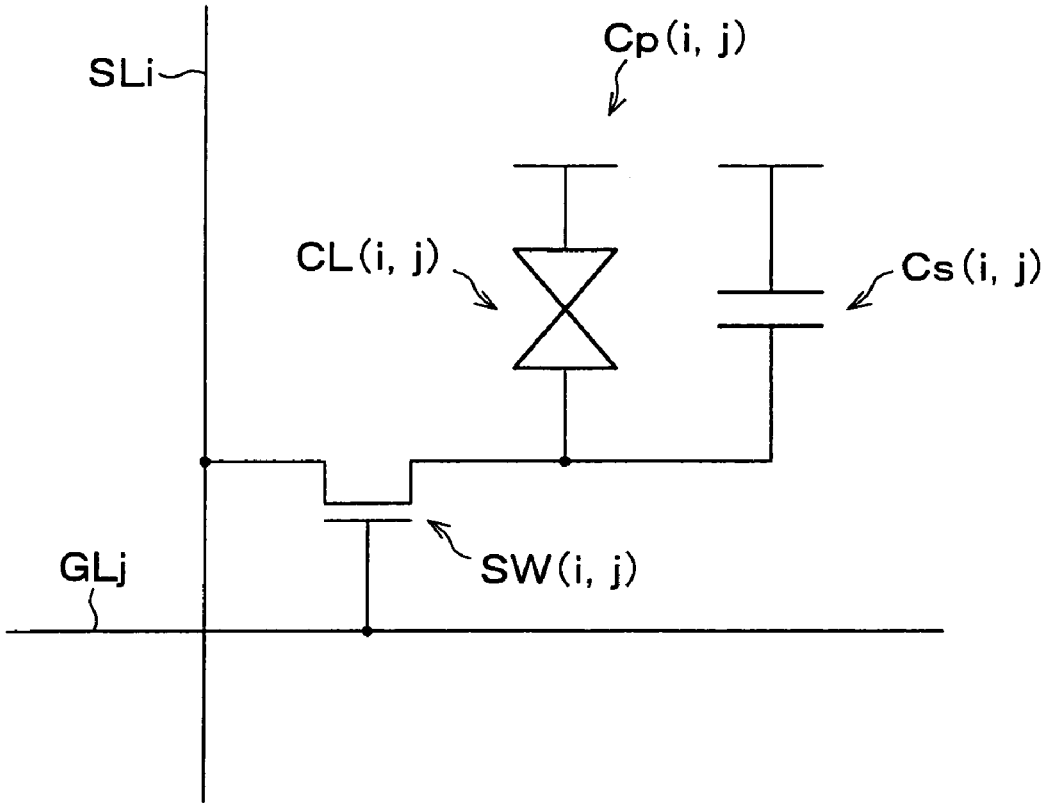
FIG. 17 is a circuit diagram illustrating a structural example of a pixel provided in the image display device.

As an example, the following will describe a case where the image display device 1 is TFT (Thin Film Transistor) liquid crystal display device. For example, as illustrated in FIG. 17, the pixel PIX(i,j) includes: field-effect transistor SW(i,j) as a switching element and a pixel capacity Cp(i,j). Gate and drain of the field-effect transistor SW(i,j) are connected to a scanning signal line GLj and a data signal line SLi, respectively. One electrode of the pixel capacity Cp(i,j) is connected to a source of the field-effect transistor SW(i,j). The other electrode of the pixel capacity Cp(i,j) is connected to a common electrode line in common use among all of the pixels PIX. The pixel capacity Cp(i,j) is made up of a liquid crystal capacity CL(i,j) and a subsidiary capacity Cs(i,j) which is added as required.

In the pixel PIX(i,j), selection of the scanning signal line GLj brings the field-effect transistor SW(i,j) into conduction and thus causes a voltage applied to the data signal lines SLi to be applied to the pixel capacity Cp(i,j). Meanwhile, while the field-effect transistor SW(i,j) is cut off because a select period of the scanning signal line GLj is ended, the pixel capacity Cp(i,j) keeps holding a voltage at the time of cutoff. Here, transmittance or reflectivity of liquid crystal varies depending upon a voltage applied to the liquid crystal capacity CL(i,j). Thus, by selecting the scanning signal line GLj and applying a voltage corresponding to video data for the pixel PIX(i,j) to the data signal line SLi, it is possible to change a display state of the pixel PIX(i,j) in accordance with video data.

The liquid crystal display device according to the present embodiment adopts, as liquid crystal cells, vertical alignment mode liquid crystal cells, i.e. liquid crystal cells in which liquid crystal molecules align substantially vertically to a substrate upon application of no voltage, and the liquid crystal molecules tilt from a vertically aligned state in accordance with a voltage applied to the liquid crystal capacity CL(i,j) of the pixel PIX(i,x). The liquid crystal cells are used in normally black mode (a black display is provided upon application of no voltage).

Further, regardless of whether the pixel PIX is a liquid crystal display element, the scanning signal line drive circuit 4 illustrated in FIG. 16 outputs signals indicative of whether or not it is a select period, such as voltage signals, for example, to the scanning signal lines GL1 through GLm. The scanning signal line drive circuit 4 changes the scanning signal line GLj for output of a signal indicative of select period, for example, in accordance with timing signals supplied from the control circuit 12, such as a clock signal GCK and a start pulse signal GSP. This allows the scanning signal line drive circuit 4 to sequentially select the scanning signal lines GL1 through GLm at predetermined timings.

Further, the data signal line drive circuit 3 extracts, as video signals, video data supplied by time division to the pixels PIX by sampling them at predetermined timings. Moreover, the data signal line drive circuit 3 outputs, through the data signal lines SL1 through SLn, output signals corresponding to respective video data to the pixels PIX(1,j) through (n,j) corresponding to the scanning signal lines GLj selected by the scanning signal line drive circuit 4.

Note that, the data signal line drive circuit 3 determines timings of the sampling and output timings of the output signals in accordance with timing signals supplied from the control circuit 12, such as a clock signal SCK and a start pulse signal SSP.

While the scanning signal lines GLj corresponding to the pixels PIX(1,j) through PIX(n,j) are selected, the pixels PIX (1,j) through PIX(n,j) adjust their luminance and transmittance to be provided during their light emissions so as to determine their brightness, in accordance with output signals supplied to the data signal lines SL1 through SLn corresponding to the PIX(1,j) through PIX(n,j).

Here, the scanning signal line drive circuit 4 sequentially selects the scanning signal lines GL1 through GLm. Therefore, It is therefore possible to adjust brightness of all of the pixels PIX(1,1) through PIX(n,m) in the pixel array 2 to brightness indicated by their corresponding video data, and it is also possible to update an image to be displayed on the pixel array 2.

The image display device 1 according to the present embodiment is arranged, in a case where a video signal source SO outputs an interlaced video signal DATI, so as to provide a display after converting the interlaced video signal DATI into a progressive signal. In this case, the video signal DATI supplied from the video signal source SO to the signal processing section 21 is transmitted in such a manner that one frame is divided into a plurality of fields (e.g. two fields) and the video signal DATI is transmitted in field unit.

More specifically, in transmitting the video signal DATI to the signal processing section 21 of the image display device 1 through a video signal line VL, the video signal source SO can transmit sets of video data for fields by time division in such a manner so as to transmit whole video data for a certain field F(k) and then transmit video data for the subsequent field F(k+1).

The field is made up of a plurality of horizontal lines. For a certain field F(k), for example, the video signal source SO can transmit, through the video signal line VL, sets of video data for horizontal lines by time division in such a manner so as to transmit all the sets of video data DI(1,j,k) through DI(n,j,k) for a certain horizontal line L(j) and then transmit sets of video data DI(1,j+2,k) through DI(n,j+2,k) for the subsequent horizontal line (e.g. L(j+2). Note that in the following descriptions, all the sets of video data DI for a certain horizontal line L(j) of a certain field F(k), for example, are represented by DI(*,j,k) using the sign *.

In the present embodiment, one frame is made up of two fields. For even-numbered fields, transmitted is video data of an even-numbered horizontal line among horizontal lines making up one frame. Further, for odd-numbered fields, transmitted is video data of an odd-numbered horizontal line in each frame.

Moreover, the video signal source SO drives the video signal line VL by time division in transmitting video data DI(*,j,k) of one horizontal line. Thus, sets of video data can be transmitted sequentially in a predetermined order.

Figure 15:
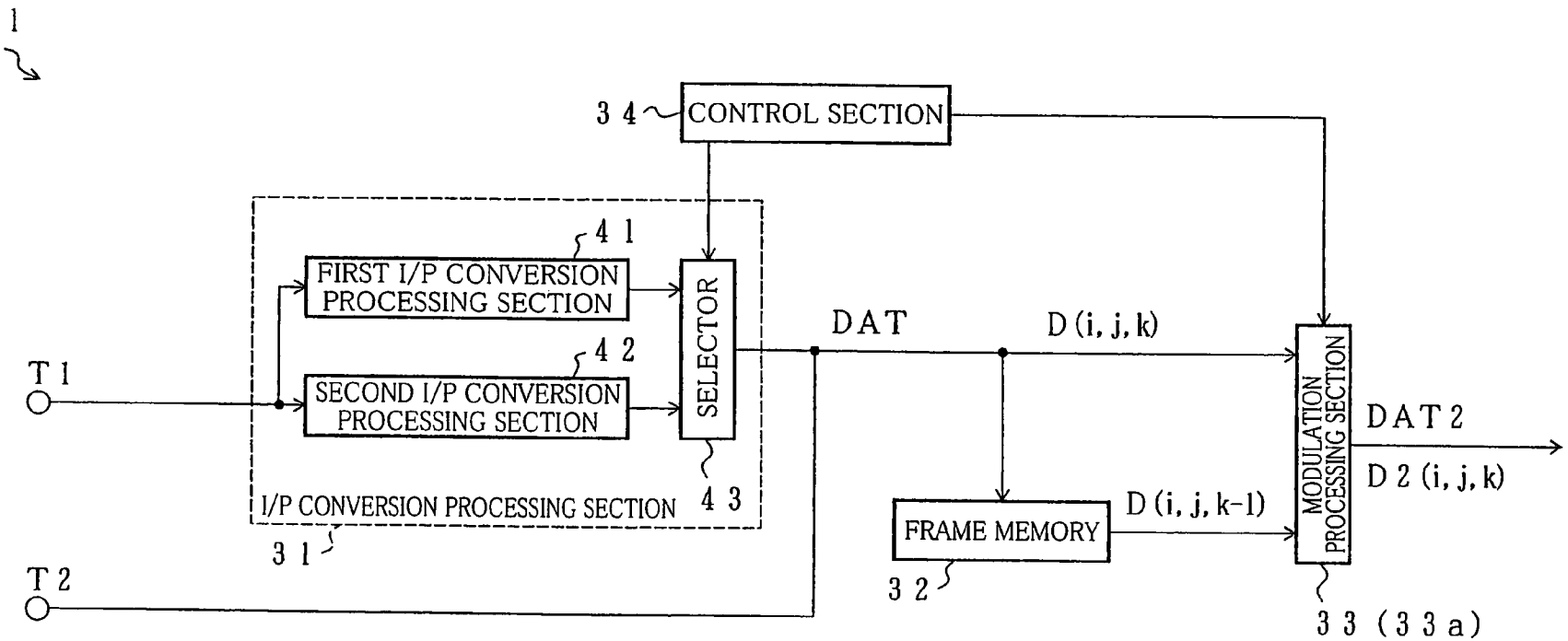
FIG. 15 illustrates still another embodiment of the present invention and is a block diagram illustrating essential components of a signal processing section.

As illustrated in FIG. 15, the signal processing section 21 according to the present embodiment includes: an interlace/progressive conversion processing section (I/P conversion processing section) 31, a frame memory 32, and a modulation processing section 33. The interlace/progressive conversion processing section (I/P conversion processing section) 31 converts an interlaced video signal DATI, which is supplied from input terminal T1, into a progressive video signal DAT. The frame memory 32 holds, for one frame period, video data D(*,*,k) of one frame in a video signal DAT supplied from the I/P conversion processing section 31. The modulation processing section 33 modifies video data D(i,j,k) of current frame FR(k), in accordance with (i) the video data D(i,j,k) of current frame FR(k) and (ii) video data D(i,j,k−1) of previous frame FR(k−1) that is video data to be supplied to the same pixel PIX(i,j) to which the video data D(i,j,k) is supplied and that is read from the frame memory 32 in the video signal DATP, in such a manner so as to emphasize grayscale transition between the video data D(i,j,k) of current frame FR(k) and the video data D(i,j,k−1) of previous frame FR(k−1). Then, the modulation processing section 33 outputs correction video data D2(i,j,k) obtained after the modification. The correction video data D2(i,j,k) for each of the pixels PIX(i,j) is supplied as a correction video signal DAT2 to the control circuit 12 illustrated in FIG. 16. The control circuit 12 and the data signal line drive circuit 3 drives the pixels PIX(i,j) in accordance with the correction video signal DAT2.

In the above arrangement, the modulation processing section 33 modifies the video data D(i,j,k) of current frame FR(k) in such a manner so as to emphasize grayscale transition from the previous frame FR(k−1) to the current frame FR(k).

For example, in a case where grayscale transition from the previous frame FR(k−1) to the current frame FR(k) is rise driving, the modulation processing section 33 modifies the video data D(i,j,k) of current frame FR(k) so as to emphasize grayscale transition from the previous frame FR(k−1) to the current frame FR(k), i.e. so as to present a grayscale level higher than that of the video data D(i,j,k) of the current frame FR(k). The control circuit 12 and the data signal line drive circuit 3 drives the pixels PIX(i,j) in accordance with the correction video data D2(i,j,k) obtained after the modification. For example, in a case where the pixels PIX(i,j) are driven with a voltage signal, the data signal line drive circuit 3, as illustrated in FIG. 18, applies to the pixels PIX(i,j) a voltage V2(i,j,k) that is higher in level than a voltage level V(i,j,k) represented by the video data D(i,j,k) of the current frame FR(k).

Thus, a luminance level T2 of the pixel PIX(i,j), without emphasis of grayscale transition, increases more sharply and reaches near a luminance level corresponding to the video data D(i,j,k) of the current frame FR(k) in a shorter period, as compared with a luminance level T obtained by application of the voltage V(i,j,k) without emphasis of grayscale transition.

On the contrary, in a case where the grayscale transition is decay driving, the modulation processing section 33 modifies the video data D(i,j,k) of current frame FR(k) so as to present a grayscale level lower than that of the video data D(i,j,k) of current frame FR(k). The control circuit 12 and the data signal line drive circuit 3 drives the pixel PIX(i,j) in accordance with the correction video data D2(i,j,k) obtained after the modification. With this, a luminance level of the pixel PIX(i,j) decrease more sharply, and reaches near a luminance level corresponding to the video data D(i,j,k) of current frame FR(k) in a shorter period.

Figure 18:
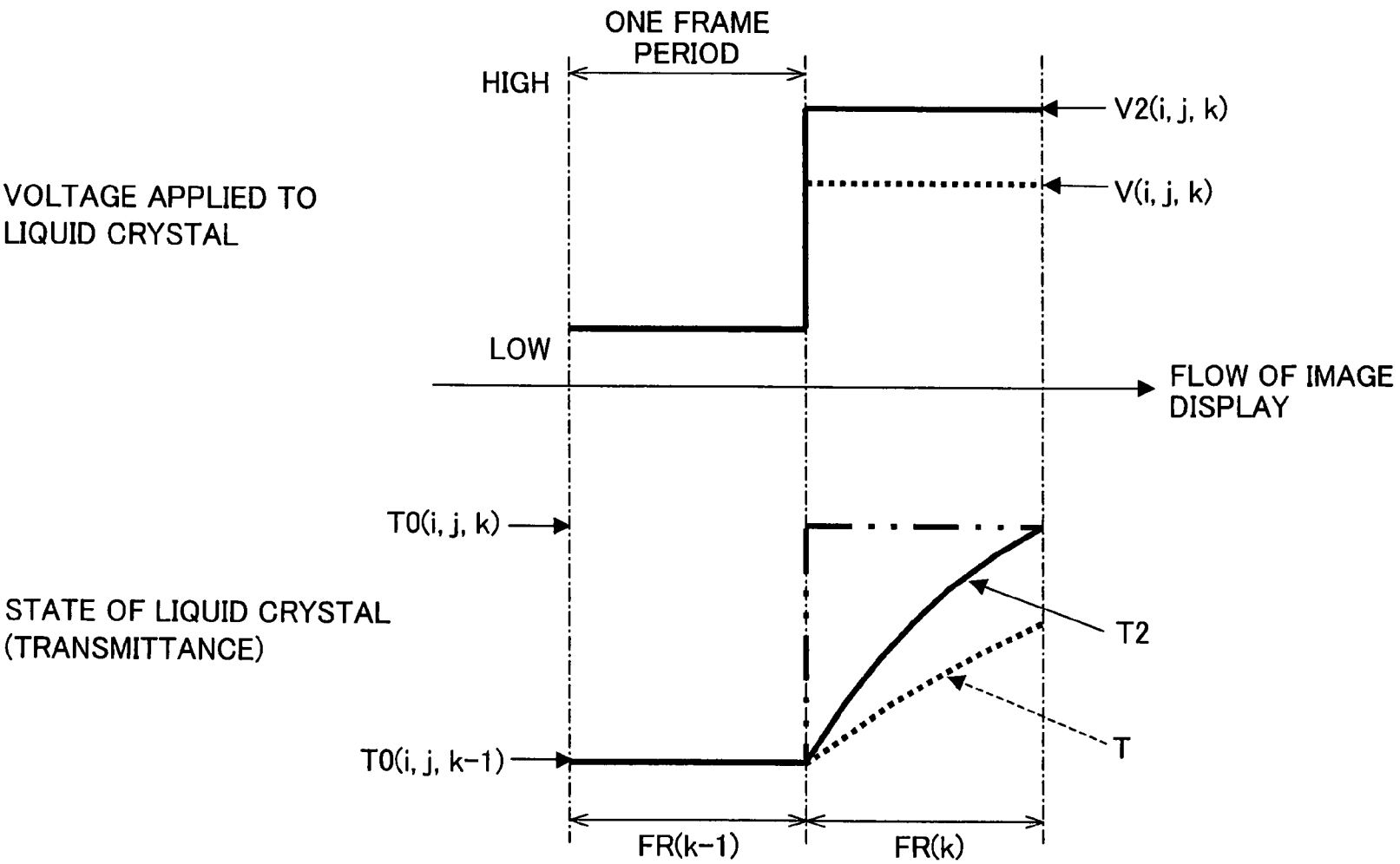
FIG. 18 is a view illustrating a driving method of the image display device.

For example, in an example illustrated in FIG. 18, in a case where grayscale transition is not emphasized, a luminance level of the pixel PIX(i,j) cannot be changed, within one frame period, from a luminance level specified in the previous frame FR(k−1) (a luminance level T0(i,j,k) corresponding to D(i,j,k−1)) to a luminance level specified in the current frame FR(k) (a luminance level T0(i,j,k) corresponding to D(i,j,k)). On the contrary, emphasis of grayscale transition changes the luminance level to a luminance level specified within one frame period.

As a result, this increases a response speed of the image display device 1, as compared with the arrangement in which the pixels PIX(i,j) are driven for grayscale transition in accordance with the video data D(i,j,k) of current frame FR(k). This makes it possible to compensate for optical response properties of the image display device 1 and to display a high-quality video image free from afterimage and trailing on the pixel array 2.

Further, the signal processing section 21 according to the present embodiment is arranged such that the I/P conversion processing section 31 can perform I/P conversion by two ore more conversion methods, and the signal processing section 21 includes a control section 34 which changes the degree of grayscale transition emphasis performed by the modulation processing section 33 according to a conversion method currently selected in the I/P conversion processing section 31.

Therefore, the image display device 1 can select a more appropriate conversion method automatically or by user hand, for example, in accordance with type and S/N ratio of a video signal supplied from the video signal source SO, user's preference, or a demanded image quality. Selection of a more appropriate conversion method by user hand includes user's selection from one of I/P conversion processing sections 41 and 42 described later to the other as a result of user's judgment by visual observation that noise becomes obtrusive in a displayed video image due to video image processing performed on a video signal having a poor S/N ratio. The I/P conversion processing section 41 is an embodiment of the motion adaptive I/P conversion method. The I/P conversion processing section 42 is an embodiment of conversion by intra-field interpolation only.

Further, in the above arrangement, the control section 34 changes the degree of grayscale transition emphasis performed by the modulation processing section 33 according to a conversion method performed by the I/P conversion processing section 31. Thus, the modulation processing section 33 can emphasize grayscale transition with a suitable degree all the time whichever I/P conversion method is performed by the I/P conversion processing section 31. Thus, it is possible to realize both improvement in response speed of pixels and improvement in quality of video image displayed on the pixel array 2.

More specifically, the control section 34 determines an I/P conversion method, for example, according to user's instructions or by a method determined in advance in accordance with a currently supplied interlaced video signal. Then, the control section 34 instructs the I/P conversion processing section 31 about the determined I/P conversion method, and instructs the modulation processing section 33 about the degree of grayscale transition emphasis according to the thus determined I/P conversion method.

The user's instructions accepted by the control section 34 may include setting instructions of the I/P conversion method itself, for example. Alternatively, the control section 34 may accept instructions of settings whose associations with the I/P conversion methods are predetermined, including selection instructions of an input video source and setting instructions of a video display mode, for example, and then performs setting of the I/P conversion method in accordance with the accepted setting instructions.

Further, for example, the control section 34 can store I/P conversion methods corresponding to results of evaluation performed using a predetermined S/N ratio valuation method of an incoming interlaced video signal, or store I/P conversion methods corresponding to and associated with S/N ratios of an incoming interlaced video signal. Thus, any of the I/P conversion methods can be selected according to the magnitude of the S/N ratio of a currently supplied interlaced video signal. Examples of the determination method of I/P conversion method and the evaluation method include the method in which detection of noise amount from a video signal is performed for detection of a S/N ratio in accordance with a known noise detection method, and evaluation is performed by comparison between the detected S/N ratio and a preset threshold value, and I/P conversion method is automatically determined in accordance with a result of the comparison.

Further, any of the I/P conversion methods may be selected according to the magnitude of moving amount included in the currently supplied interlaced video signal. The magnitude of moving amount is evaluated by detecting each of the pixels in one screen as to whether an image is moving or nonmoving. As such a detection method, there are various kinds of methods. Most basically, considering, as the magnitude of motion, a difference in luminance between sets of video data of corresponding pixels in two fields that are chronologically adjacent to each other, the video data are evaluated as moving picture, i.e. the moving amount is evaluated as being large if the difference is higher than a given threshold value.

On the other hand, the I/P conversion processing section 31, in the arrangement illustrated in FIG. 15, for example, includes the first I/P conversion processing section 41 and the second I/P conversion processing section 42, which performs I/P conversion by mutually different conversion methods, and a selector 43 which selects one of the I/P conversion processing sections 41 and 42 in accordance with the instructions from the control section 34 and then provides output. The I/P conversion processing section 31 can perform I/P conversion by a conversion method instructed from the control section 34.

For example, in a situation where a video signal in the NTSC (National Television System Committee) broadcasting scheme is supplied as an interlaced video signal, the I/P conversion processing section 31 generates a progressive video signal DAT of 60 frames per second from a video signal DATI of 60 fields per second (30 frames per second).

The first I/P conversion processing section 41 according to the present embodiment performs I/P conversion by a conversion method called as inter-field interpolation (motion adaptive I/P conversion). The first I/P conversion processing section 41 extracts sets of video data in the fields from the interlaced video signal DATI supplied from the input terminal T1 so as to evaluate the association between the fields. Also, the first I/P conversion processing section 41 can generate a progressive video signal in such a manner so as to compensate for motion between video images in the fields in a case where the degree of the association falls within a predetermined range.

In such a conversion method, the progressive video signal is generated in accordance with sets of video data in a plurality of fields. Thus, realization of proper association evaluation and motion compensation makes it possible to increase a substantial resolution of video signals. In this case, it is possible to display high-definition video images, particularly moving pictures by which smooth motions are reproducible on the pixel array 2, as compared with a case where proper association evaluation and motion compensation are not conducted.

On the other hand, the second I/P conversion processing section 42 performs I/P conversion, for example, by a conversion method called as pseudo-I/P conversion or line doubling. In the conversion method called as pseudo—I/P conversion or line doubling, I/P conversion is performed by (i) extracting sets of video data of the fields from the interlaced video signal DATI supplied from the input terminal T1 so as to output, for example, video data DI(*,j,k) of a certain horizontal line LO) included in a current field as video data DI(*,j+1,k) of the subsequent horizontal line L(j+1) in the frame, (ii) averaging sets of video data (e.g. DI(i,j,k) and DI(i,j+2,k)) of two horizontal lines L(j) and L(j+2) included in the current field so as to generate video data (e.g. DI(i,j+1,k)={DI(i,j,k)−DI(i,j+2,k)}/2+DI(i,j+2,k)) of the intermediate horizontal line L(j+1) between the horizontal lines L(j) and L(j+2) in the frame, or (iii) averaging sets of data in the field while being weighted. The above I/P conversion is called as conversion by intra-field interpolation only (intra-field interpolation for all pixels making up one screen), and enables improvement in vertical resolution of still images.

Here, as described previously, the first I/P conversion processing section 41 performs scanning line interpolation by using the association valuation and motion compensation. Properly conducting the association valuation and the motion compensation allows for high-definition image display. However, improperly conducting the association valuation and the motion compensation might increase a radio-frequency noise and others.

On the contrary, the second I/P conversion processing section 42 generates a progressive video signal DAT. by copying intra-field data, by averaging or by averaging with weight, without performing evaluation of the association between fields and motion compensation. As a result, spatial resolution decreases, and it is therefore possible to display a video image with the foregoing radio-frequency noise reduced. However, unwanted grayscale (luminance) variation (transition) occurs in every one frame in edge portions of a still image, in spite of not occurring in original video signal DATI. This causes flickers which cause degradation in display quality.

Thus, in a situation where the I/P conversion by the first I/P conversion processing section 41 increases radio-frequency noise, the I/P conversion performed by the second I/P conversion processing section 42 allows video image with less radio-frequency noise to be displayed on the pixel array 2, as compared with the I/P conversion performed by the first I/P conversion processing section 41.

Incidentally, the second I/P conversion processing section 42 generates video data D(*,*,k) of one frame in accordance with only video data DI(*,*,k) of the current field. That is why such an arrangement makes it difficult to properly generate a video signal for the pixel PIX which is not included in the field, and is more likely to occur flickers in edge portions of an image, as compared with the arrangement in which the first I/P conversion processing section 41 generates a progressive video signal. Further, for example, as in a case where a still image is displayed, even in a case where there is almost no difference between sets of video data of corresponding pixels PIX in the previous frame and the current frame in the interlaced video signal DATI, unwanted back-and-forth grayscale transition in a grayscale level given to the pixel PIX occurs. Such a grayscale transition is likely to be visually identified as flickers by the user of the image display device 1.

As an example, the following will describe just a mechanism for copying. More specifically, in an example illustrated in FIG. 19, in the background of a certain grayscale level (e.g. 196) displayed is a box with other grayscale level (e.g. 64). In this case, in a region near an edge extending along horizontal lines, like region A near an upper end of the box, as indicated by A0 in FIG. 19, grayscale level (196) of horizontal lines above a certain border horizontal line (e.g. j-th horizontal line) is 196th grayscale level, which is different from a grayscale level (64) of the border horizontal line and horizontal lines below the border horizontal line, considering whole one frame made up of odd-numbered fields and even-numbered fields.

However, the video signal DATI, an interlaced signal, is transmitted with its video data of one frame divided into even-numbered fields and odd-numbered fields. Here, assume that the j-th horizontal line is an odd-numbered horizontal line. For an odd-numbered field F(k), j-2th, j-th, and j+2th horizontal lines are transmitted of the horizontal lines in the A0. The second I/P conversion processing section 42 performs interpolation between the horizontal lines to generate j−1th and j+1th horizontal lines, as indicated by A1 in FIG. 19, in accordance with the video data of these horizontal lines.

Figure 19:
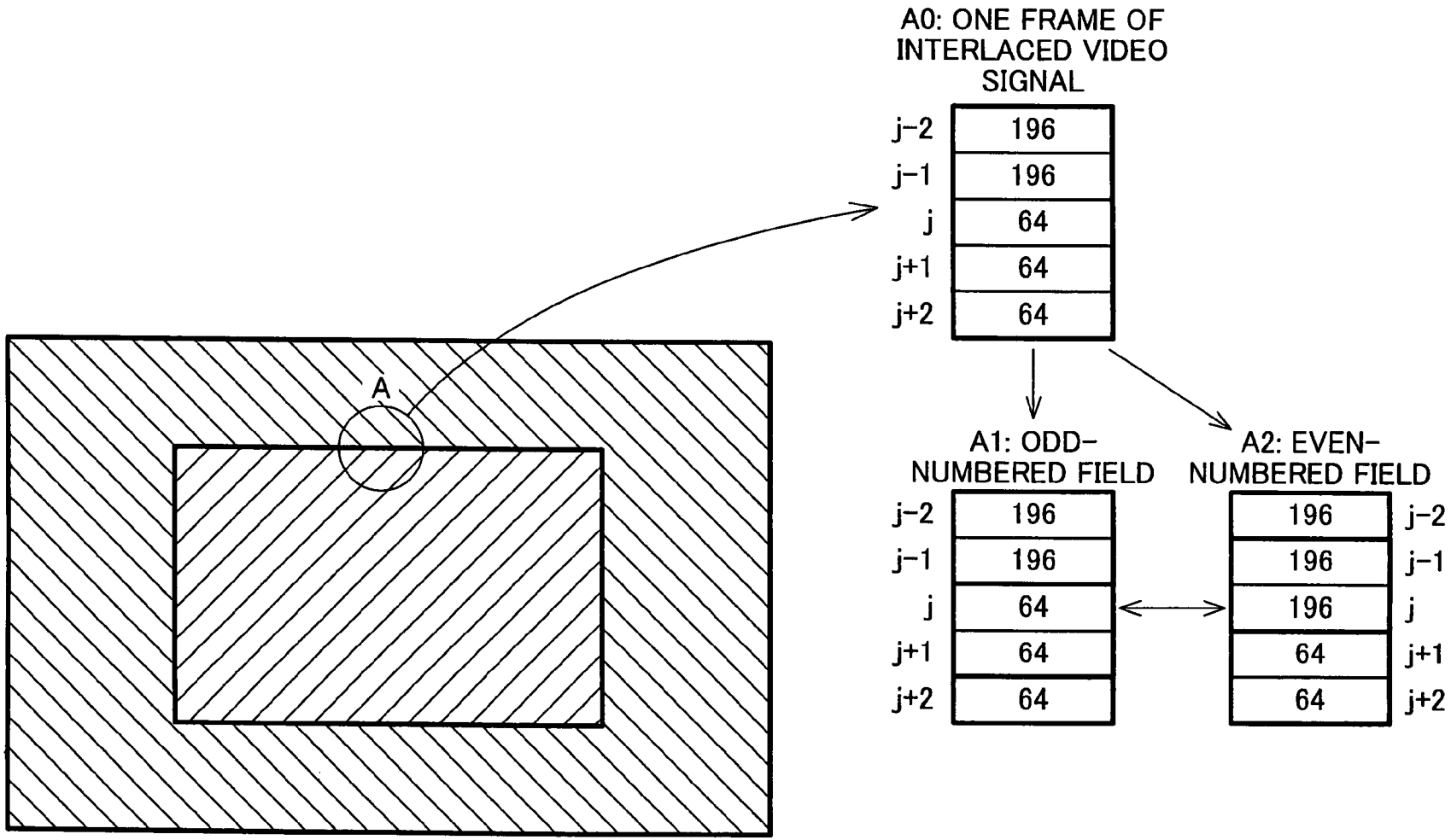
FIG. 19 is a view illustrating a cause of flickers occurring when a progressive video signal is generated by copying a field video signal.

Note that, FIG. 19 illustrates a case where horizontal lines (j−1th horizontal line and other horizontal lines) with the same grayscale level as a reference horizontal line (j−2th horizontal line or other horizontal line) are generated by interpolation. Meanwhile, for an even-numbered field F(k+1), j−1th and j+1th horizontal lines are transmitted of the horizontal lines in the A0. The second I/P conversion processing section 42 performs interpolation between the horizontal lines to generate jth and j+2th horizontal lines, as indicated by A2 in FIG. 19.

As described previously, the j-th horizontal line is a border line and is in a fixed grayscale level (64), when viewed in unit of a frame of the interlaced video signal DATI. However, change of a horizontal line serving as a reference horizontal line for interpolation between fields causes a back-and-forth response between original grayscale level (64) and other grayscale level (196), when viewed in unit of a field. As a result, a grayscale level indicated by video data D(i,j,*) of this horizontal line L(j) for the pixel PIX(i,j) repeats increase (rise) and decrease (decay) in each frame of the progressive video signal DAT.

Note that, the above descriptions has taken as an example the case where data in the field is copied to generate an image of one frame and the box is displayed. This is not the only possibility. In a case where interpolation is performed by using only video data in a field as in the second I/P conversion processing section 42, an edge position, which is supposed to be stationary, varies in every field. This results in the occurrence of flicker noise (false signal) and jaggies of slanted lines (difference in brightness).

Assume that considering flicker at the edge position which should be stationary as grayscale transition of a moving image, the grayscale transition is emphasized. This flicker becomes obtrusive to user's eyes, and therefore causes significant degradation in display quality of the image display device.

Thus, as a result of the I/P conversion performed by the second I/P conversion processing section 42, repetition of increase (rise) and decrease (decay) of grayscale level for each frame is more likely to occur in a progressive video signal DAT, than in the I/P conversion performed by the first I/P conversion processing section 41. In such a state, when the modulation processing section 33 performs grayscale transition emphasis with the same degree as a degree of grayscale transition for the first I/P conversion processing section 41, this tends to cause degradation in display quality resulting from excessive grayscale transition.

On the other hand, in a case where the second I/P conversion processing section 42 generates a progressive video signal DAT, the control section 34 according to the present embodiment controls the modulation processing section 33 so that the degree of grayscale transition emphasis becomes lower than in a case where the first I/P conversion processing section 41 does. That is, in a case where the second I/P conversion processing section 42 generates a progressive video signal DAT, the modulation processing section 33 according to the present embodiment emphasizes grayscale transition with a lower degree than in a case where the first I/P conversion processing section 41 does. Thus, degradation in display quality resulting from excessive emphasis of flickering generated in the edge portions of a still image can be suppressed, and a higher-definition image can be displayed on the pixel array 2.

Especially, in a case where the first I/P conversion processing section 41 performs I/P conversion of a video signal with a sufficiently high S/N ratio by the motion adaptive I/P conversion, emphasis conversion of image data is performed so that liquid crystal pixels can provide transmittance which incoming image data defines within a prescribed period. This allows for high-definition image display free from afterimage and trailing. On the other hand, in a case where the second I/P conversion processing section 42 carries out I/P conversion by intra-field interpolation only, emphasis conversion is performed with a further lower degree. This makes it possible to compensate for optical response properties (including temperature dependence property) of pixels while preventing image quality degradation caused by excessive emphasis, such as unwanted flicker noise and jaggies generated in the edge portions of a displayed image by the I/P conversion processing. Thus, high-definition image display free from afterimage and trailing can be performed.

Figure 20:
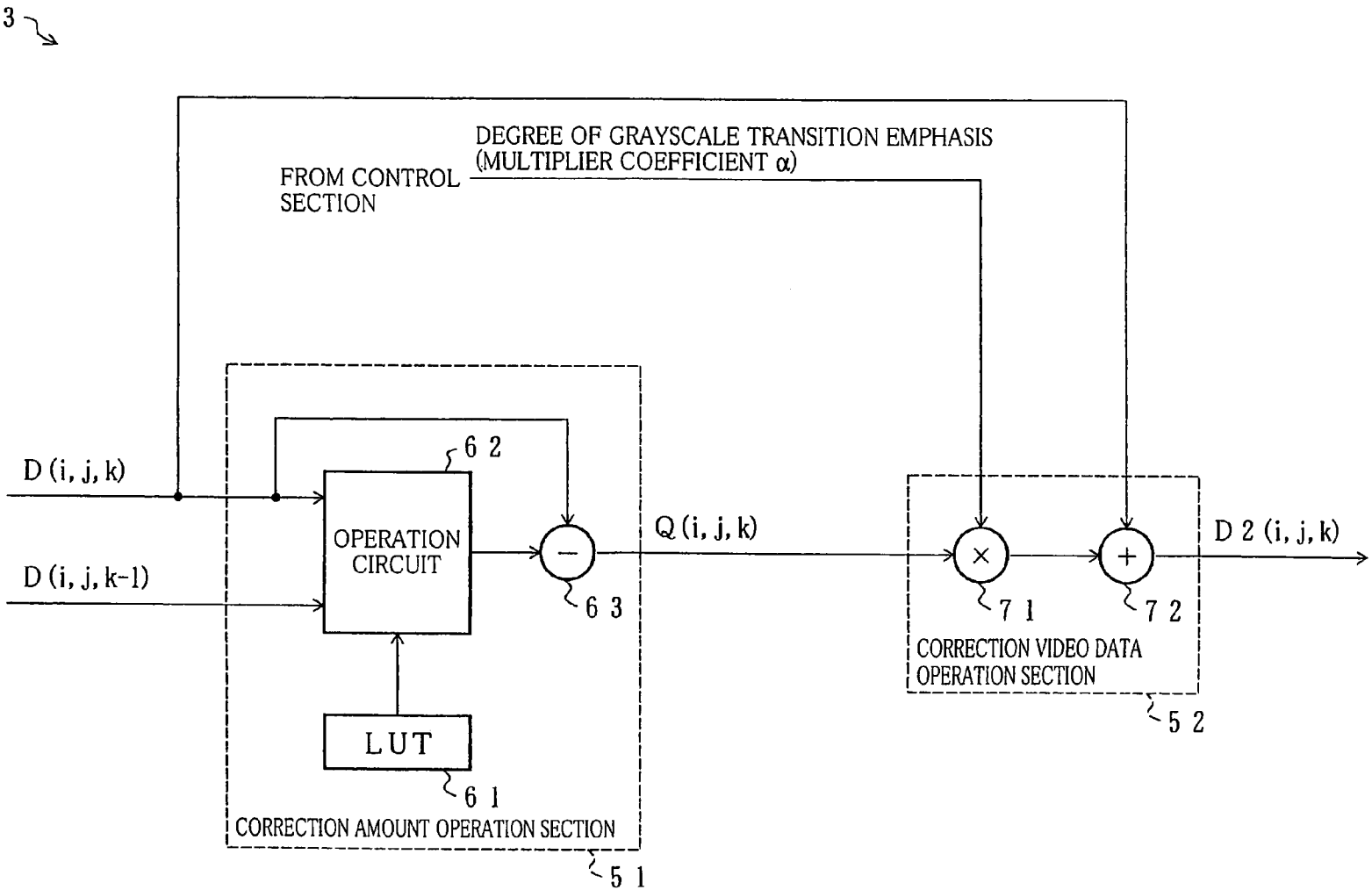
FIG. 20 illustrates a structural example of a modulation processing section provided in the signal processing section and is a block diagram illustrating essential components of the modulation processing section.

The following will describe a structural example of the modulation processing section 33 with reference to FIG. 20. That is, the modulation processing section 33 illustrated in FIG. 20 includes: a correction amount operation section 51 and a correction video data operation section 52. The correction amount operation section 51 determines a suitable correction amount Q(i, j, k) of grayscale transition in a case where the degree of grayscale transition emphasis is a degree predetermined in accordance with video data D(i, j, k) of current frame FR(k) outputted from the I/P conversion processing section 31 and video data D(i, j, k−1) of the previous frame FR(k−1) outputted from the frame memory 32. The correction image data operation section 52 adds correction amount Q2(i, j, k), which is adjusted responsive to the degree of the grayscale transition emphasis given by the control section 34, to the video data D(i, j, k) of the current frame FR(k), and then outputs a result of the addition as correction video data D2(i, j, k).

The correction amount operation section 51 according to the present embodiment includes a look up table (LUT) 61 which stores correction video data D2(i, j, k) which the modulation processing section 33 should output, for example, in a case where the degree of the grayscale transition emphasis set to be suitable when the first I/P conversion processing section 41 outputs a progressive video signal DAT is considered as the predetermined degree of grayscale transition emphasis, where a combination of the video data D(i, j, k) of the previous frame FR(k−1) and the video data D(i, j, k) of the current frame FR(k) is supplied to the modulation processing section 33, and where the first I/P conversion processing section 41 outputs a progressive video signal DAT.

Note that the above-mentioned correction video data D2(i, j, k) is preferably set to a value which causes the pixel array 2 to provide grayscale luminance (transmittance) defined by the video data D(i, j, k) of the current frame FR(k) within a predetermined period. The correction video data D2(i, j, k) is obtained, for example, by actually measuring optical response properties of the image display device 1 (pixel array 2). The predetermined period is, for example, one frame image display period (pixel rewrite cycle). More specifically, in a normal hold-type display, the image display period is one frame period (for example, 16.7 msec in a 60 Hz progressive scan). For example, in the case of a pseudo-impulse type display which displays black in 50% of the one-frame period, the image display period is a ½-frame period (for example, 8.3 msec in a 60 Hz progressive scan).

Here, the above-mentioned LUT 61 may store sets of correction video data D2(i, j, k) corresponding to varying combinations of all the grayscale levels which can be taken by both the video data D(i, j, k) and the video data D(i, j, k−1). However, in the present embodiment, in order to reduce a storage capacity required for the LUT 61, the above-mentioned combinations, which correspond to the sets of correction video data D2, stored in the LUT 61 are restricted to predetermined combinations, rather than varying combinations of all the grayscale levels. The correction amount operation section 51 is provided with an operation circuit 62 which interpolates the correction video data D2(i, j, k) corresponding to each of the combinations stored in the LUT 61, and calculates and outputs the correction video data D2(i, j, k) corresponding to the combination of video data D(i, j, k) and the video data D(i, j, k−1).

For example, assume that a bit width of the video data D is 8 bits and the video data D can be of 256 levels of gray. As illustrated in FIG. 21, the LUT 61 stores 9-by-9 correction video data D2(i,j,k) concerning nine representative levels of gray in every thirty-two levels of gray. Correction video data D2(i,j,k) corresponding to other levels than the nine representative levels of gray can be obtained by the operation circuit 62 performing interpolation operation such as linear complement from the video dataD2(i,j,k) stored in the LUT 61.

Further, the correction amount operation section 51 includes a subtractor 63 which subtracts the video data D(i, j, k) of the current frame FR(k) from the correction video data D2(i, j, k) corresponding to the combination of both the video data D(i, j, k) and the video data D(i, j, k−1) so as to obtain correction amount Q(i, j, k).

In the present embodiment, the control section 34 gives, as the degree of grayscale transition emphasis, multiplier coefficient α which should be multiplied by the correction amount Q(i, j, k). The correction video data operation section 52 includes a multiplier 71 and an adder 72. The multiplier 71 multiplies the correction amount Q(i, j, k) by the multiplier coefficient α to obtain the above-mentioned correction amount Q2(i, j, k). The adder 72 adds a result of the multiplication to the video data D(i, j, k) of the current frame FR(k) to obtain the correction video data D2(i, j, k). Here, as the multiplier coefficient α, used is a value obtained in advance from an actual measured value of optical response properties of the pixel array 2.

As mentioned previously, the LUT 61 stores the correction video data D2(i, j, k) which is suitable when the first I/P conversion processing section 41 outputs a progressive video signal DAT. The control section 34 gives multiplier coefficient α=1 when the first I/P conversion processing section 41 is selected, but gives the multiplier coefficient α which is smaller than 1 when the second I/P conversion processing section 42 is selected.

In the above arrangement, the LUT 61 used for calculation of the correction amount Q is shared between the case where the first I/P conversion processing section 41 is selected and the case where the second I/P conversion processing section 42 is selected. The correction video data operation section 52 adjusts the correction amount Q according to instructions from the control section 34, whereby the degree of grayscale transition emphasis is changed. This arrangement realizes the LUT 61 with a smaller circuit scale than the arrangement in which the LUT 61 is provided separately for each of the above cases.

Generally, in many cases, an expression capable of calculation with a small amount of operations cannot obtain correction video data D2(i, j, k) approximate with high precision from video data D(i, j, k−1) of the previous frame FR(k−1) and video data D(i, j, k) of the current frame FR(k). In the present embodiment, the LUT 61 is referenced to in order to obtain correction video data D2(i, j, k). In this case, it is possible to obtain the correction video data D2 by using a comparatively small-scale circuit. Further, in this case, a suitable correction video data D2 obtained when the first I/P conversion processing section 41 is selected and a suitable correction video image data D2 obtained when the second I/P conversion processing section 42 is selected are often correlated with each other to some extent. Thus, adjustment of the correction amount Q according to instructions from the control section 34 makes it possible to obtain the correction video data D2 with high precision by using a comparatively small-scale circuit.

In the correction amount operation section 51 illustrated in FIG. 20, correction video data D2(i, j, k) set to be suitable in a case when the degree of grayscale transition emphasis is a predetermined degree is stored in the LUT 61. Further, the subtractor 63 subtracts the video data D(i, j, k) of the current frame FR(k) from the correction video data D2(i, j, k) corresponding to a combination of both the video data D(i, j, k) and the video data D(i, j, k−1), so as to obtain the correction amount Q(i, j, k). However, this is not the only possibility. Alternatively, for example, the subtractor 63 may be omitted, and the correction amount Q(i, j, k) corresponding to a combination of both the video data D(i, j, k) and the video data D(i, j, k−1) may be stored in the LUT 61, instead. In either case, the same effect can be obtained as long as the correction amount Q(i, j, k) can be outputted.

In the arrangement illustrated in FIG. 20, the correction amount Q is adjusted by multiplication of a predetermined multiplier coefficient α. However, this is not the only possibility. Alternatively, the correction amount Q may be adjusted by other operations. However, adjustment of the correction amount Q by multiplication realizes adjustment of the correction amount Q with high precision by using a comparatively small-scale circuit.

Furthermore, in order to adjust the correction amount Q by operation other than multiplication, i.e. by operation (e.g. addition) by which a correction amount can be changed by changing the correction video data D2 without using the correction amount Q, for example, the subtractor 63 and adder 72 may be removed, and the correction video data D2 stored in the LUT 61 may be changed. However, since a suitable amount of adjustment is often changed according to the correction amount Q, the arrangement as illustrated in FIG. 20, i.e. an arrangement in which the correction amount Q is found and then adjusted, can realize adjustment of the correction amount Q with high precision by using a comparatively small-scale circuit.

Figure 22:
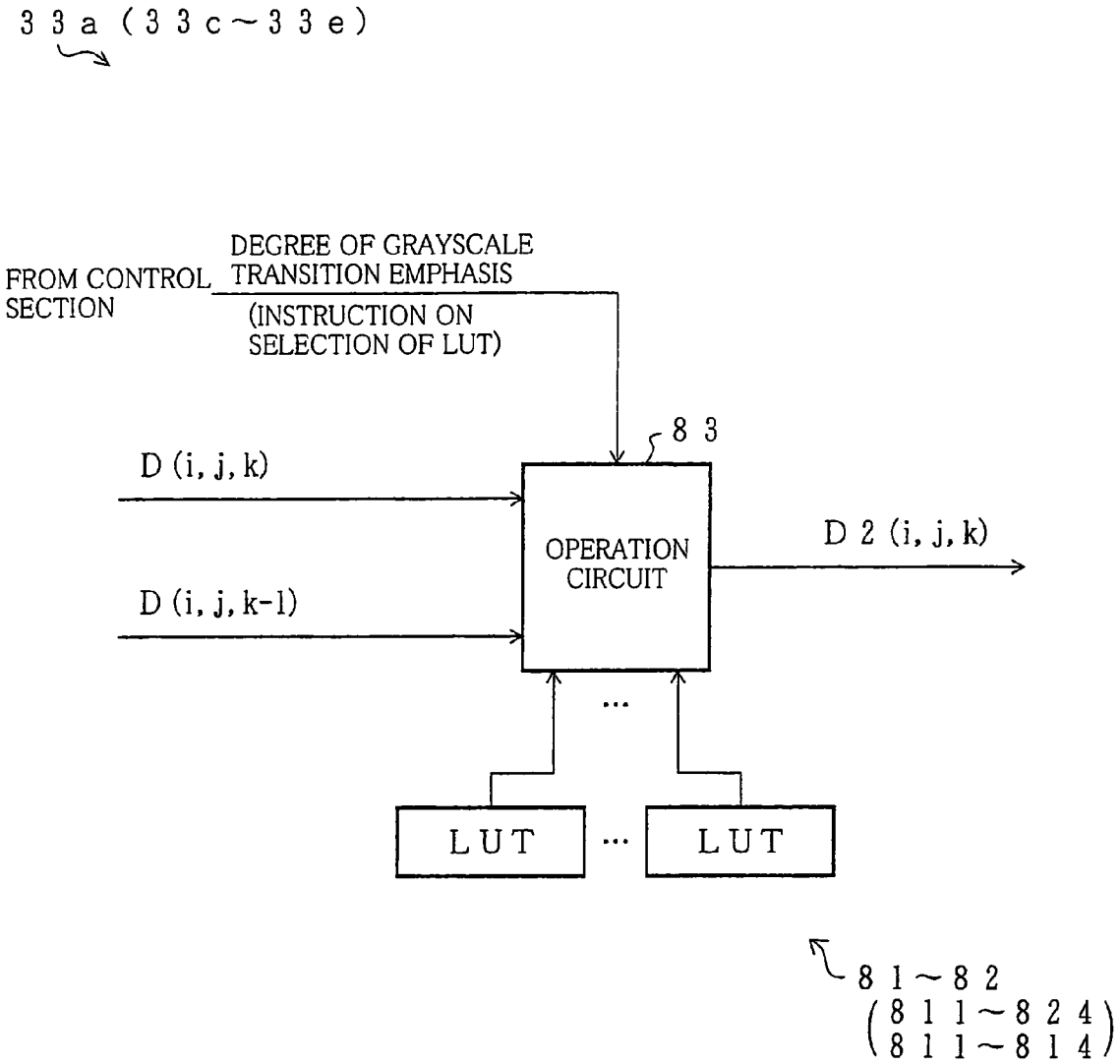
FIG. 22 illustrates another structural example of the modulation processing section and is a block diagram illustrating essential components of the modulation processing section.

On the other hand, as illustrated in FIG. 22, a modulation processing section 33*a* according to another structural example switches LUTs which are referenced to in calculating the correction video data D2(i, j, k), in accordance with which of the first I/P conversion processing section 41 and the second I/P conversion processing section 42 is selected.

More specifically, the modulation processing section 33*a* includes LUTs 81 and 82 and an operation circuit 83. The LUTs 81 and 82 are provided respectively for the first I/P conversion processing section 41 and the second I/P conversion processing section 42, and each of the LUTs 81 and 82 stores correction video data D2(i, j, k) which the modulation processing section 33*a* should output in response to the combination of the video data D(i, j, k) and the video data D(i, j, k−1) supplied to the modulation processing section 33. The operation circuit 83 obtains the correction video data D2(i, j, k) referencing to either of the LUTs 81 and 82 according to instructions from the control section 34 illustrated in FIG. 15.

As is the case of the LUT 61, the above-mentioned combination corresponding to the correction video data D2 which the LUTs 81 and 82 according to the present structural example is limited to a predetermined combination. The operation circuit 83 interpolates the correction video data D2 (i, j, k) corresponding to each combination which is stored in the LUT 81 or the LUT 82, and calculates and outputs the correction video data D2(i, j, k) corresponding to the combination of the video data D(i, j, k) and the video data D(i, j, k−1).

Furthermore, in this arrangement, the control section 34 makes instruction about the degree of grayscale transition emphasis to the modulation processing section 33*a* by making instruction about which of the LUTs 81 and 82 is selected. When the first I/P conversion processing section 41 is selected in the I/P conversion processing section 31, the control section 34 instructs to select the LUT 81. On the other hand, when the second I/P conversion processing section 42 is selected in the I/P conversion processing section 31, the control section 34 instructs to select the LUT 82. Here, correction video data D2 in which grayscale transition is emphasized with a lower degree is stored in the LUT 82 than in the LUT 81. Therefore, the modulation processing section 33*a* can emphasize grayscale transition with a lower degree than in a case where the first I/P conversion processing section 41 is selected.

As is the case of the arrangement illustrated in FIG. 20, this arrangement changes the degree of grayscale transition emphasis according to an I/P conversion method used in the I/P conversion processing section 31. Thus, it is possible to realize both improvement in response speed of pixels and improvement in quality of video image displayed on the pixel array 2.

Unlike the arrangement illustrated in FIG. 20, the LUTs (81 and 82) referenced to by the operation circuit 83 are switched according to an I/P conversion method used in the I/P conversion processing section 31, and there is therefore a weak correlation between sets of correction video data D2 which are suitable for the I/P conversion methods. Thus, it is possible to obtain correction video data D2 with a high precision, although in the arrangement illustrated in FIG. 20, i.e. the arrangement in which correction amount Q suitable for a certain I/P conversion method is adjusted to calculate correction video data D2 suitable for another I/P conversion method, there is a big difference between the thus calculated value and most suitable correction video data D2.

Note that the above description takes as an example the case where an interlaced video signal is supplied to the signal processing section 21. However, the signal processing section 21 according to the present embodiment is arranged so as to be capable of receiving a progressive video signal, and the signal processing section 21, in response to the progressive video signal, supplies the video signal as the foregoing video signal DAT to the frame memory 32 and the modulation processing section 33.

In this case, the control section 34 may give the modulation processing section (33 and 33*a* ) the same degree of grayscale transition emphasis as in the case where the first I/P conversion processing section 41 is selected. However, if there is a demand for much higher-definition image display, it is desirable to give the modulation processing section a different degree of grayscale transition emphasis from the degree of grayscale transition emphasis in a case where the I/P conversion processing section 31 carries out I/P conversion.

More specifically, even a case where the progressive video signal is supplied is treated as in a case where a certain I/P conversion method is selected. For example, the degree of grayscale transition emphasis is changed in an arrangement such that LUTs dedicated for progressive video signal is provided for the modulation processing section so that the control section 34 instructs to select the LUT or designates a multiplier coefficient for progressive video signal.

Here, generally, unwanted grayscale transition resulting from I/P conversion does not occur in a case where a progressive video signal is supplied, as compared with in a case where an interlaced video signal is supplied. Therefore, in a case where an interlaced video signal is supplied, the degree of grayscale transition emphasis is set to be lower than in a case where a progressive video signal is supplied. This allows for improvement in optical response speed, without degradation in quality of video image displayed on the pixel array 2.

With this arrangement, the degree of grayscale transition emphasis can be changed according to whether the I/P conversion is required and according to an I/P conversion method. Even in a case where a progressive video signal is supplied and whichever I/P conversion method is selected, a high-definition image can be always displayed on the pixel array 2.

Tenth Embodiment

The descriptions in First Embodiment have taken, as an example, the arrangement in which the degree of grayscale transition emphasis is changed only by an I/P conversion method used in the I/P conversion processing section 31. However, the present embodiment describes an arrangement in which the degree of grayscale transition emphasis is changed by a combination of an I/P conversion method and other trigger. The following description will take temperature as an example of other trigger.

Figure 23:
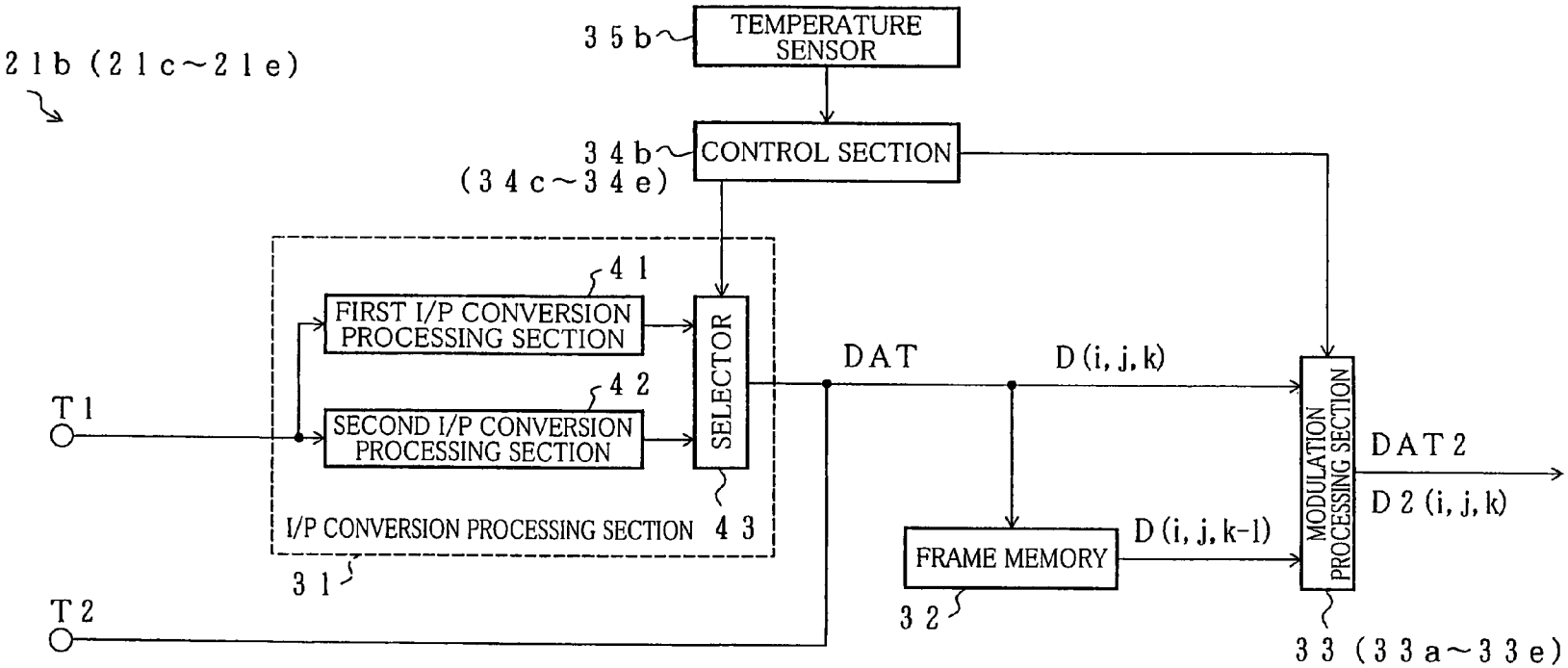
FIG. 23 illustrates another embodiment of the present invention and is a block diagram illustrating essential components of the signal processing section.
Figure 24:
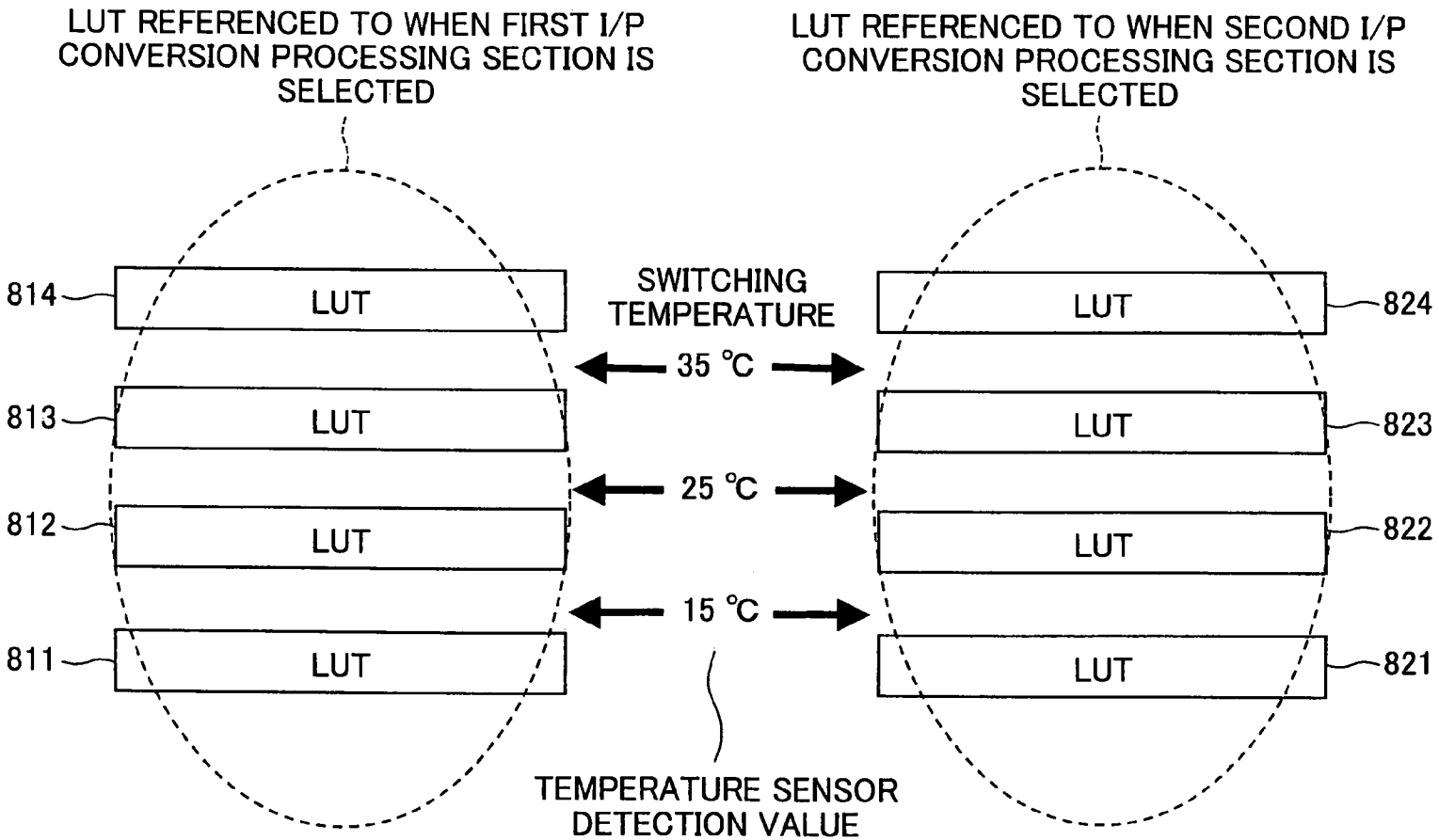
FIG. 24 is a view illustrating a relationship between look up tables provided in the signal processing section.

That is, as illustrated in FIG. 23, a configuration of a signal processing section 21*b* according to the present embodiment is almost the same as that of the signal processing section 21 illustrated in FIG. 15, but is different in that the signal processing section 21*b* additionally includes a temperature sensor 35*b*. A control section 34*b* makes instruction to the modulation processing section 33 about the degree of grayscale transition emphasis, according to a combination of the I/P conversion method used in the I/P conversion processing section 31 and a temperature detected by the temperature sensor 35*b*.

It is preferable that the temperature sensor 35*b* is provided inside the pixel array 2. However, if such an arrangement is structurally difficult to realize, the temperature sensor 35*b* is placed at the closest possible location to the pixel array 2. The number of the temperature sensor 35*b* is not limited to one. A plurality of temperature sensors 35*b* may be disposed respectively corresponding to areas of the pixel array 2. If a plurality of temperature sensors 35*b* are provided, a mean value of respective detection results obtained by the temperature sensors 35*b* may be used as detection data, or a greatly changed detection result obtained by any of the temperature sensors 35*b* may be used as detection data.

In either case, the same effect can be obtain as long as a temperature of the pixel array 2 can be measured.

Here, for example, a liquid crystal element changes its response speed with temperature. In the image display device 1 in which the pixel PIX is realized by the liquid crystal element, a suitable degree of grayscale transition emphasis changes with temperature. Thus, in a situation where a response speed of the pixel PIX changes with temperature, fixing the degree of grayscale transition emphasis irrespective of temperature makes it impossible to emphasize grayscale transition appropriately. Therefore, excessive or insufficient grayscale transition emphasis causes unwanted excessive brightness and black trailing on a video image displayed on the pixel array 2, which may result in degradation in quality of video image.

However, in the above-mentioned arrangement, the degree of grayscale transition emphasis is changed not only with an I/P conversion method but also with a device internal temperature. It is therefore possible to emphasize grayscale transition more appropriately and to display a higher-definition video image on the pixel array 2, than the arrangement in which the degree of grayscale transition emphasis is changed only with an I/P conversion method.

As an example, the following will take a case where the modulation processing section 33 is arranged as illustrated in FIG. 20. The control section 34*b* makes instruction on multiplier coefficient $\alpha$ corresponding to a combination of an I/P conversion method and a temperature detected by the temperature sensor 35*b*, as the degree of grayscale transition emphasis, to the modulation processing section 33.

The control section 34*b* according to the present embodiment, in determining the degree of grayscale transition emphasis, controls temperature ranges by classifying under the following temperatures ranges: temperature range R1 of 15° C. or lower, temperature range R2 of higher than 15° C. but not higher than 25° C., temperature range R3 of higher than 25° C. but not higher than 35° C., and temperature range R4 of 35° C. or higher. Assuming that multiplier coefficients corresponding to the temperature ranges R1 through R4 under a situation the first I/P conversion processing section 41 is selected are all through α14, the control section 34*b* gives a multiplier coefficient corresponding to a current temperature range, among multiplier coefficients which are determined in advance so as to be α11>α12>α13>α14, to the modulation processing section 33. Similarly, assuming that multiplier coefficients corresponding to the temperature ranges R1 through R4 under a situation the second I/P conversion processing section 42 is selected are α21 through α24, the control section 34*b* gives a multiplier coefficient corresponding to a current temperature range, among multiplier coefficients which are determined in advance so as to be α21>α22>α23>α24, to the modulation processing section 33.

As in Ninth Embodiment, when the multiplier coefficients are compared between the corresponding temperature ranges, the multiplier coefficients of the second I/P conversion processing section 42 are set so as to be smaller (α21<α11, α22<α12, α23<α13, α24<α14). α14 is set to 1 when a value (e.g. correction video data D2) for calculating correction amount Q of grayscale transition which is set as being suitable in a case where the first I/P conversion processing section 41 is selected and a temperature is in the temperature range R4 of 35° C. or higher is stored in the LUT 61.

In the above arrangement, the LUT 61 for obtaining correction amount Q is shared between both in a case where the first I/P conversion processing section 41 is selected with the temperature ranges R1 through R4 and in a case where the second I/P conversion processing section 42 is selected in the temperature ranges R1 through R4. Further, the correction video data operation section 52 adjusts the correction amount Q in accordance with the instructions from the control section 34, so that the degree of grayscale transition emphasis is changed. This arrangement therefore realizes a smaller circuit scale than the arrangement in which LUTs are provided respectively for the above cases as illustrated in FIG. 22.

In many cases, the sets of correction video data D2 suitable for combinations of an I/P conversion method and temperature are correlated to some extent. Therefore, by adjusting the correction amount Q in accordance with the instructions from the control section 34*b*, it is possible to obtain the correction video data D2 with relatively high precision. The above description has taken as an example the arrangement in which there are predetermined plurality of temperature ranges (in this case, four temperature ranges) are provided. Alternatively, for example, multiplier coefficient corresponding to a device internal temperature may be found by operation if it is possible to change the degree of grayscale transition emphasis in accordance with a device internal temperature.

On the other hand, in another structural example, i.e. in a case where the modulation processing section is a modulation processing section 33*a* illustrated in FIG. 22, as LUTs, LUTs 811 and LUTs 821 are provided. The LUTs 811 correspond to the respective temperature ranges in a case where the first I/P conversion processing section 41 is selected. The LUTs 821 correspond to the respective temperature ranges in a case where the second I/P conversion processing section 42 is selected. The control section 34*b* makes instruction to the modulation processing section 33*a* about a LUT corresponding to a combination of an I/P conversion method and a temperature detected by the temperature sensor 35*b*, as the degree of grayscale transition emphasis.

For example, as mentioned above, in the arrangement in which temperatures are classified under four temperature ranges R1 through R4, as illustrated in 24, as LUTs referenced to when the first I/P conversion processing section 41 is selected, LUTs 811 through 814 corresponding to the temperature ranges R1 through R4 are provided. In addition, as LUTs referenced to when the second I/P conversion processing section 42 is selected, LUTs 821 through 824 corresponding to the temperature ranges R1 through R4 are provided.

For example, in a case where the first I/P conversion processing section 41 is selected, and moreover, a temperature range is the temperature range R1 of 15° C. or lower, the control section 34*b* instructs to select the LUT 811, as a LUT corresponding to a combination of the selection of the first I/P conversion processing section 41 and the temperature range R1. With this arrangement, the modulation processing section 33*a* can emphasize grayscale transition with reference to the LUT 811, and can emphasize grayscale transition most strongly. On the other hand, in a case where the second I/P conversion processing section 42 is selected, and moreover, a temperature range is the temperature range R4 of 35° C. or higher, the control section 34*b* instructs to select the LUT 824, as a LUT corresponding to a combination of the selection of the second I/P conversion processing section 42 and the temperature range R4. With this arrangement, the modulation processing section 33*a* can emphasize grayscale transition with reference to the LUT 821, and can emphasize grayscale transition most weakly.

Unlike the arrangement illustrated in FIG. 20, in the above arrangement, LUTs (811 through 824) are referenced to by the operation circuit 83 are switched according to an I/P conversion method used in the I/P conversion processing section 31, and there is therefore a weak correlation between sets of correction video data D2 which are suitable for the I/P conversion methods. Thus, it is possible to obtain correction video data D2 with a high precision, although in the arrangement illustrated in FIG. 20, i.e. the arrangement in which correction amount Q suitable for a certain I/P conversion method is adjusted to calculate correction video data D2 suitable for another I/P conversion method, there is a big difference between the thus calculated value and most suitable correction video data D2.

Figure 25:
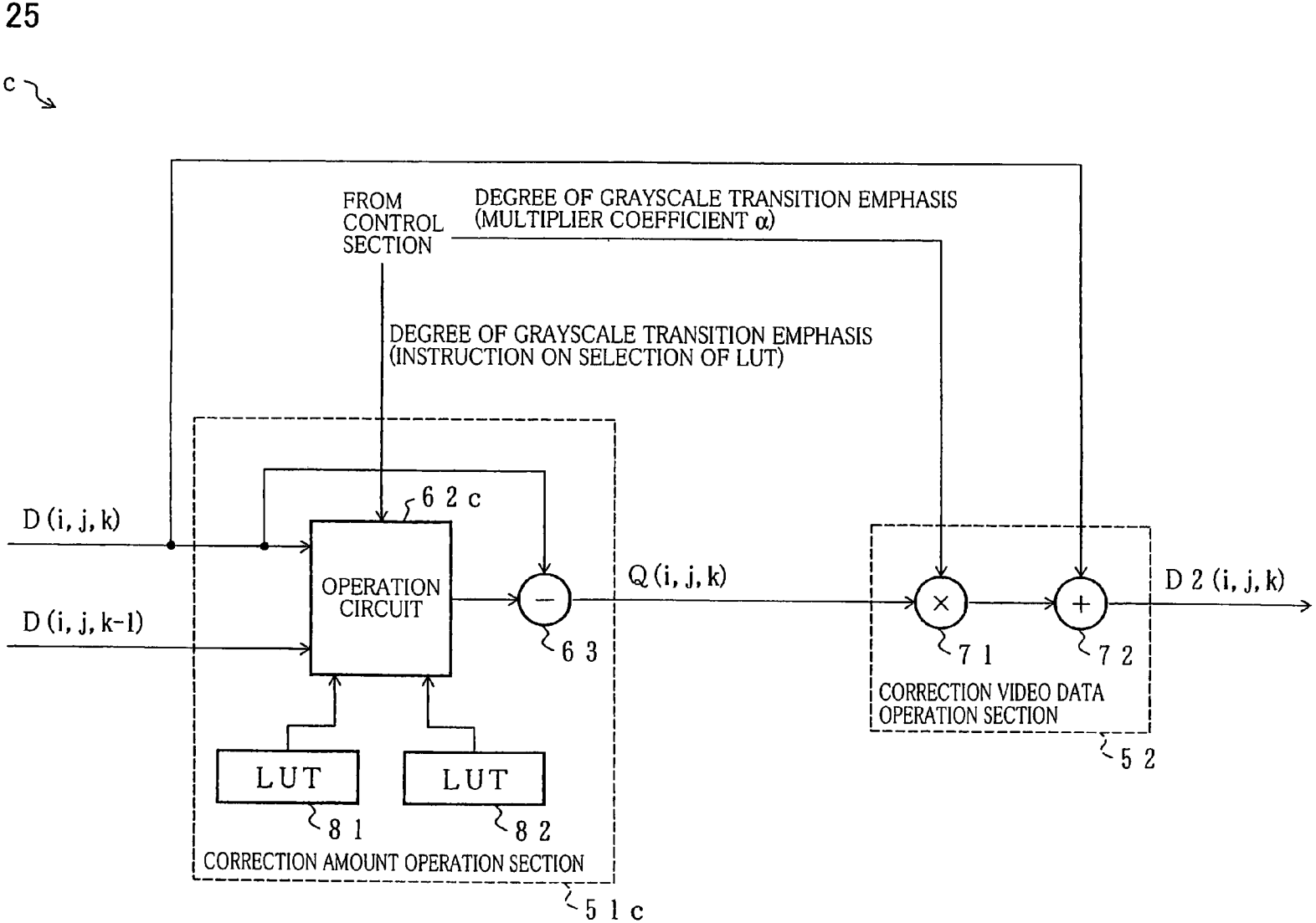
FIG. 25 illustrates a structural example of a modulation processing section provided in the signal processing section and is a block diagram illustrating essential components of the modulation processing section.
Figure 26:
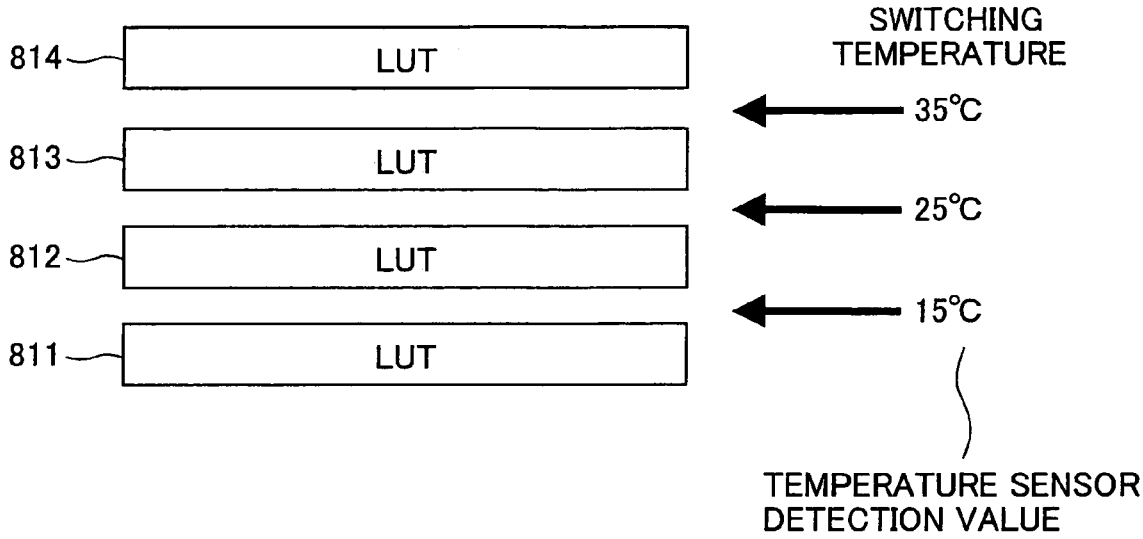
FIG. 26 is a view illustrating a relationship between look up tables provided in the signal processing section.

The following will describe still another structural example with reference to FIGS. 25 and 26. That is, in a signal processing section 21*c* according to the present structural example, LUTs corresponding to the respective temperature ranges are provided, while the LUTs referenced to for reference to correction video data D2 are shared between the I/P conversion methods used in the I/P conversion processing section 31.

More specifically, as illustrated in FIG. 25, the modulation processing section 33*c*, as with the modulation processing section 33 illustrated in FIG. 20, is provided with a correction amount operation section 51*c* and a correction video data operation section 52. However, in the present structural example, the correction amount operation section 51*c*, which is replaced with the correction amount operation section 51 illustrated in FIG. 20, is provided with the LUTs 81 and 82 corresponding the respective I/P conversion methods, as the LUTs referenced to by the operation circuit 62*c*. The operation circuit 62*c* references to a LUT instructed from the control section 34*c* so as to obtain correction video data D2(i, j, k) corresponding to (i) video data D(i, j, k) of the current frame FR(k) and (ii) video data D(i, j, k−1) of the previous frame FR(k−1).

Moreover, in the present structural example, the control section 34*c* shown in FIG. 23 makes instruction to the modulation processing section 33*c* about a combination of (a) a LUT corresponding to an I/P conversion method selected between the LUTs 81 and 82 and (b) multiplier coefficient α corresponding to a temperature detected by the temperature sensor 35*b*, as the degree of grayscale transition emphasis.

In the above arrangement, as illustrated in FIG. 26, the LUTs 81 and 82 corresponding to the respective I/P conversion methods are shared between the temperature ranges R1 through R4. Further, as in the arrangement of FIG. 20, the correction video data operation section 52 adjusts the correction amount Q in accordance with instructions from the control section 34*c*, so that the degree of grayscale transition emphasis is changed. Therefore, as shown in FIG. 22, a circuit scale can be reduced to be smaller than in the arrangement in which LUTs 811 through 824 are provided separately for respective combinations of a temperature range and an I/P conversion method.

Moreover, in the present structural example, the LUTs 81 and 82 corresponding to the I/P conversion methods are provided separately, and the LUTs referenced to by the operation circuit 62*c* are switched according to which of the I/P conversion methods is selected, so that the degree of grayscale transition emphasis is changed. There is therefore a weak correlation between sets of correction video data D2 which are suitable for the I/P conversion methods. Thus, it is possible to obtain correction video data D2 with a high precision, although in the arrangement illustrated in FIG. 20, i.e. the arrangement in which correction amount Q suitable for a certain I/P conversion method is adjusted to calculate correction video data D2 suitable for another I/P conversion method, there is a big difference between the thus calculated value and most suitable correction video data D2.

Therefore, it is possible to realize the image display device 1 which balances reduction in circuit scale and improvement in quality of video image displayed on the pixel array 2.

The above description has takes as an example the arrangement where the correction video data operation section 52 adjusts the correction amount Q according to an I/P conversion method, and the operation circuit 62*c* switches LUTs to reference to according to a temperature. Alternative arrangement may be adopted such that the LUTs referenced to by the operation circuit 62*c* are switched according to which temperature range a current temperature belongs to, and the correction video data operation section 52 adjust the correction amount Q according to an I/P conversion method. In this case, as illustrated in FIG. 26, the LUTs 811 though 814 corresponding to the respective R1 through R4 are shared between the I/P conversion methods. It is therefore possible to reduce a circuit scale to be smaller than in the arrangement where the LUTs 811 through 824 are provided separately. In addition, since the LUTs 811 through 814 corresponding to the respective temperature ranges R1 through R4 are provided separately, it is possible to find correction video data D2 with high precision even when there is a weak correlation between sets of correction video data D2 which are suitable for the I/P conversion methods.

However, the arrangement where the correction amount Q is adjusted responsive to a temperature as illustrated in FIG. 25 is more preferable in a case where there is a stronger correlation between sets of correction video data D2 suitable for the respective temperature ranges than between sets of correction video data D2 suitable for the I/P conversion methods, or in a case where there are few kinds of I/P conversion methods than the number of temperature ranges and reduction of a circuit scale is especially required.

Moreover, the above has described the arrangement in which the LUTs are shared between either I/P conversion methods or temperatures, and the correction amount is adjusted in accordance with one of an I/P conversion method or a temperature while the LUTs are switched in accordance with the other. However, alternatively, the LUTs may be shared between combinations of I/P conversion methods and temperatures, and the correction amount is adjusted in accordance with any of the combinations. However, the above arrangement can reduce a circuit scale because the LUTs are shared between either I/P conversion methods or temperatures, and the correction amount is adjusted in accordance with one of an I/P conversion method or a temperature while the LUTs are switched only in accordance with the other.

Still further, the above description has taken as an example the arrangement in which the operation circuit 62*c* carries out interpolation operation, in order to reduce a circuit scale of the LUTs. Alternatively, as mentioned previously, interpolation operation may not be carried out, but the correction video data D2 corresponding to the combinations (for example, 256×256 combinations) of all the grayscale levels may be stored and used. In this case, the operation circuit 62*c* switches the LUTs for reference according to instructions from the control section 34*c*, and outputs correction video data D2(i, j, k) stored in a LUT corresponding to vide data D(i, j, k) of the current frame FR(k) and video data D(i, j, k−1) of the previous frame FR(k−1). Yet further, the above description has taken as an example the arrangement in which the correction video data D2 is stored in the LUT, and the control section 34*c* instructs the correction video data operation section 52 on a multiplier coefficient so as to adjust the correction amount Q. As mentioned previously, the correction amount may be stored in the LUT and the correction amount Q may be adjusted with other operations.

The following will describe, with reference to FIGS. 27 through 30, an arrangement in which the degree of grayscale transition emphasis can be changed in accordance with an I/P conversion method, without providing the correction video data operation section 52 while sharing LUTs between I/P conversion methods.

Figure 27:
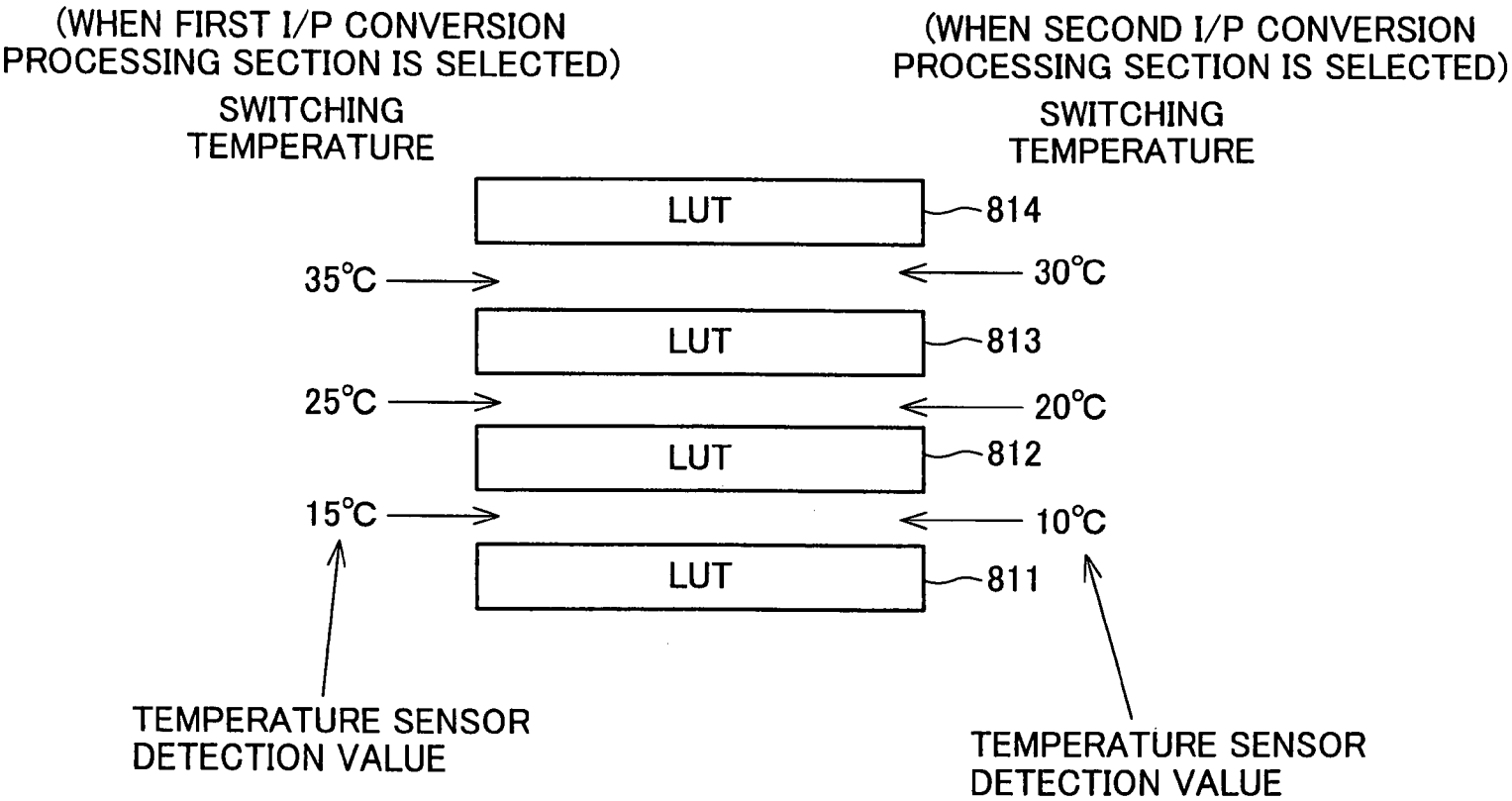
FIG. 27 illustrates another structural example and is a view illustrating a relationship between look up tables provided in the signal processing section.

That is, as shown in FIG. 27, in a signal processing section 21*d* according to the present structural example, as in FIG. 26, the LUTs are shared between the I/P conversion methods, and a modulation processing section 33*c* illustrated in FIG. 22 is provided as the modulation processing section.

However, in the present structural example, as shown in FIG. 27, a temperature at which the LUTs are switched is set differently for every I/P conversion method, and the control section 34*d* makes instruction on switching of the LUTs in such a manner that switching to a LUT corresponding to a higher temperature range is performed at a lower temperature for an I/P conversion method for which the degree of grayscale transition emphasis should be set to be lower.

For example, the following description will take as an example an arrangement in which the LUTs 811 through 814 corresponding to four temperature ranges R1 through R4 are provided. In a case where the I/P conversion method for which the degree of grayscale transition emphasis should be set to be higher is selected, i.e. in a case where the first I/P conversion process section 41 is selected, the control section 34*c* instructs, at the time when a device internal temperature exceeds 15° C., to switch to the LUT 812 corresponding to a higher temperature range.

On the other hand, in a case where the I/P conversion method for which the degree of grayscale transition emphasis should be set to be lower is selected, i.e. in a case where the second I/P conversion process section 42 is selected, the control section 34*c* instructs to switch to the LUT 812 corresponding to a higher temperature range, at the time when a device internal temperature becomes a temperature lower than the temperature in a case where the first I/P conversion processing section 41 is selected (in an example of FIG. 27, at the time when a device internal temperature exceeds 10° C.).

Here, as mentioned previously, for the LUTs corresponding to higher temperature ranges among the LUTs 811 through 814, the degree of grayscale transition emphasis is set to be lower. Therefore, when the control section 34*c* makes instruction about switching of the LUTs, as mentioned previously, as the instruction about the degree of grayscale transition emphasis, if the degree of grayscale transition emphasis is compared under the same condition of temperature, the degree of grayscale transition emphasis for the second I/P conversion processing section 42 can be set to be equal or lower than the degree of grayscale transition emphasis for the first I/P conversion processing section 41. As a result, even though the correction video data operation section 52 is not provided, the degree of grayscale transition emphasis can be changed according to an I/P conversion method. In addition, as shown in FIG. 25, a circuit scale can be reduced to be smaller than the arrangement in which the correction video data operation section 52 is provided.

Figure 28:
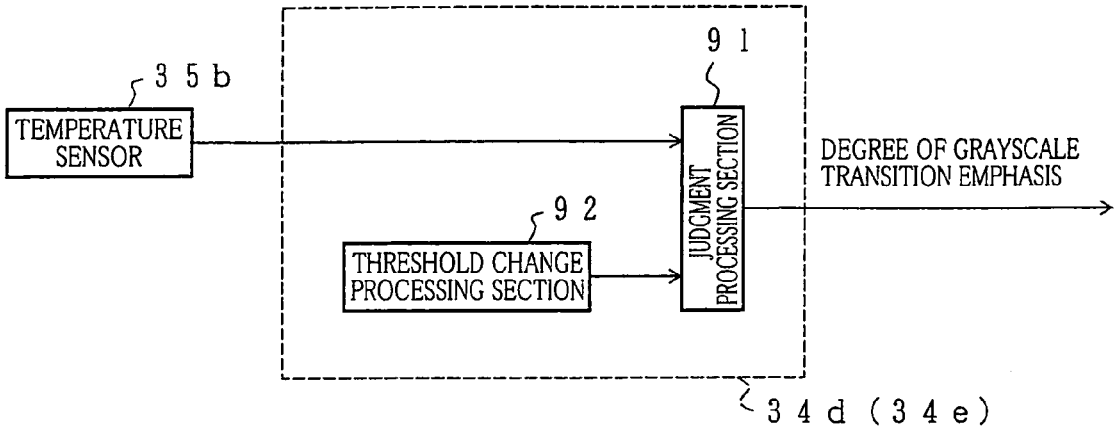
FIG. 28 illustrates structural example of a control section provided in the signal processing section and is a block diagram illustrating essential components of the control section.
Figure 29:
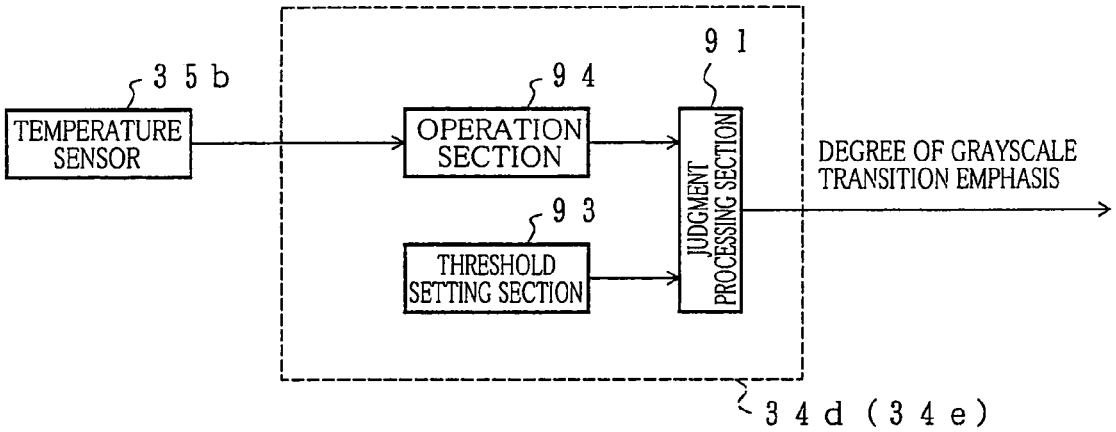
FIG. 29 illustrates another structural example of the control section and is a block diagram illustrating essential components of the control section.
Figure 30:
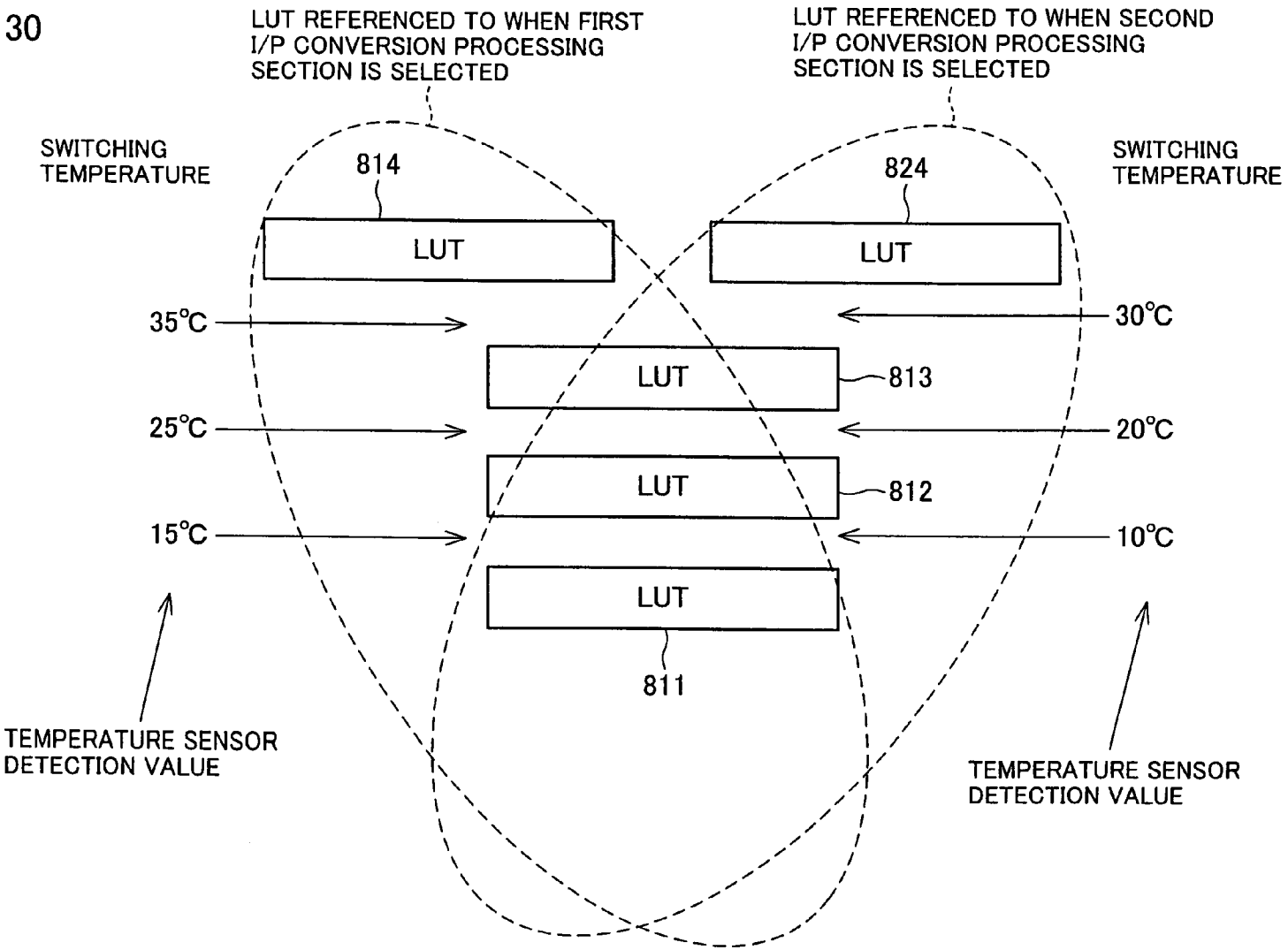
FIG. 30 illustrates another structural example and is a view illustrating a relationship between look up tables provided in the signal processing section.
Figure 31:
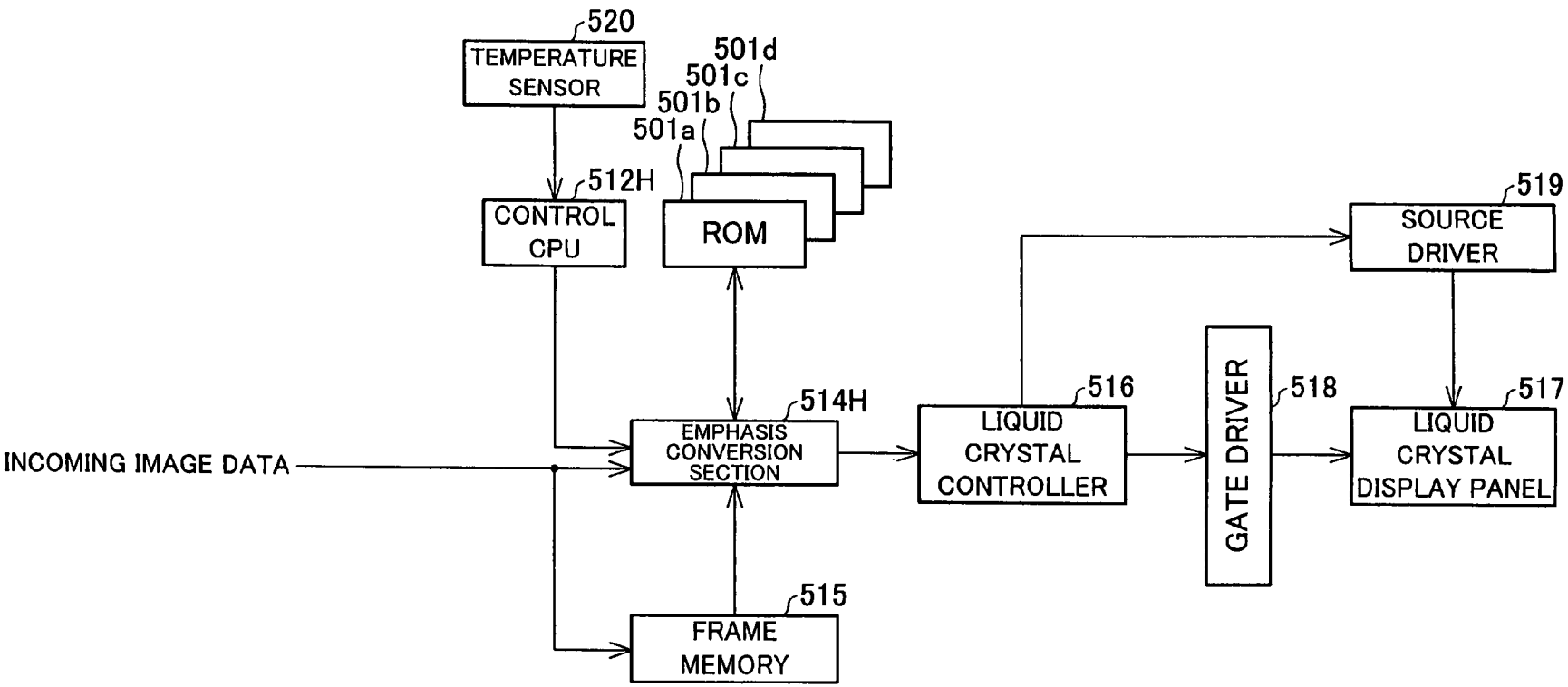
FIG. 31 is a diagram illustrating a structural example of the conventional liquid crystal display device.
Figure 32:
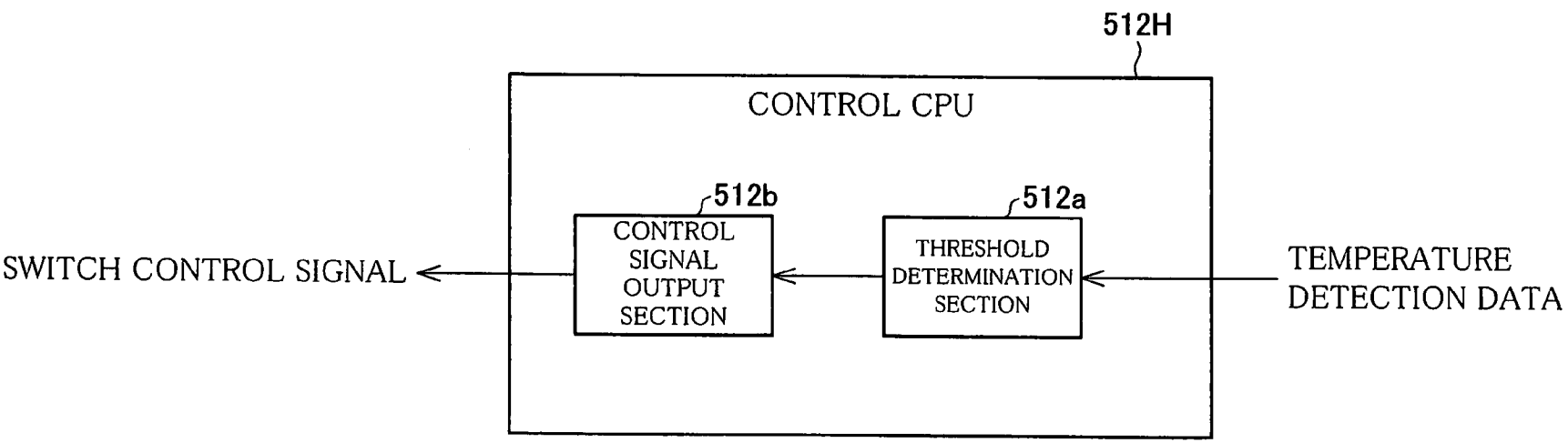
FIG. 32 is a diagram illustrating a structural example of a control CPU of FIG. 31.
Figure 33:
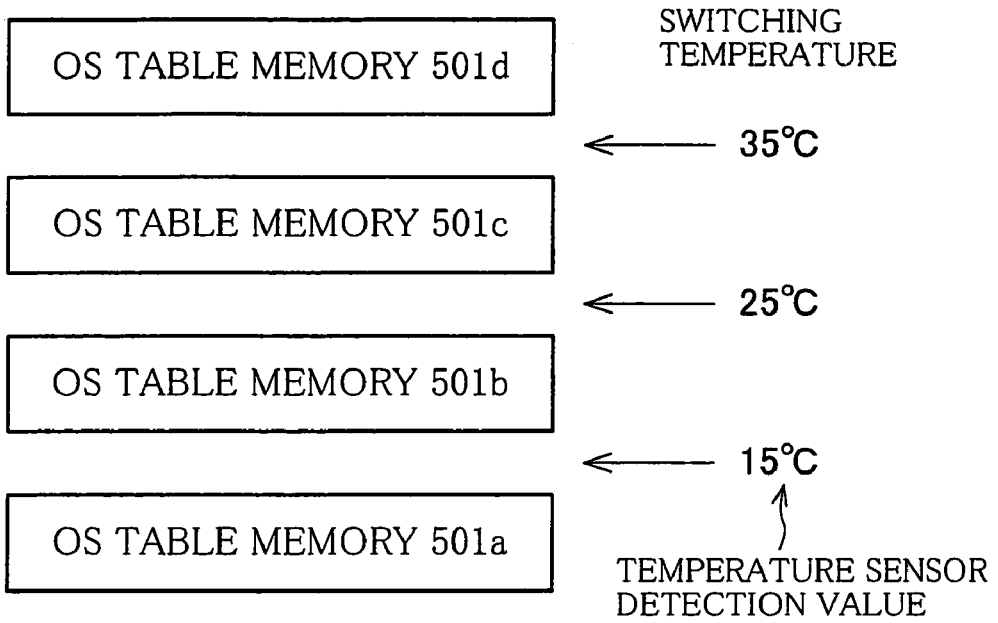
FIG. 33 is an explanatory diagram illustrating an operation of performing switching between OS table memories (ROMs) of FIG. 31 to select one of them in accordance with a device internal temperature.
Figure 34:
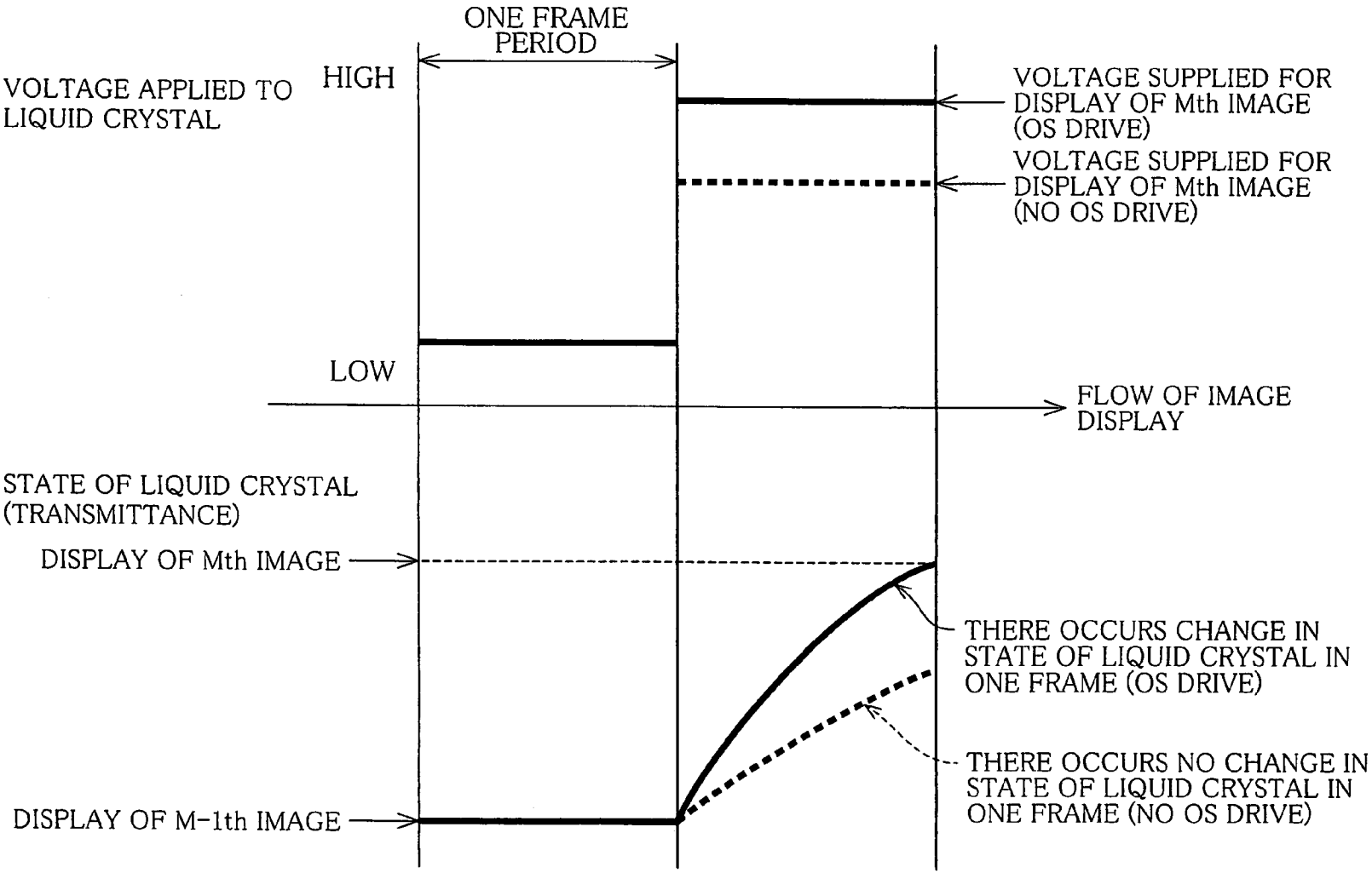
FIG. 34 is a diagram for explaining overshoot driving of the liquid crystal display device of FIG. 31.

The control section 34*d* can be arranged, for example, as shown in FIG. 28 or 29. More specifically, the control section 34*d* shown in FIG. 28 includes a judgment processing section 91 and a threshold change processing section 92. The judgment processing section 91 compares a detection value indicative of a temperature detected by the temperature sensor 35*b* with a designated threshold value to judge which temperature range the temperature detected by the temperature sensor 35*b* belongs to. Then, the judgment processing section 91 instructs the modulation processing section 33*c* to select a LUT determined according to a judgment result. The threshold change processing section 92 changes a threshold value to be designated to the judgment processing section 91, in accordance with an I/P conversion method used in the I/P conversion processing section 31.

For example, the following description will take the arrangement in which switching temperatures are temperatures shows in FIG. 27. The threshold change processing section 92 designates 15° C., 25° C., and 35° C. as threshold values, when the first I/P conversion processing section 41 is selected. With this, the judgment processing section 91 instructs to select the LUT 811 when a temperature is in a temperature range of 15° C. or lower. Further, the judgment processing section 91 instructs to select the LUT 812 when a temperature is in a temperature range of higher than 15° C. but not higher than 25° C. Still further, the judgment processing section 91 instructs to select the LUT 813 when a temperature is in a temperature range of higher than 25° C. but not higher than 35° C. Yet further, the judgment processing section 91 instructs to select the LUT 814 when a temperature is in a temperature range of 35° C. or higher.

On the other hand, the threshold change processing section 92 designates 10° C., 20° C., and 30° C. as threshold values, when the second I/P conversion processing section 42 is selected. With this, the judgment processing section 91 instructs to select the LUT 811 when a temperature is in a temperature range of 10° C. or lower. Further, the judgment processing section 91 instructs to select the LUT 812 when a temperature is in a temperature range of higher than 10° C. but not higher than 20° C. Still further, the judgment processing section 91 instructs to select the LUT 813 when a temperature is in a temperature range of higher than 20° C. but not higher than 30° C. Yet further, the judgment processing section 91 instructs to select the LUT 814 when a temperature is in a temperature range of 30° C. or higher.

Thus, for an I/P conversion method for which the degree of grayscale transition emphasis should be set to be lower, the control section 34*d* shown in FIG. 28 can instruct to switch the LUTs at the time of a lower temperature, so as to issue instruction on switching to a LUT corresponding to higher temperature range.

In the above arrangement, the switching temperature is changed by changing a threshold value to be compared with the detection value of the temperature sensor 35*b* in accordance with an I/P conversion method. Alternatively, regardless of I/P conversion methods, the threshold values may be fixed and the detection value of the temperature sensor 35*b* may be changed before the judgment of the judgment processing section 91.

More specifically, the control section 34*d* shown in FIG. 29 is provided with a threshold setting section 93 which gives fixed threshold values regardless of I/P conversion methods to the judgment processing section 91, instead of the threshold change processing section 92. Further, between the temperature sensor 35*b* and the judgment processing section 91, an operation section 94 for changing a detection value of the temperature sensor 35*b* in accordance with an I/P conversion method is provided.

For example, the following will describe taking as an example an arrangement in which the switching temperatures are temperatures illustrated in FIG. 27. In a situation where the second I/P conversion processing section 42 is selected, the operation section 94 controls a detection value of the temperature sensor 35*b* so as to be higher by 5° C. than in a situation where the first I/P conversion processing section 41 is selected. As an example, assuming that the threshold setting section 93 gives the judgment processing section 91 15° C., 25° C., and 35° C. as fixed threshold values, the operation section 94 does not change the detection value when the first I/P conversion processing section 41 is selected. However, when the second I/P conversion processing section 42 is selected, the operation section 94 add 5° C. to the temperature detection value.

Thus, even in the arrangement in which a temperature detection value is changed according to an I/P conversion method, the control section 34*d* can instruct to switch to a LUT corresponding to higher temperature range, at the time of a lower temperature, for an I/P conversion method for which the degree of grayscale transition emphasis should be set to be lower.

Here, the above description has taken as an example the arrangement in which all of the LUTs are shared between I/P conversion methods, with reference to FIGS. 25 through 29. However, this is not the only possibility, and part of the LUTs may be shared. Note that the arrangement in which part of the LUTs is shared is applicable to the arrangement in which the correction video data operation section 52 is provided, as illustrated in FIGS. 25 and 26. However, referring to FIG. 30, the following description will take, as an example, an arrangement in which LUT switching temperatures are changed in the absence of the correction video data operation section 52, as in FIG. 27.

That is, in a signal processing section 21*e* according to the present structural example, as in FIG. 27, LUTs 811 through 813 are shared between the I/P conversion methods. However, regarding temperature ranges for the lowest degrees of grayscale transition emphasis, different LUTs 814 and 824 are provided for the respective I/P conversion methods, as in the case of the modulation processing section 33*e* illustrated in FIG. 22. The LUT 814 corresponds to the first I/P conversion processing section 41, and the LUT 824 corresponds to the second I/P conversion processing section 42.

In connection with this, the control section 34*e*, as with the control section 34*d* shown in FIG. 22, instructs to switch the LUTs so that switching to a LUT corresponding to higher temperature range can be performed at the time of a lower temperature for an I/P conversion method for which the degree of grayscale transition emphasis should be set to be lower. In each of the I/P conversion methods, when a temperature detected by the temperature sensor 35*b* belongs to the highest temperature range, the control section 34*e* instructs the modulation processing section 33*e* to select a LUT corresponding to the currently selected I/P conversion method from between the LUTs 814 and 824 provided for the respective I/P conversion methods.

In this arrangement, part of LUTs corresponding to the respective temperature ranges are shared between the I/P conversion methods. This arrangement can reduce a circuit scale required for the LUTs to be smaller than the arrangement in which mutually different LUTs are provided for the I/P conversion methods. On the other hand, for the other temperature range, another LUT is provided for every I/P conversion method. This makes it possible to emphasize grayscale transition emphasis with a degree suitable for each of the I/P conversion methods, even in a case where there exist temperature ranges which cannot emphasize grayscale transition appropriately when the LUTs are shared between the I/P conversion methods. As a result of this, it is possible to realize the image display device 1 which balances reduction in circuit scale and improvement in quality of video image displayed on the pixel array 2.

Note that in the present embodiment, as in Ninth Embodiment, even a case where the progressive video signal is supplied is treated as in a case where a certain I/P conversion method is selected. For example, the degree of grayscale transition emphasis may be changed in an arrangement such that LUTs dedicated for progressive video signal are provided for the modulation processing section so that the control section 34 makes instruction on selection of the LUT, designates a multiplier coefficient for progressive video signal, or makes instruction on switching of the LUTs with switching temperatures for progressive video signal.

Here, generally, undesirable grayscale transition resulting from I/P conversion does not occur in a case where a progressive video signal is supplied, as compared with in a case where an interlaced video signal is supplied. Therefore, in a case where an interlaced video signal is supplied, the degree of grayscale transition emphasis is set to be lower than in a case where a progressive video signal is supplied. This allows for improvement in optical response speed, without degradation in quality of video image displayed on the pixel array 2.

With this arrangement, the degree of grayscale transition emphasis can be changed according to whether the I/P conversion is required and according to a combination of an I/P conversion method and a temperature. Even in a case where a progressive video signal is supplied and whichever I/P conversion method is selected, a high-definition image can be always displayed on the pixel array 2.

By the way, in Ninth and Tenth Embodiments, the modulation processing section (33 through 33*e*) corrects video data D(i, j, k) in accordance with video data D(i, j, k−1) of a previous frame and video data D(i, j, k) of a current frame, so that grayscale transition from the previous frame to the current frame can be emphasized. However, this is not the only possibility. The grayscale transition may be emphasized, referring to video data D(i, j, k−2) of a second previous frame or others as well as the video data D(i, j, k−1) of a previous frame and the video data D(i, j, k) of a current frame. At least, the same effect can be obtained as long as grayscale transition from a previous frame to a current frame can be emphasized in accordance with the video data D(i, j, k−1) of a previous frame and the video data D(i, j, k) of a current frame. However, as in the foregoing embodiments, grayscale transition emphasis based on the video data D(i, j, k−1) of a previous frame and the video data D(i, j, k) of a current frame can reduce the amount of data to be stored and a circuit scale to be smaller than grayscale transition emphasis based on the video data D of a second previous frame as well as the video data D(i, j, k−1) of a previous frame and the video data D(i, j, k) of a current frame.

The descriptions in the foregoing embodiments took as an example cases where among members constituting the signal processing section, the control sections (34 to 34*e*) are "functional blocks realized by a CPU or other computing means executing program code contained in a ROM, RAM, or other storage medium", and the other members are realized by hardware. Alternatively, the control section may be realized by hardware carrying out the same processes, and the other members may be realized by the same functional block as the control section. Further, the members constituting the signal processing section 21 can be realized by a combination of hardware carrying out some of the processes and computing means controlling the hardware and executing program code for the other processes.

Further, those members which were described as hardware may be realized by a combination of hardware carrying out some of the processes and computing means controlling the hardware and executing program code for the other processes. The computing means may be a single entity, or a set of computing means connected over internal device bus and various communications paths may work together to execute program code. Among those members, a storage section (frame memory, LUT, and others) may be a storage device itself such as memory. Needles to say, the selector 43 is not limited to switching element of hardware, and can be anything as long as the selector 43 can cause one of the I/P conversion methods to be selectively functioned.

The program code itself directly executable by the computing means or the program as data that can generate program code by decompression or an other process (detailed later) is executed by the computing means after the program (program code or the data) is recorded and distributed on a storage medium or the program is transmitted and distributed over communications means which transmits the program over wired or wireless communications paths.

To transmit over a communications path, a program is transmitted though the communications path by means of a series of signals indicative of a program which propagate through the transmission media constituting the communications path. To transmit a series of signals, a transmitter device may modulate a carrier wave with the series of signals indicative of the program to transmit the series of signals on the carrier wave. In this case, a receiver device will restore the series of signals by demodulating the carrier wave.

Meanwhile, when transmitting the series of signals, the transmitter device may divides the series of signals as a series of digital data into packets for a transmission. In this case, the receiver device will combine received group of packets to restore the series of signals. In addition, the transmitter device may transmit the series of signals by time division, frequency division, code division, or another multiplex scheme involving the series of signals and another series of signals. When this is the case, the receiver device will extract individual series of signals from a multiplex series of signals to restore them. In any case, similar effects are obtained if the program can be transmitted over a communications path.

Here, the storage medium for the distribution of a program is preferable removable. After the distribution of the program, the storage medium may or may not be removable. In addition, the storage medium may or may not be rewritable (writable) or volatile, be recordable by any method, and come in any shape at all, provided that the medium can hold the program. Examples of such a storage medium include tapes, such as magnetism tapes and cassette tapes; magnetic disks, such as floppy (registered trademark) disks and hard disks; and other discs, such as CD-ROMs, magneto-optical discs (MOs), mini discs (MDs), and digital video discs (DVDs). In addition, the storage medium may be a card, such as an IC card or an optical card; a semiconductor memory, such as a mask ROM, an EPROM, an EEPROM, or a flash ROM; or a memory provided inside a CPU or other computing means.

The program code may be such that it instructs the computing means regarding all the procedures of the processes. If there is already a basic computer program (for example, an operating system or library) which can be retrieved by a predetermined procedure to execute all or some of the processes, code or a pointer which instructs the computing means to retrieve that basic computer program can replace all or some of the processes.

In addition, the program storage format of the storage medium may be, for example, such that: the computing means can access the program for an execution as in an actual memory having loaded the program; the program is not loaded into an actual memory, but installed in a local storage medium (for example, an actual memory or hard disk) always accessible to the computing means; or the program is stored before installing in a local storage medium from a network or a mobile storage medium.

In addition, the program is not limited to compiled object code. The program may be stored as source code or intermediate code generated in the course of interpretation or compilation. In any case, similar effects are obtained regardless of the format in which the storage medium stores the program, provided that decompression of compressed information, decoding of encoded information, interpretation, compilation, links, or loading to an memory or combinations of these processes can convert into a format executable by the computing means.

Note that a liquid crystal display device according to the foregoing embodiments is a liquid crystal display device which carries out emphasis conversion on video data supplied to a liquid crystal display panel in accordance with at least video data of previous vertical period and video data of current vertical period, thereby compensating for optical response properties of the liquid crystal display panel, the liquid crystal display device comprising: I/P conversion means which, when incoming video data is an interlaced signal, converts the interlaced signal into a progressive signal in accordance with any one of two or more conversion methods; and emphasis conversion means which carries out emphasis conversion on the video data having been subjected to the conversion so that the liquid crystal display panel provides a transmittance defined by the video data within a predetermined period, wherein a degree of the emphasis conversion on the video data is controlled so as to be changed in accordance with which kind of conversion method among the two or more conversion methods is used for the conversion.

A program according to the foregoing embodiments is a program causing a computer to execute a process of controlling a degree of emphasis conversion on video data so as to be changed in accordance with which kind of conversion method among two or more conversion methods is used for the conversion, the computer controlling a liquid crystal display device comprising: an I/P conversion means which, when incoming video data is an interlaced signal, converts the interlaced signal into a progressive signal in accordance with any one of two or more conversion methods; and emphasis conversion means which carries out emphasis conversion on the video data having been subjected to the conversion so that the liquid crystal display panel provides a transmittance defined by the video data within a predetermined period, and the liquid crystal display device carrying out emphasis conversion on video data supplied to a liquid crystal display panel in accordance with at least video data of previous vertical period and video data of current vertical period, thereby compensating for optical response properties of the liquid crystal display panel.

Further, a liquid crystal display control method according to the foregoing embodiments is a liquid crystal display control method of carrying out emphasis conversion on video data supplied to a liquid crystal display panel in accordance with at least video data of previous vertical period and video data of current vertical period, thereby compensating for optical response properties of the liquid crystal display panel, the method comprising the steps of: when incoming video data is an interlaced signal, converting the interlaced signal into a progressive signal in accordance with any one of two or more conversion methods; and carrying out emphasis conversion on the video data having been subjected to the conversion so that the liquid crystal display panel provides a transmittance defined by the video data within a predetermined period, wherein a degree of the emphasis conversion on the video data is controlled so as to be changed in accordance with which kind of conversion method among the two or more conversion methods is used for the conversion.

Still further, a liquid crystal display control method according to the foregoing embodiments is a liquid crystal display control method of carrying out comparison at least between video data of previous frame and video data of current frame, and performing emphasis conversion on video data supplied to a liquid crystal display panel in accordance with a result of the comparison, thereby compensating for optical response properties of the liquid crystal display panel, the method comprising the steps of: when incoming video data is an interlaced signal, converting the interlaced signal into a progressive signal in accordance with any one of two or more conversion methods; and carrying out emphasis conversion on the video data having been subjected to the conversion so that the liquid crystal display panel provides a transmittance defined by the video data within a predetermined period, wherein a degree of the emphasis conversion on the video data is controlled so as to be changed in accordance with which kind of conversion method among the two or more conversion methods is used for the conversion.

In addition to the above steps, the method may have: a step of referencing to a table memory which stores an emphasis conversion parameter determined by video data of current frame and video data of at least previous frame; a step of subjecting the video data to emphasis operation by using the emphasis conversion parameter; and a step of multiplying output data obtained by the emphasis operation by a different coefficient varying depending upon which kind of conversion method among the two or more conversion methods is used for the conversion.

In addition to the above steps, the method may have: a step of referencing to a table memory which is referenced to when incoming vide data is converted by a first conversion method, and stores an emphasis conversion parameter determined by video data of current frame and video data of at least previous frame; a step of referencing to a table memory which is referenced to when incoming vide data is converted by a second conversion method, and stores an emphasis conversion parameter determined by video data of current frame and video data of at least previous frame; and a step of performing emphasis operation on the video data obtained by the conversion by using the emphasis conversion parameter which is read from the table memory determined by which kind of conversion method among the two or more conversion methods is used for the conversion.

In addition to the above steps, the method may have: a step of detecting a device internal temperature; and a step of changing the degree of emphasis conversion performed on the video data in accordance with a detection result of the device internal temperature.

In addition to the above steps, the method may have: a step of referencing to table memory which stores an emphasis conversion parameter determined by video data of current frame and video data of at least previous frame; a step of performing emphasis operation on the video data obtained by the conversion, by using the emphasis conversion parameter; and a step of multiplying output data obtained by the emphasis operation by a coefficient varying depending upon (i) which kind of conversion method among the two or more conversion methods is used for the conversion and (ii) a detection result of the device internal temperature.

In addition to the above steps, the method may have: a step of referencing to a table memory which is referenced to when incoming vide data is converted by a first conversion method, and stores an emphasis conversion parameter determined by video data of current frame and video data of at least previous frame; a step of referencing to a table memory which is referenced to when incoming vide data is converted by a second conversion method, and stores an emphasis conversion parameter determined by video data of current frame and video data of at least previous frame; a step of performing emphasis operation on the video data obtained by the conversion by using the emphasis conversion parameter which is read from the table memory determined by which kind of conversion method among the two or more conversion methods is used for the conversion; and a step of multiplying output data obtained by the emphasis operation by a coefficient varying depending upon a detection result of the device internal temperature.

In addition to the above steps, the method may have: a step of referencing to table memories which are referenced to when incoming video data is converted by a first conversion method, and store emphasis conversion parameters respectively associated with a plurality of device internal temperatures, the emphasis conversion parameters each being determined by video data of current frame and video data of at least previous frame; a step of referencing to table memories which are referenced to when incoming video data is converted by a second conversion method, and store emphasis conversion parameters respectively associated with a plurality of device internal temperatures, the emphasis conversion parameters each being determined by video data of current frame and video data of at least previous frame; and a step of performing emphasis operation on the video data obtained by the conversion by using the emphasis conversion parameter which is read from the table memory determined by (i) which kind of conversion method among the two or more conversion methods is used for the conversion and (ii) a detection result of the device internal temperature.

In addition to the above steps, the method may have: a step of referencing to table memories which store emphasis conversion parameters respectively associated with a plurality of device internal temperatures, the emphasis conversion parameters each being determined by video data of current frame and video data of at least previous frame; and a step of performing emphasis operation on the video data obtained by the conversion by using the emphasis conversion parameter which is read from the table memory determined by a result of comparison between (i) a switching temperature determined by which kind of conversion method among the two or more conversion methods is used for the conversion and (ii) a detection result of the device internal temperature.

In addition to the above steps, the method may have: a step of performing a predetermined operation on temperature data that is the detection result of the device internal temperature, the operation being determined for each of the two or more conversion methods; a step of comparing between the temperature data having been subjected to the operation and given threshold temperature data determined in advance; and a step of generating a switching control signal for controlling switching of the emphasis conversion parameters, in accordance with a result of the comparison.

In addition to the above steps, the method may have: a step of comparing between temperature data that is the detection result of the device internal temperature and a given threshold temperature data determined for each of the two or more conversion methods; and a step of generating a switching control signal for controlling switching of the emphasis conversion parameters, in accordance with a result of the comparison.

Note that the foregoing embodiments have taken as an example a case where an image display device adopts a driving method such that a whole video image of video data of one frame is subjected to write scanning over one frame period of the video data (e.g. 16.7 msec), i.e. a driving method such that one vertical period (one frame period) is equal to one vertical display period. However, this is not the only possibility. For example, the following driving method (pseudo-impulse driving method) may be adopted in an image display device such as a liquid crystal display device, such that one frame period is divided into a period during which video image is displayed (video display period) and a period during which black is displayed (e.g. black display) (dark display period).

Further, the foregoing embodiments have taken as an example a case where emphasis conversion data corresponding to a combination of incoming video data of previous frame and incoming video data of current frame is outputted to the control circuit 12. However, this is not the only possibility. For example, emphasis conversion data may be determined with reference to not only incoming video data of previous frame but also incoming video data of further previous frame (e.g. incoming video data of second previous frame). In either case, the same effect can be obtained as long as emphasis conversion data is determined with reference to at least incoming video data of previous frame. However, in order to determine emphasis conversion data with reference to incoming video data of further previous frame, a frame memory with a larger storage capacity is required. Therefore, when reduction of a storage capacity is demanded, it is desirable to determine emphasis conversion with reference to only incoming video data of previous frame and incoming video data of current frame among the sets of incoming video data of any frames, as in the foregoing embodiments.

In the foregoing embodiments, emphasis conversion data is outputted to the control circuit 12, after reference to incoming video data of previous frame. Alternatively, instead of an actually incoming video data of previous frame, a prediction value obtained by prediction of a grayscale level which a pixel of a liquid crystal panel actually reaches by writing of incoming video data of previous frame may be referenced to as the incoming video data of previous frame (previous data). Even in this case, incoming video data of previous frame is referenced to for prediction of a reached grayscale level. In either case, the same effect ban be obtained as long as emphasis conversion data is determined based on incoming video data of at least previous frame and incoming video data of current frame.

Note that in the foregoing embodiments have taken as an example a case where the modulation processing section 33 (33*a*) performs emphasis conversion with reference to correction video data D2(i,j,k) that is a parameter (emphasis conversion parameter) stored in the LUT 61 or LUTs 81 and 82, which are OS table memories. However, this is not the only possibility. For example, the modulation processing section may calculate correction (emphasis) conversion data for compensating for optical response properties of the liquie crystal display panel 11, by using a function such as a quadratic function f (Current Data, Previous Data) including variables, i.e. incoming video data of Mth frame (Current Data) and incoming video data of M−1th frame stored in the frame memory 32 (Previous Data).

The embodiments and concrete examples of implementation discussed in the foregoing best mode for carrying out the invention serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

Thus, according to the present invention, the degree of grayscale transition emphasis or the degree of emphasis conversion is changed in accordance with a conversion method of interlace/progressive conversion. This makes it possible to perform grayscale transition emphasis (emphasis conversion) with a suitable degree all the time whichever conversion method is used for generation of a progressive video signal. It is therefore possible to realize both improvement in response speed of the liquid crystal display device and improvement in quality of video image displayed on the liquid crystal display device. The present invention can be used preferably for the realization of a liquid crystal television receiver, a liquid crystal monitor, and various liquid crystal display devices.

The invention claimed is:

1. A signal processing unit for use in a liquid crystal display device, the signal processing unit comprising:

a conversion section which converts an interlaced video signal into a progressive video signal; and a correction section which corrects a video signal of current vertical period so as to emphasize grayscale transition at least from previous vertical period to current vertical period in the progressive video signal, wherein the conversion section is capable of conversions by two or more conversion methods, a degree of the grayscale transition emphasis performed by the correction section is changed in accordance with which conversion method among the two or more conversion methods is used by the conversion section, the two or more conversion methods include a first conversion method of referencing to a video signal of other field for conversion and a second conversion method of not referencing to a video signal of other field for conversion, and in a case where the conversion section performs conversion by the second conversion method, a degree of grayscale transition emphasis performed by the correction section is changed to be lower than in a case where the conversion section performs conversion by the first conversion method.

2. The signal processing unit for use in a liquid crystal display device according to claim 1, wherein:

the two or more conversion methods include a first conversion method of performing motion detection between fields and a second conversion method of performing conversion in a given procedure regardless of presence or absence of motion between fields, and in a case where the conversion section performs conversion by the second conversion method, a degree of grayscale transition emphasis performed by the correction section is changed to be lower than in a case where the conversion section performs conversion by the first conversion method.

3. The signal processing unit for use in a liquid crystal display device according to claim 2, wherein:

the second conversion method is a method of copying a video signal in a certain field, or averaging sets of video signals in a certain field or averaging sets of video signals in a certain field while being weighted, so as to convert the video signal in the field into a progressive video signal.

4. The signal processing unit for use in a liquid crystal display device according to claim 1, wherein:

the two or more conversion methods include a first conversion method of performing conversion by motion prediction between fields and a second conversion method of performing conversion in a given procedure regardless of presence or absence of motion between fields, and in a case where the conversion section performs conversion by the second conversion method, a degree of grayscale transition emphasis performed by the correction section is changed to be lower than in a case where the conversion section performs conversion by the first conversion method.

5. The signal processing unit for use in a liquid crystal display device according to claim 4, wherein:

the second conversion method is a method of copying a video signal in a certain field, or averaging sets of video signals in a certain field or averaging sets of video signals in a certain field while being weighted, so as to convert the video signal in the field into a progressive video signal.

6. The signal processing unit for use in a liquid crystal display device according to claim 1, wherein:

the correction section includes a plurality of table memories each of which stores emphasis conversion parameter determined by at least the video signal of previous vertical period and the video signal of current vertical period, and the table memories referenced to by the correction section are switched in accordance with a conversion method used by the conversion section, so that the degree of the grayscale transition emphasis is changed.

7. The signal processing unit for use in a liquid crystal display device according to claim 1, wherein:

the correction section includes: a table memory which stores an emphasis conversion parameter determined by at least the video signal of previous vertical period and the video signal of current vertical period; and an adjustment section which adjusts a correction amount for the video signal of current vertical period in accordance with the degree of grayscale transition emphasis, the correction amount being determined with reference to the table memory.

8. The signal processing unit for use in a liquid crystal display device according to claim 1, wherein:

the degree of grayscale transition emphasis performed by the correction section is changed in accordance with not only the conversion method used by the conversion section but also a device internal temperature.

9. The signal processing unit for use in a liquid crystal display device according to claim 8, wherein:

the correction section includes a plurality of table memories each of which stores emphasis conversion parameter determined by at least the video signal of previous vertical period and the video signal of current vertical period, and the table memories referenced to by the correction section are switched in accordance with (a) the conversion method used by the conversion section and (b) the device internal temperature, so that the degree of the grayscale transition emphasis is changed.

10. The signal processing unit for use in a liquid crystal display device according to claim 8, wherein:

the correction section includes a plurality of table memories each of which stores an emphasis conversion parameter determined by at least the video signal of previous vertical period and the video signal of current vertical period, the correction section further includes an adjustment section which adjusts a correction amount for the video signal of current vertical period, the correction amount being determined with reference to any one of the table memories, and a degree of the adjustment performed by the adjustment section is changed in accordance with a device internal temperature, and the table memories referenced to by the correction section are switched in accordance with the conversion method used by the conversion section, so that the degree of the grayscale transition emphasis is changed.

11. The signal processing unit for use in a liquid crystal display device according to claim 8, wherein:

the correction section includes a plurality of table memories each of which stores an emphasis conversion parameter determined by at least the video signal of previous vertical period and the video signal of current vertical period, at least part of the table memories are shared between the two or more conversion methods used by the conversion section, and the table memories referenced to by the correction section are switched in accordance with the device internal temperature, and switching temperatures for switching between the table memories are changed in accordance with the conversion method used by the conversion section, so that the degree of the grayscale transition emphasis is changed.

12. The signal processing unit for use in a liquid crystal display device according to claim 11, wherein:

the table memories are switched in such a manner that part of the table memories is referenced only when the conversion section performs conversion by a particular conversion method.

13. A liquid crystal display device including the signal processing unit according to claim 1.

14. The signal processing unit for use in a liquid crystal display device according to claim 1, wherein:

the second conversion method is a method of copying a video signal in a certain field so as to convert the video signal in the field into a progressive video signal.

15. The signal processing unit for use in a liquid crystal display device according to claim 1, wherein:

the second conversion method is a method of averaging sets of video signals in a certain field so as to convert the video signal in the field into a progressive video signal.

16. The signal processing unit for use in a liquid crystal display device according to claim 1, wherein:

the second conversion method is a method of averaging sets of video signals in a certain field while being weighted, so as to convert the video signal in the field into a progressive video signal.

* * * * *